US008310162B2

(12) United States Patent
Nakajo et al.

(10) Patent No.: US 8,310,162 B2
(45) Date of Patent: Nov. 13, 2012

(54) LIGHTING APPARATUS AND LIGHTING FIXTURE

(75) Inventors: Akira Nakajo, Kyoto (JP); Hiroshi Kido, Hirakata (JP); Ryusuke Ura, Osaka (JP); Hidenori Kakehashi, Takatsuki (JP); Kohji Hiramatsu, Hirakata (JP); Katsuyoshi Goto, Hirakata (JP)

(73) Assignee: Panasonic Corporation, Osaka (JP)

( * ) Notice: Subject to any disclaimer, the term of this patent is extended or adjusted under 35 U.S.C. 154(b) by 169 days.

(21) Appl. No.: 12/858,646

(22) Filed: Aug. 18, 2010

(65) Prior Publication Data

US 2011/0095691 A1 Apr. 28, 2011

(30) Foreign Application Priority Data

Aug. 19, 2009 (JP) ..... 2009-190376
Sep. 25, 2009 (JP) ..... 2009-221603

(51) Int. Cl.
*H05B 37/04* (2006.01)
*H05B 37/03* (2006.01)

(52) U.S. Cl. ..... 315/133; 315/119

(58) Field of Classification Search ..... 315/133, 315/129, 119, 136, 360, 362, 74
See application file for complete search history.

(56) References Cited

U.S. PATENT DOCUMENTS 5,978,928 A 11/1999 Rust
6,348,766 B1 2/2002 Ohishi et al.
6,448,715 B1 * 9/2002 Fujiwara et al. ..... 315/129
2005/0184681 A1 8/2005 Gordin et al.

FOREIGN PATENT DOCUMENTS

EP 0 978 756 A1 2/2000
(Continued)

OTHER PUBLICATIONS

European Search Report for European Patent Application No. 10173404.4 issued Dec. 29, 2010.

*Primary Examiner* — Daniel D Chang
(74) *Attorney, Agent, or Firm* — Edwards Wildman Palmer LLP; James E. Armstrong, IV; Stephen D. LeBarron

(57) ABSTRACT

A lighting apparatus includes a lighting circuit unit, a timer unit, a life judgment unit, a timing adjustment unit, and an indication unit. The lighting circuit unit is configured to activate a light source. The timer unit is configured to measure accumulated operation time of the lighting circuit unit. The life judgment unit is configured to store a first judgment time and a second judgment time longer than the first judgment time. The life judgment unit is configured to compare the accumulated operation time with the first judgment time and output a first judgment signal when the accumulated operation time becomes equal to the first judgment time. The life judgment unit is configured to compare the accumulated operation time with the second judgment time and output a second judgment signal when the accumulated operation time becomes equal to the second judgment time. The timing adjustment unit is configured to vary timing at which the life judgment unit outputs the first judgment signal. The timing adjustment unit is configured to vary timing at which the life judgment unit outputs the second judgment signal. The indication unit is configured to indicate, upon receiving the first judgment signal from the life judgment unit, a first level of the end of life with the light source kept turned on. The indication unit is configured to indicate, upon receiving the second judgment signal from the life judgment unit, a second level of the end of life. The second level of the end of life is later than the first level of the end of life.

10 Claims, 26 Drawing Sheets

FOREIGN PATENT DOCUMENTS

| | | | |
|---|---|---|---|
| EP | 1 098 550 | A2 | 5/2001 |
| JP | 06-333687 | A | 12/1994 |
| JP | 11-191168 | A | 7/1999 |
| JP | 2006-236664 | A | 9/2006 |

* cited by examiner

LIGHTING APPARATUS AND LIGHTING FIXTURE

TECHNICAL FIELD

The present invention is directed to a lighting apparatus and a lighting fixture.

BACKGROUND ART

In the past, a lighting fixture including a lighting apparatus configured to turn on a light source (e.g., a discharge lamp, an incandescent lamp, and an LED) has been proposed. With respect to such the lighting fixture, when the light source comes close to the end of its life due to a long time use, a situation where the light source can not be turned on or the light source becomes hard to be turned on or the brightness of the light source is decreased occurs. Therefore, a user can easily recognize the end of life of the light source in view of the above situation. Then, the user replaces the light source.

Meanwhile, the lighting apparatus turning on the light source and a main body also have a useful life (that is, life). Long time use causes a situation, such as fatigue and/or oxidization of metal components of the lighting apparatus and/or the main body, deterioration, discoloration, and/or breakage of resin components thereof, and deterioration and/or decrease of dielectric resistance of circuit components of a lighting circuit. As mentioned in the above, both the lighting apparatus configured to turn on the light source and the main body have the life (lifetime). Even if the lighting apparatus and the main body come close to the end of life, a user is unlikely to know that the lighting apparatus and the main body come to the end of life while the light source is normally turned on. Therefore, the user often continues to use the lighting apparatus and the main body. When the user continues to use the lighting apparatus and the main body which have already come to the end of life, it is impossible to obtain a proper performance of the lighting fixture. In addition, breakage or fall of the main body is likely to occur depending on a deteriorated component thereof.

In contrast to an electric device such as the lighting fixture performing a lighting function by use of both the light source and the lighting apparatus, with respect to an electric device (e.g., TV receiver) performing a predetermined function alone, it is possible to determine that the TV receiver itself has been deteriorated when a performance of television viewing (e.g. sharpness of an image, color reproducibility and quality of sounds) is deteriorated. However, in a situation of the lighting fixture in which the lighting apparatus turns on the light source to perform the lighting function, it is difficult to distinguish the end of life of the lighting apparatus from the end of life of the light source. Therefore, it is difficult for a user to understand a degree of deterioration of the lighting apparatus. In some cases, the lighting apparatus having life of 10 years is likely to be used for at least 10 years or a few decades.

Therefore, in the past, there has been proposed a lighting fixture which includes a means configured to measure by use of a counting circuit an accumulated lighting time in which a lighting apparatus keeps turning on a light source and to determine the end of life of the lighting apparatus or a main body when the accumulated lighting time exceeds a predetermined time (see a document 1 [Japanese patent laid-open publication No. 6-333687], and a document 2 [Japanese patent laid-open publication No. 2006-23664]).

The lighting fixtures disclosed in the documents 1 and 2 indicate the end of life of the lighting apparatus or the main body when the accumulated lighting time measured by the counting circuit reaches the predetermined time. Therefore, the lighting fixture can perform a protection operation of turning off the light source prior to occurrence of abnormal heat generation of electrical components due to deterioration of the electrical components or breakage of structural components due to deterioration of the structural components at the end of life thereof. Thus, it is possible to improve safety of the lighting fixture.

For example, it is assumed that plural lighting fixtures are installed inside a tunnel. The counting circuits of the respective lighting fixtures count a clock signal generated at a predetermined oscillation frequency. Thus, counted values of the counting circuits are not so irregularly distributed. Therefore, with respect to the plural lighting fixtures installed around the same time, the accumulated lighting times of the plural lighting fixtures are likely to reach the predetermined time around the same time. Thus, the plural lighting fixtures perform the protection operation (operation of turning off the light source) simultaneously, and thereby lighting at an installation site is lost without providing prior notice. Consequently, the lighting fixture is likely to perturb people therearound and users, and safety of the lighting fixture is reduced due to a loss of lighting.

Consequently, as disclosed in a document 3 (Japanese patent laid-open publication No. 11-191168), it has been proposed to prevent the plural lighting fixture from performing the protection operation (operation of turning off the light source) simultaneously by means of irregularly distributing timings in which the plural lighting fixtures determine the end of life thereof by employing a method of using random numbers in counting circuits.

The lighting fixtures of the aforementioned documents 1 and 2 have a function of performing the protection operation at timing of the end of life, but do not have a function of performing an indication operation at timing prior to the end of life. When the method of using random numbers in counting circuits disclosed in the document 3 is applied to the lighting fixture of the document 1 or 2 in order to vary timing at which the indication operation is performed, it is possible to prevent the plural lighting fixtures from being turned off simultaneously. However, when the accumulated lighting time reaches the predetermined time, the plural lighting fixtures are turned off in sequence without providing prior notice. Therefore, the lighting fixture is still likely to perturb or discomfort people therearound and users.

DISCLOSURE OF INVENTION

In view of the above insufficiency, the present invention has been aimed to propose a lighting apparatus and lighting fixture capable of indicating its end of life without perturbing people around it and reducing safety.

The lighting apparatus in accordance with the present invention includes a lighting circuit unit, a timer unit, a life judgment unit, a timing adjustment unit, and an indication unit. The lighting circuit unit is configured to activate a light source. The timer unit is configured to measure accumulated operation time of the lighting circuit unit. The life judgment unit is configured to store a first judgment time and a second judgment time longer than the first judgment time. The life judgment unit is configured to compare the accumulated operation time with the first judgment time and output a first judgment signal when the accumulated operation time becomes equal to the first judgment time. The life judgment unit is configured to compare the accumulated operation time with the second judgment time and output a second judgment signal when the accumulated operation time becomes equal to the second judgment time. The timing adjustment unit is configured to vary timing at which the life judgment unit outputs the first judgment signal. The timing adjustment unit is configured to vary timing at which the life judgment unit outputs the second judgment signal. The indication unit is configured to indicate, upon receiving the first judgment signal from the life judgment unit, a first level of the end of life with the light source kept turned on. The indication unit is configured to indicate, upon receiving the second judgment signal from the life judgment unit, a second level of the end of life. The second level of the end of life is later than the first level of the end of life.

In a preferred embodiment, the timing adjustment unit is configured to vary the first judgment time and the second judgment time respectively. The life judgment unit is configured to compare the accumulated operation time measured by the timer unit with the first judgment time varied by the timing adjustment unit and output the first judgment signal when the accumulated operation time measured by the timer unit becomes equal to the first judgment time varied by the timing adjustment unit. The life judgment unit is configured to compare the accumulated operation time measured by the timer unit with the second judgment time varied by the timing adjustment unit and output the second judgment signal when the accumulated operation time measured by the timer unit becomes equal to the second judgment time varied by the timing adjustment unit.

More preferably, the timing adjustment unit is configured to randomly vary the first judgment time within a first variation width and to randomly vary the second judgment time within a second variation width.

Further preferably, the lighting circuit unit is configured to activate the light source selected from an electrodeless discharge lamp, a light emitting diode, and an organic electroluminescence device.

In a preferred embodiment, the first level of the end of life is defined as the initial level of the end of life, and the second level of the end of life is defined as the last level of the end of life. The first variation width and the second variation width are selected such that the maximum of the first judgment time within the first variation width is shorter than the minimum of the second judgment time within the second variation width.

In a preferred embodiment, the second variation width is greater than the first variation width.

In other preferred embodiment, the lighting apparatus includes a detection unit configured to detect at least one of a temperature of the lighting apparatus, a voltage applied to the lighting apparatus, and a current flowing through the lighting apparatus, and output detection value indicative thereof. The timing adjustment unit is configured to respectively vary the first judgment time and the second judgment time according to the detection value received from the detection unit. The second level of the end of life is defined as the last level of the end of life. The second judgment time is shorter than an end of life of any component of the lighting circuit unit.

Further preferably, the lighting circuit unit is configured to activate the light source selected from an electrodeless discharge lamp, a light emitting diode, and an organic electroluminescence device.

In other preferred embodiment, the timing adjustment unit is configured to vary the accumulated operation time measured by the timer. The life judgment unit is configured to compare the accumulated operation time varied by the timing adjustment unit with the first judgment time and output the first judgment signal when the accumulated operation time varied by the timing adjustment unit becomes equal to the first judgment time. The life judgment unit is configured to compare the accumulated operation time varied by the timing adjustment unit with the second judgment time and output the second judgment signal when the accumulated operation time varied by the timing adjustment unit becomes equal to the second judgment time.

More preferably, the timer unit includes an oscillator configured to output a clock signal at a constant period, and a counting circuit configured to count the number of the clock signals output from the oscillator. The timing adjustment unit is configured to randomly vary a threshold for the counting circuit within a predetermined variation width. The counting circuit is configured to increase the accumulated operation time by a constant amount each time when the number of the clock signals output from the oscillator becomes identical to the threshold varied by the timing adjustment unit, thereby measuring the accumulated operation time.

Alternately, the lighting apparatus includes a detection unit configured to detect at least one of a temperature of the lighting apparatus, a voltage applied to the lighting apparatus, and a current flowing through the lighting apparatus, and output detection value indicative thereof. The timing adjustment unit is configured to vary the accumulated operation time according to the detection value received from the detection unit. The second level of the end of life is defined as the last level of the end of life. The second judgment time is shorter than an end of life of any component of the lighting circuit unit.

A lighting fixture in accordance with the present invention includes a light source and a lighting apparatus. The lighting apparatus includes a lighting circuit unit, a timer unit, a life judgment unit, a timing adjustment unit, and an indication unit. The lighting circuit unit is configured to activate a light source. The timer unit is configured to measure accumulated operation time of the lighting circuit unit. The life judgment unit is configured to store a first judgment time and a second judgment time longer than the first judgment time. The life judgment unit is configured to compare the accumulated operation time with the first judgment time and output a first judgment signal when the accumulated operation time becomes equal to the first judgment time. The life judgment unit is configured to compare the accumulated operation time with the second judgment time and output a second judgment signal when the accumulated operation time becomes equal to the second judgment time. The timing adjustment unit is configured to vary timing at which the life judgment unit outputs the first judgment signal. The timing adjustment unit is configured to vary timing at which the life judgment unit outputs the second judgment signal. The indication unit is configured to indicate, upon receiving the first judgment signal from the life judgment unit, a first level of the end of life with the light source kept turned on. The indication unit is configured to indicate, upon receiving the second judgment signal from the life judgment unit, a second level of the end of life. The second level of the end of life is later than the first level of the end of life. The timing adjustment unit is configured to randomly vary the first judgment time within a first variation width and to randomly vary the second judgment time within a second variation width.

In another embodiment, the lighting fixture includes a light source and a lighting apparatus. The lighting apparatus includes a lighting circuit unit, a timer unit, a life judgment unit, a timing adjustment unit, and an indication unit. The lighting circuit unit is configured to activate a light source. The timer unit is configured to measure accumulated operation time of the lighting circuit unit. The life judgment unit is configured to store a first judgment time and a second judgment time longer than the first judgment time. The life judgment unit is configured to compare the accumulated operation time with the first judgment time and output a first judgment signal when the accumulated operation time becomes equal to the first judgment time. The life judgment unit is configured to compare the accumulated operation time with the second judgment time and output a second judgment signal when the accumulated operation time becomes equal to the second judgment time. The timing adjustment unit is configured to vary timing at which the life judgment unit outputs the first judgment signal. The timing adjustment unit is configured to vary timing at which the life judgment unit outputs the second judgment signal. The indication unit is configured to indicate, upon receiving the first judgment signal from the life judgment unit, a first level of the end of life with the light source kept turned on. The indication unit is configured to indicate, upon receiving the second judgment signal from the life judgment unit, a second level of the end of life. The second level of the end of life is later than the first level of the end of life. The lighting apparatus further includes a detection unit configured to detect at least one of a temperature of the lighting apparatus, a voltage applied to the lighting apparatus, and a current flowing through the lighting apparatus, and output detection value indicative thereof. The timing adjustment unit is configured to respectively vary the first judgment time and the second judgment time according to the detection value received from the detection unit. The second level of the end of life is defined as the last level of the end of life. The second judgment time is shorter than an end of life of any component of the lighting circuit unit.

BEST MODE FOR CARRYING OUT THE INVENTION

Following explanations are made to embodiments of the present invention with reference to the figures.

First Embodiment

Figure 1:
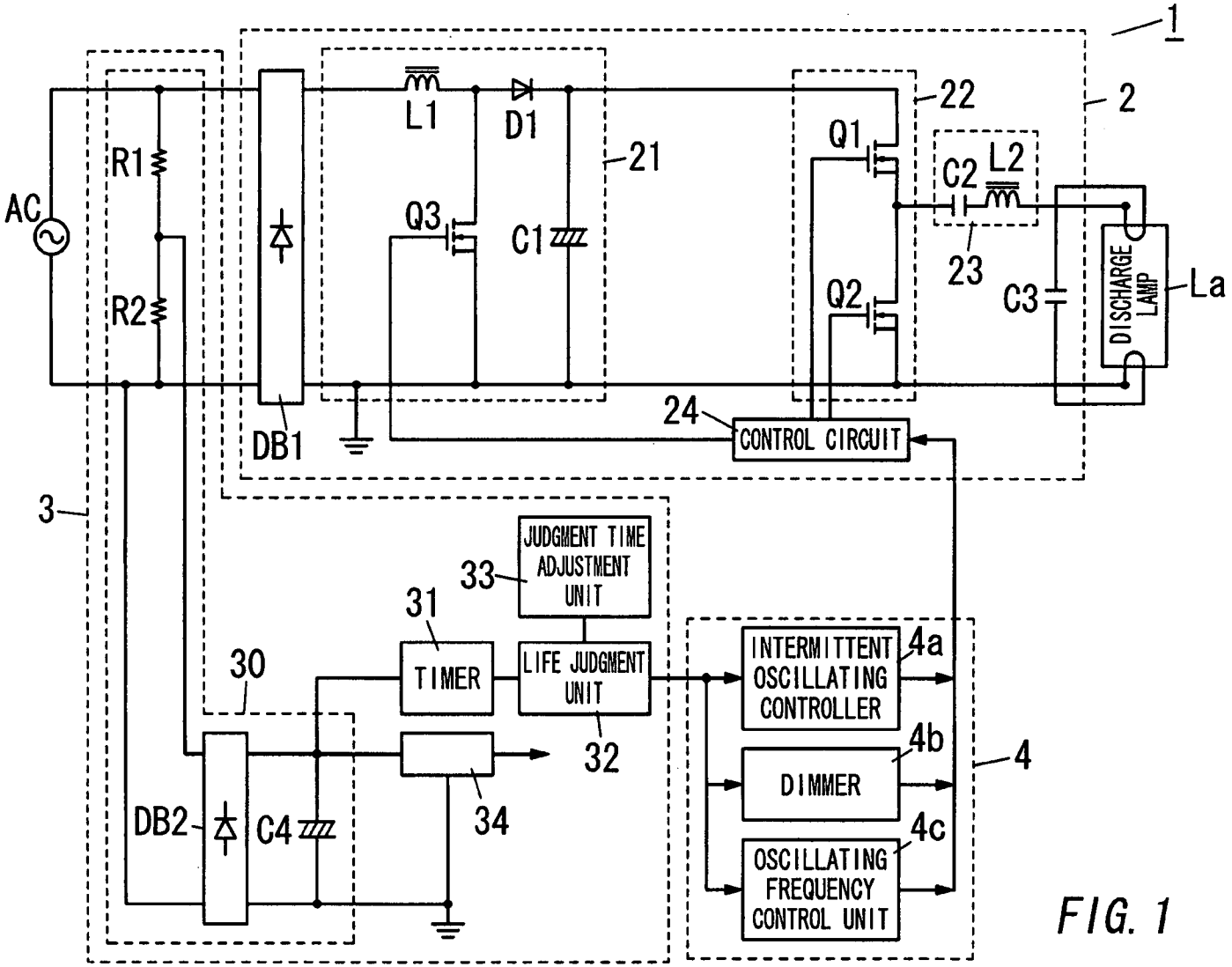
FIG. 1 is a circuit diagram illustrating a lighting apparatus of a first embodiment.
Figure 2:
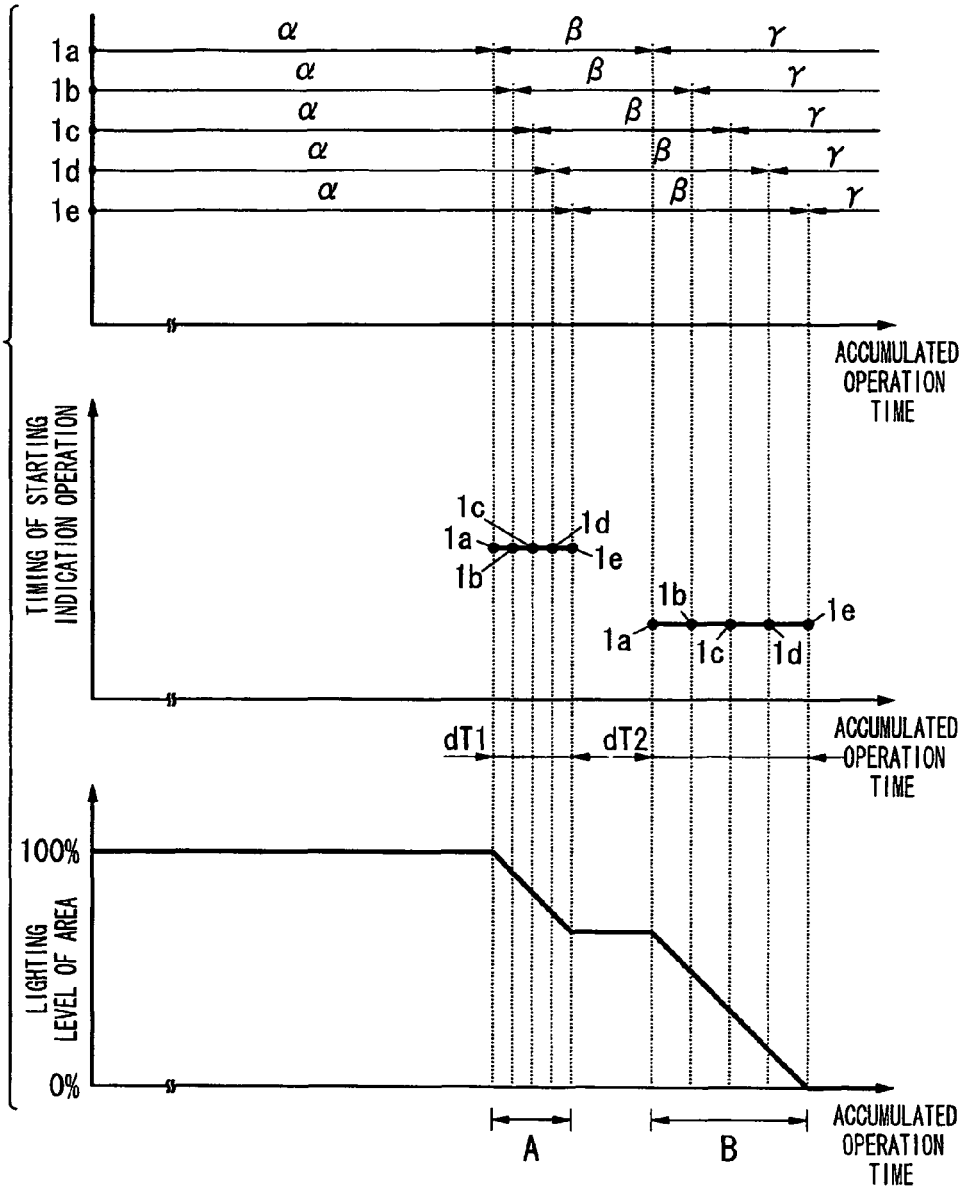
FIG. 2 shows (a) which is an explanatory view illustrating operation statuses of a plurality of the lighting apparatuses, (b) which is a diagram illustrating a timing at which the respective lighting apparatuses start to make an indication operation for respective levels of the end of life, and (c) which is an explanatory view illustrating a variation of a lighting level of an entire lighting area.

An explanation is made to the first embodiment of the present invention, with reference to FIGS. 1 and 2. FIG. 1 shows a circuit diagram of a lighting apparatus 1 of the present embodiment. This lighting apparatus 1 has primary components including a lighting circuit unit 2 configured to supply electrical power to a discharge lamp La, a life judgment block 3, and an indication unit 4. The lighting apparatus 1, the discharge lamp La turned on by the lighting apparatus 1, and a main body (not shown) configured to hold the lighting apparatus 1 and the discharge lamp La constitute a lighting fixture. With the exception of the life judgment block 3 and the indication unit 4, the lighting fixture has the same configuration and operation as a lighting fixture which is disclosed in Japanese patent laid-open publication No. 2006-236635. Therefore, no explanation is made to the same circuit configuration and operation.

The lighting circuit unit 2 includes a rectifier DB1, a chopper circuit 21, an inverter circuit 22, an LC resonator 23, a preheating capacitor C3, and a control circuit 24. The rectifier DB1 is a diode bridge configured to make a full-wave rectification for a commercial AC source (AC source) AC. The chopper circuit 21 is configured to smooth an output of the rectifier DB1, thereby converting the same into a predetermined DC voltage. The inverter circuit 22 is of a half bridge type and is configured to convert an output of the chopper circuit 21 into an AC voltage. The LC resonator 23 is a series circuit of a capacitor C2 and an inductor L2, and is connected across output terminals of the inverter circuit 22 with the discharge lamp La. The preheating capacitor C3 is connected across the discharge lamp La. The control circuit 24 is configured to turn on and off switching elements of each of the chopper circuit 21 and the inverter circuit 22.

The chopper circuit 21 is a step-up chopper circuit including a series circuit of an inductor L1 and a switching element Q3 connected across the output terminals of the rectifier DB1 and a series circuit of a diode D1 and a smoothing capacitor C1 connected across the switching element Q3. The chopper circuit 21 is configured to turn on and off the switching element Q3 in response to a control signal from the control circuit, thereby generating the predetermined DC voltage across the smoothing capacitor C1.

The inverter circuit 22 is a series circuit of switching elements Q1 and Q2 connected across the smoothing capacitor C1. The LC resonator 23 and the discharge lamp La are connected across the switching element Q2 of a low side. The inverter circuit 22 turns on and off the switching elements Q1 and Q2 alternately at a high frequency in response to a control signal from the control circuit 24, thereby converting a DC power output from the chopper circuit 21 into a high frequency power. The inverter circuit 22 supplies the resultant high frequency power to the discharge lamp La to turn on the discharge lamp La. Each of the switching elements Q1 to Q3 is a MOSFET. Besides, each of the switching elements Q1 to Q3 may be a switching element such as bipolar transistor.

The life judgment block 3 includes a control source step-down circuit 30, a timer (timer unit) 31, a life judgment unit 32, a judgment time adjustment unit 33, a three-terminal regulator IC 34. The control source step-down circuit 30 includes a series circuit of resistors R1 and R2 connected across AC input terminals of the rectifier DB1 and configured to divide the voltage of the commercial AC source AC. The control source step-down circuit 30 further includes a rectifier DB2 and a smoothing capacitor C4. The rectifier DB2 is a diode bridge configured to make a full-wave rectification for a voltage across the resistor R2. The smoothing capacitor C4 is configured to smooth a voltage rectified by the rectifier DB2. The three-terminal regulator IC 34 is configured to stabilize a power output from the smoothing capacitor C4 and supply the resultant power to the timer 31, the life judgment unit 32, the judgment time adjustment unit 33, and the indication unit 4. Besides, a single microcomputer functions as the timer 31, the life judgment unit 32, the judgment time adjustment unit 33, and the indication unit 4.

The timer 31 is configured to measure a time in which the voltage across the smoothing capacitor C4 is not less than a predetermined reference voltage, thereby measuring an accumulated operation time of the lighting circuit unit 2. The timer 31 includes a nonvolatile memory (e.g. EEPROM) configured to store the accumulated operation time. When a power switch (not shown) for turning on and off the lighting apparatus 1 is turned on, and when the lighting circuit unit 2 is energized, the timer 31 reads out the previous accumulated operation time from the nonvolatile memory and resumes measurement operation of measuring the accumulated operation time from the previous accumulated operation time. The timer 31 continues the measurement operation while the power switch is turned on (the voltage across the smoothing capacitor C4 is not less than the predetermined reference voltage). When the power switch is turned off to terminate the power supply, the timer 31 stores the measured accumulated operation time in the nonvolatile memory and terminates the measurement operation.

In order to judge the end of life at multi-levels for each of components (e.g. electronic components or machine components constructing the lighting apparatus 1 and the main body) except for a light source, the life judgment unit 32 is configured to store a plurality of judgment times respectively corresponding to a plurality of levels predetermined to the components. Each time the accumulated operation time measured by the timer 31 reaches the judgment time, the life judgment unit 32 generates a life judgment signal indicative of the level of the end of life corresponding to the judged judgment time and outputs the same to the indication unit 4. In the present embodiment, the life judgment unit 32 is configured to judge the life of the lighting circuit unit 2.

FIG. 2 is an explanatory view for explaining an indication operation at the end of life. In the present embodiment, the life judgment unit 32 stores the judgment time (first judgment time) T1 corresponding to the beginning stage of the end of life (the initial level of the end of life) and the judgment time (second judgment time) T2 (T1<T2) corresponding to the end stage of the end of life (the last level of the end of life) for the component (lighting apparatus 2) except for the light source. In FIG. 2, (b) shows timings at which each of the lighting apparatuses 1*a* to 1*e* starts to perform the indication operation. As shown in (b) of FIG. 2, dT1 denotes a temporal distribution width (first variation width) of the judgment time T1 corresponding to the beginning stage of the end of the life, and dT2 denotes a temporal distribution width (second variation width) of the judgment time T2 corresponding to the end stage of the end of the life.

In FIG. 2, (a) indicates operation statuses of each of the lighting apparatuses 1*a* to 1*e*. The control circuit 24 turns on the discharge lamp at the maximum power (100%) until the accumulated operation time measured by the timer 31 reaches the judgment time T1 (period α). When the accumulated operation time reaches the judgment time T1, the life judgment unit 32 outputs the life judgment signal (first judgment signal) indicative of the beginning stage of the end of the life to the indication unit 4. Upon receiving the life judgment signal (first judgment signal), the indication unit 4 causes its oscillating frequency control unit 4*c* to vary the oscillating frequency of the lighting circuit unit 2 in order to reduce light flux of the discharge lamp La down to 67% of the maximum power, thereby indicating that the lighting circuit unit 2 is coming closer to the end of life. Thus, the indication unit 4 is configured to indicate the beginning stage of the end of life with the discharge lamp La kept turned on. Thereafter, when the accumulated operation time reaches the judgment time T2, the life judgment unit 32 outputs the life judgment signal (second judgment signal) indicative of the end stage of the end of the life to the indication unit 4.

The judgment time adjustment unit 33 is configured to vary the judgment times T1 and T2 from initial values (e.g. center values) of the life judgment unit 32 stored in the life judgment unit 32, respectively, thereby distributing the respective judgment times T1 and T2 differently from different ones of the lighting apparatuses 1. The variation widths (first variation width and second variation width) for varying the corresponding judgment times T1 and T2 are selected to have enough length for preparing a replacement for the lighting fixture.

The indication unit 4 includes an intermittent oscillating controller 4*a*, a dimmer 4*b*, and the oscillating frequency control unit 4*c*. The indication unit 4 outputs a control signal corresponding to the life judgment signal of the life judgment unit 32 to the control unit 24 of the lighting circuit unit 2 in order to adjust a power supplied to the discharge lamp La from the lighting circuit unit 2. Thereby, the indication unit 4 performs the indication operation indicative of a level of the end of life of the lighting circuit unit 2. The indication operation at the timing at which the accumulated operation time reaches the judgment time T1 is aimed to indicate that the lighting circuit unit 2 is in the prior stage of the end of life. The dimmer 4*b* outputs a dimming signal to the control unit 24 to reduce the light flux of the discharge lamp La down to 67% from 100% not to turn off the discharge lamp La. For example, when the life judgment unit 32 is configured to judge the end of life of the lighting fixture, the indication unit 4 is configured to perform the indication operation indicative of a level (stage) of the end of life of the lighting fixture.

In the present embodiment, the indication unit 4 reduces the light flux to indicate a level of the end of life prior to the end stage of the end of life. Instead of reduction of the light flux, the indication unit 4 may blink the discharge lamp La for a constant time when the lighting apparatus 1 is turned on or off, and may flicker the discharge lamp La periodically or non-periodically, and may flicker weakly the discharge lamp La, and may vary the light output of the discharge lamp La slightly, and may perform a combination of these operations. It is assumed that the indication unit 4 periodically flickers the discharge lamp La or varies continuously the light output of the discharge lamp La during the indication operation indicative of a level of the end of life prior to the end stage of the end of life. In this instance, when the lighting apparatuses 1*a* to 1*e* start to perform the indication operation, the lighting apparatuses 1*a* to 1*e* flicker its discharge lamp La or vary the light output of its discharge lamp La at the same timing after being turned on. When this situation is kept for a long time, a user may feel anxiety or may doubt power failure. However, with use of random numbers, it is possible to change randomly timings at which the lighting apparatuses 1*a* to 1*e* flicker its discharge lamp La respectively and variations of the light outputs of the discharge lamps La. Thereby, it is possible to prevent the lighting apparatuses 1*a* to 1*e* from flickering its discharge lamp La or varying the light output of its discharge lamp La at the same timing.

The indication operation, which is performed after the accumulated operation time reaches the judgment time T2 (period γ in FIG. 2A), is aimed to perform a protection operation of preventing the lighting apparatus 1 or the main body coming to the end of its life from operating continuously in an unsafe status (i.e., status where safety is not assured). The indication unit 4 terminates the oscillating operation to turn off the discharge lamp La. Thus, the indication unit 4 performs the protection operation of deactivating the discharge lamp La or the lighting circuit unit 2 as the indication operation indicative of the end stage of the end of life. Therefore, it is possible to restrain a deterioration of the lighting circuit unit 2 or the main body, thereby improving safety of the lighting apparatus 1 or the lighting fixture. Instead of turning off the discharge lamp La, the indication unit 4 may reduce a power consumption of the lighting apparatus 1 down to zero or approximately zero. For example, the indication unit 4 turns on continuously or periodically the discharge lamp La under a condition where the light output thereof is more reduced. In this situation, a deterioration of the lighting circuit unit 2 or the main body is suppressed as possible. Therefore, it is possible to prevent the lighting apparatus 1 or the main body from coming into the unsafe status.

In the present embodiment, the indication unit 4 turns off the discharge lamp La in the indication operation corresponding to the end stage of the end of life after reducing the light flux of the discharge lamp La in the indication operation corresponding to the beginning stage of the end of life. However, the indication unit 4 may reduce the light flux of the discharge lamp La at the beginning stage of the end of life and may more reduce the light flux of the discharge lamp La at the end stage of the end of life. Alternatively, the indication unit 4 may flicker at long intervals the discharge lamp La at the beginning stage of the end of life and may flicker at short intervals or turn off the discharge lamp La at the end stage of the end of life. Moreover, the indication unit 4 may flicker weakly the discharge lamp La at the beginning stage of the end of life and may flicker strongly or turn off the discharge lamp La at the end stage of the end of life. Further, the indication unit 4 may keep varying slightly the light output of the discharge lamp La at the beginning stage of the end of life and may keep varying widely the light output of the discharge lamp La or turn off the discharge lamp La at the end stage of the end of life. In addition, the indication unit 4 may perform a combination of these operations.

As described in the above, the lighting apparatus 1 of the present embodiment includes the lighting circuit unit 2 configured to turn on the discharge lamp (light source) La, the timer (timer unit) 31 configured to measure the accumulated operation time of the lighting circuit unit 2, the life judgment unit 32, the judgment time adjustment unit 33, and the indication unit 4.

The life judgment unit 32 is configured to store the first judgment time T1 and the second judgment time T2 longer than the first judgment time T1. The life judgment unit 32 is configured to compare the accumulated operation time with the first judgment time T1 and output the first judgment signal when the accumulated operation time reaches the first judgment time T1. The life judgment unit 32 is configured to compare the accumulated operation time with the second judgment time T2 and output the second judgment signal when the accumulated operation time reaches the second judgment time T2.

The judgment time adjustment unit 33 is configured to vary timing at which the life judgment unit 32 outputs the first judgment signal and timing at which the life judgment unit 32 outputs the second judgment signal, respectively.

The indication unit 4 is configured to indicate, upon receiving the first judgment signal from the life judgment unit 32, a first level of the end of life with the discharge lamp La kept turned on. The indication unit 4 is configured to indicate, upon receiving the second judgment signal from the life judgment unit 32, a second level of the end of life. The second level of the end of life is later than the first level of the end of life.

In the present embodiment, the judgment time adjustment unit 33 is configured to vary the first judgment time T1 and the second judgment time T2, respectively.

That is, the life judgment unit 32 is configured to compare the accumulated operation time measured by the timer 31 with the first judgment time T1 varied by the judgment time adjustment unit 33 and output the first judgment signal when the accumulated operation time measured by the timer 31 reaches the first judgment time T1 varied by the judgment time adjustment unit 33.

The life judgment unit 32 is further configured to compare the accumulated operation time measured by the timer 31 with the second judgment time T2 varied by the judgment time adjustment unit 33 and output the second judgment signal when the accumulated operation time measured by the timer unit 31 reaches the second judgment time T2 varied by the judgment time adjustment unit 33.

According to the lighting apparatus 1 of the present embodiment, the indication unit 4 can perform the indication operations at multi-levels of the end of life of the lighting circuit unit 2 before the lighting circuit unit 2 comes to the end of its life. Therefore, even if the light source is turned off at the end stage of the end of life for safety, the light source is not turned off without providing prior notice. Consequently, it is possible to avoid sudden termination of the lighting effect, causing no anxiety to people and reducing the safety which would otherwise occur. Further, a user can be given a change of replacing the lighting apparatus 1 before the lighting circuit unit 2 comes to the end of its life because the user can know a current level of the end of life. In addition, the judgment time adjustment unit 33 varies the judgment times of each of the levels of the end of life, respectively. Therefore, even if the plural lighting apparatuses 1 are installed, the plural lighting apparatuses 1 do not perform the indication operation at the same timing. For example, even if the plural lighting apparatuses 1 perform the indication operation with reducing the light flux, the plural lighting apparatuses 1 do not reduce the light flux at the same timing. Therefore, the lighting apparatus 1 will not cause anxiety to people therearound and will not reduce its safety. Further, it is possible to prevent the people from making false recognition that the light flux is lowered due to the power failure.

Even if the single lighting apparatus 1 is installed, the indication unit 4 performs at least one time the indication operation indicative of a level of the end of life before performing the indication operation of indicating the end stage of the end of life. Therefore, it is possible to indicate that the lighting apparatus 1 or the main body is coming closer to the end of its life. Thus, a user can replace the lighting apparatus 1 or the main body before the lighting apparatus 1 or the main body comes to the end of its life. It is possible to improve safety of the lighting apparatus 1 or the main body.

Further, the lighting apparatus 1 makes the indication operation of reducing its light output stepwise until it reaches the end stage of the end of life, and makes the indication operation of turning off the lamp La upon reaching the end stage. Consequently, in contrast to a situation where all the lighting apparatuses 1 reduce its light output continuously as the accumulated operation time comes closer to the end of life, it is possible to clearly distinguish the lighting fixture already initiating the indication operation from that not initiating the indication operation. In other words, it is easy to judge whether or not the lighting fixture is under indication operation. It is noted that the lighting apparatus 1 of the present embodiment can adopt a dimmable light source of varying its output stepwise.

In the present embodiment, the judgment time adjustment unit 33 varies each of the judgment times T1 and T2. Especially, the judgment time adjustment unit 33 varies by use of a random number the judgment time T1 for judging the beginning stage of the end of life. In addition, like the judgment time T1, the judgment time adjustment unit 33 may vary by use of a random number the judgment time T2 for judging the end stage of the end of life. For example, the judgment time adjustment unit 33 is configured to randomly vary the first judgment time T1 within the first variation width and to randomly vary the second judgment time T2 within the second variation width. A method disclosed in Japanese patent laid-open publication No. 11-191168 may be adopted as a method for varying the judgment time T1 by use of random numbers. The judgment time adjustment unit 33 generates a random number before a lapse of a predetermined time from timing at which the lighting apparatus 1 (e.g., the judgment time adjustment unit 33, the timer 31, or a microcomputer acting as the judgment time adjustment unit 33 and the timer 31) is turned on for the first time (beginning of use). The judgment time adjustment unit 33 varies the judgment time T1 by use of the generated random number. Desired distributions of each of the judgment times T1 and T2 can be selected easily by use of random numbers. The judgment time adjustment unit 33 can be implemented by a program of a microcomputer. Therefore, the judgment time adjustment unit 33 can be implemented by modifying only the program of the microcomputer. That is, no additional components are necessary for implementing the judgment time adjustment unit 33.

Besides, the judgment time adjustment unit 33 varies the judgment time T2 such that an ascending order of the plural lighting apparatuses 1*a* to 1*e* with regard to the judgment time T2 is identical to an ascending order of the plural lighting apparatuses 1*a* to 1*e* with regard to the judgment time T1. Therefore, when the plurality of the lighting apparatuses 1*a* to 1*e* is installed around the same time and is used for the same period, the plurality of the lighting apparatuses 1*a* to 1*e* performs the indication operation at the end stage of the end of life in the order where the plurality of the lighting apparatuses 1*a* to 1*e* performs the indication operation at the beginning stage of the end of life. Thus, a user can predict the order of the protection operation of deactivating the lighting apparatus on the basis of the order of the indication operation at the beginning stage of the end of life.

In the judgment time adjustment unit 33, the distribution width dT2 for the judgment time T2 corresponding to the end stage of the end of life is greater than the distribution width dT1 for the judgment time T1 corresponding to the beginning stage of the end of life (see FIG. 2B). In the indication operation for the end stage of the end of life, the lighting apparatus 1 does not provide its lighting function. Therefore, there might remain safety problem. However, in contrast to a situation where all the lighting apparatuses 1*a* to 1*e* perform the indication operation at the very beginning stage of the end of life, the present embodiment assures to sequentially turn off the lighting apparatuses 1*a* to 1*e* to complete the turn off of the all lighting apparatuses in a certain time period, i.e., extended time period. With the extended time period given by the protection operation, it is successfully made to improve the safety of the lighting apparatus 1 or the main body. A user can be therefore given a chance of replacing the lighting apparatuses 1*a* to 1*e* within the extended time period.

As seen from the above, the indication unit 4 performs the indication operations at the plurality of levels of the end of life of the lighting circuit unit 2 before the lighting circuit unit 2 comes to the end of its life. Therefore, even if the light source is turned off at the end stage of the end of life for safety, the light source is not turned off without providing prior notice. Consequently, it is possible to avoid sudden termination of the lighting effect, causing no anxiety to people and reducing the safety which would otherwise occur. Further, a user can be given a chance of replacing the lighting apparatus 1 before the lighting circuit unit 2 comes to the end of its life because the user can know a current level of the end of life. In addition, the judgment time adjustment unit 33 varies the judgment times of each of the levels of the end of life, respectively. Therefore, even if the plurality of the lighting apparatuses 1 is installed, the plurality of the lighting apparatuses 1 does not perform the indication operation at the same timing. For example, even if the plurality of the lighting apparatuses 1 performs the indication operation with reducing the light flux, the plurality of the lighting apparatuses 1 does not reduce the light flux at the same timing. Therefore, the lighting apparatus 1 will not cause anxiety to people therearound and will not reduce its safety. Further, it is possible to prevent the people from making false recognition that the light flux is lowered due to the power failure.

In FIG. 2, (c) shows a lighting level of the entire lighting area in which the lighting apparatuses 1*a* to 1*e* are installed. The figure shows a variation of the lighting level before and after the lighting apparatuses 1*a* to 1*e* perform the protection operation, where "100%" denotes a situation where all the lighting apparatuses 1*a* to 1*e* are turned on at its maximum power (100%) and "0%" denotes a situation where all the lighting apparatuses 1*a* to 1*e* are turned off. In each of the lighting apparatuses 1*a* to 1*e*, the judgment time adjustment unit 33 varies the respective judgment times T1 and T2. Thereby the distribution widths dT1 and dT2 of the judgment times T1 and T2 are adjusted. A reduction rate of the lighting level at a period B where the indication operation at the end stage is performed in sequence is limited to the same level as a reduction rate of the lighting level at a period A where the indication operation at the beginning stage is performed in sequence. Therefore, it is possible to prevent a sudden decrease of the lighting level at the period B. It is possible to improve safety.

Second Embodiment

Figure 3:
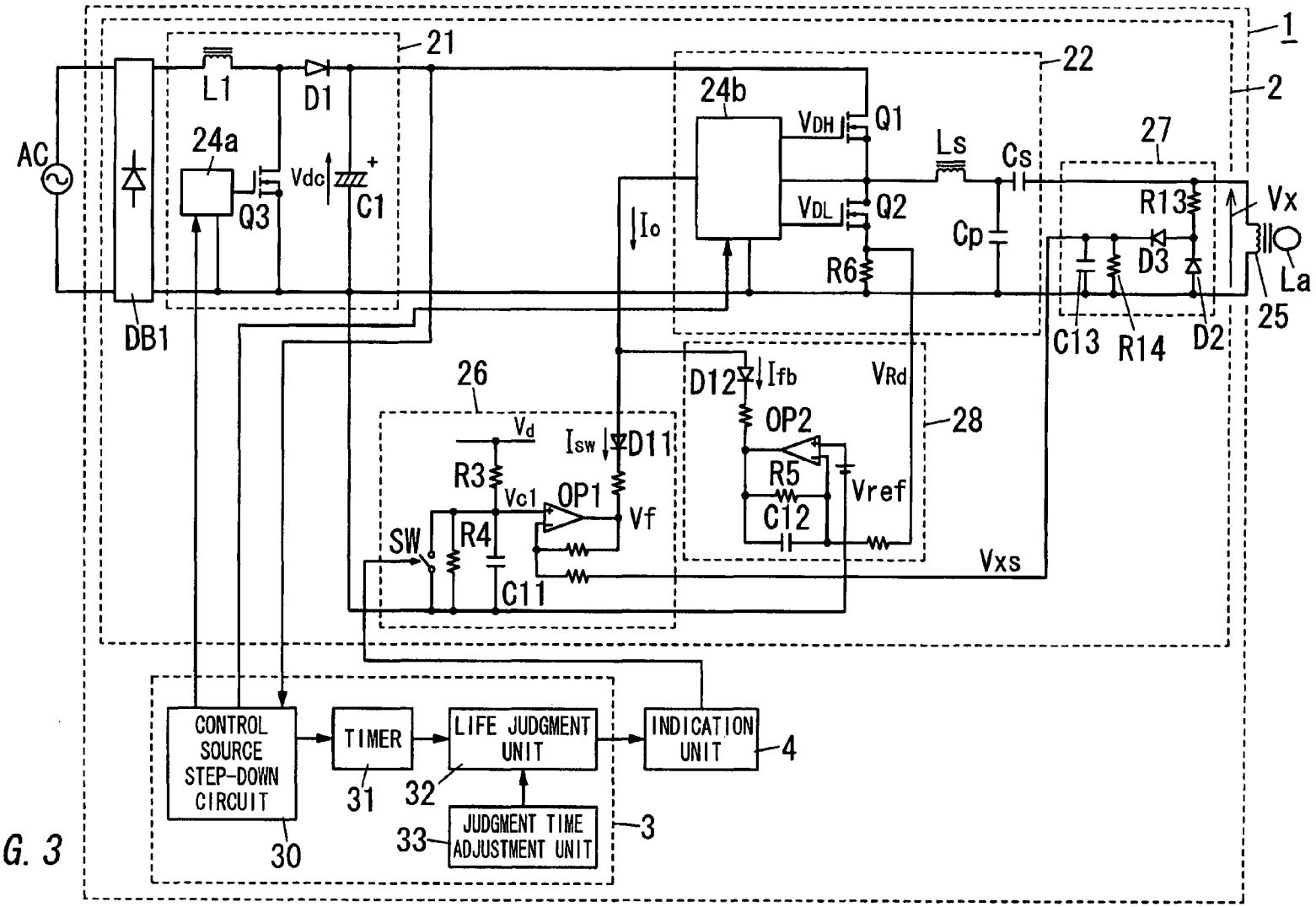
FIG. 3 is a circuit diagram illustrating the lighting apparatus of a second embodiment.

The second embodiment of the present invention is explained with reference to FIGS. 3 and 4. FIG. 3 shows a circuit diagram of the lighting apparatus 1 of the present embodiment. The lighting apparatus 1 of the present embodiment is configured to turn on and off the electrodeless discharge lamp La. The electrodeless discharge lamp La has a transparent spherical glass bulb or a spherical glass bulb having its inner periphery coated by a fluorescent material which includes a discharge gas (e.g., combination gas of a mercury vapor and a noble gas) containing an inactive gas and a metal vapor. The lighting apparatus 1*a* includes the rectifier DB1, the chopper circuit 21, the inverter circuit 22, a starting circuit 26, a voltage detection circuit 27, and a control circuit 28. The lighting apparatus 1*a* further includes the life judgment block 3 and the indication unit 4 which are explained in the first embodiment. The rectifier DB1 is a diode bridge configured to make a full-wave rectification for the commercial AC source AC. The chopper circuit 21 is configured to smooth an output of the rectifier DB1, thereby converting the same into a predetermined DC voltage. The inverter circuit 22 is configured to convert a DC power of the chopper circuit 21 into a high frequency power and supply the resultant high frequency power to an induction coil 25 disposed adjacent to the electrodeless discharge lamp La. The starting circuit 26 is configured to increase gradually an output voltage of the inverter circuit 22 to activate the electrodeless discharge lamp La during activation of the electrodeless discharge lamp La. The voltage detection circuit 27 is configured to measure an output voltage of the inverter circuit 22. With the exception of the life judgment block 3 and the indication unit 4, the lighting apparatus 1 of the present embodiment has the same circuit configuration and operation as an electrodeless discharge lamp lighting apparatus which is disclosed in Japanese patent laid-open publication No. 2005-158464. Therefore, no explanation is made to the same circuit configuration and operation.

The chopper circuit 21 is a step-up chopper circuit including the series circuit of the inductor L1 and the switching element Q3 connected across the output terminals of the rectifier DB1 and the series circuit of the diode D1 and the smoothing capacitor C1 connected across the switching element Q3. The chopper circuit 21 includes a drive circuit 24*a* configured to turn on and off the switching element Q3, thereby generating the predetermined DC voltage across the smoothing capacitor C1.

The inverter circuit 22 is of a half bridge type and includes a pair of the switching elements Q1 and Q2 connected in series with each other. The switching elements Q1 and Q2 are field effect transistors. The switching elements Q1 and Q2 are connected across the smoothing capacitor C1. A resonator composed of an inductor Ls and capacitors Cp and Cs is connected across the switching element Q2 of the low side. The inverter circuit 22 turns on and off the switching elements Q1 and Q2 alternately in response to square-wave pulse signals VDH and VDL output from the drive circuit 24*a* in order to supply the high frequency power to the induction coil 25 through the resonator, thereby turning on the discharge lamp La.

The voltage detection circuit 27 includes diodes D2 and D3 for rectification, resistors R13 and R14 for dividing voltage, and a smoothing capacitor C13. The voltage detection circuit 27 outputs a detection voltage Vxs, which is a DC voltage corresponding to an output voltage Vx, to the starting circuit 26.

The control circuit 28 is constituted by an operational amplifier OP2, an input resistor, and other components. The control circuit 28 includes an error amplifier (differential amplifier) configured to amplify a difference between a reference voltage Vref and a detection voltage VRd of a current detection circuit (a resistor R6 connected in series with the switching elements Q1 and Q2), and a diode D12 having its cathode connected to an output terminal of the operational amplifier OP2 via a resistor. The operational amplifier OP2 has its noninverting terminal into which the reference voltage Vref is input. A delay circuit which is a parallel circuit of a resistor R5 and a capacitor C12 is connected between an inverting terminal and the output terminal of the operational amplifier OP2.

The starting circuit 26 includes a capacitor C11, an error amplifier, a dividing resistor R4, and a switch SW for discharging. The capacitor C11 receives, via a thermistor R3, an operation voltage Vd generated by decreasing and stabilizing the output voltage Vdc of the chopper circuit 21. Thereby, the capacitor C11 is charged. The error amplifier includes an operational amplifier OP1, an input resistor, and a feedback resistor. The error amplifier is configured to amplify a difference between a voltage Vc1 across the capacitor C11 and the detection voltage Vxs of the voltage detection circuit 27. The dividing resistor R4 is connected across the capacitor C11. The switch SW is connected in parallel with the capacitor C11. The starting circuit 26 increases its output voltage in conformity with a time constant (that is, the product of a resistance of thermistor R3 and a capacitance of the capacitor C11) of a charging circuit composed of the thermistor R3 and the capacitor C11. The operational amplifier OP1 of the error amplifier of the starting circuit 26 has its output terminal connected to a cathode of a diode D11 via a resistor. The two diodes D11 and D12 have its anode connected to an input terminal of the drive circuit 24*b*.

A constant voltage (input terminal voltage) is applied to the input terminal of the drive circuit 24*b*. When the output voltage (output terminal voltage of the operational amplifier OP1) of the error amplifier of the starting circuit 26 becomes less than the input terminal voltage of the drive circuit 24*b*, the diode D11 is turned on. Thereby a first control current Isw, which is corresponding to a difference between the input terminal voltage of the drive circuit 24*b* and the output terminal voltage of the starting circuit 26, flows through the diode D11. When the output voltage (output terminal voltage of the operational amplifier OP2) of the error amplifier of the control circuit 28 becomes less than the input terminal voltage of the drive circuit 24*b*, the diode D12 is turned on. Thereby a second control current Ifb, which is corresponding to a difference between the input terminal voltage of the drive circuit 24*b* and the output terminal voltage of the control circuit 28, flows through the diode D12. Consequently, a control current Io output from the input terminal of the drive circuit 24*b* has its magnitude identical to the sum of the first control current Isw and the second control current Ifb.

The drive circuit 24*b* includes an oscillator, and varies an oscillating frequency of the oscillator according to the control current Io output from the input terminal of the drive circuit 24*b* to the output terminals of each of the starting circuit 26 and the control circuit 28, thereby changing frequencies (operation frequencies) of the square-wave pulse signals (drive signals) VDH and VDL in proportion to the control current Io. Herein, the drive circuit 24*b* decreases the operation frequencies of the drive signals VDH and VDL as the output voltages of the error amplifiers of the starting circuit 26 and the control circuit 28 increase.

Next, an explanation is made to operation of the lighting apparatus of the present embodiment. When the commercial AC source AC starts to supply a power to the chopper circuit 21, the life judgment block 3 and the indication unit 4 are activated. Upon being activated, the indication unit 4 turns off the switch SW. In this situation, the operation voltage Vd is generated in response to a supply voltage from the chopper circuit 21, and the operation voltage Vd charges the capacitor C11. Thereby, the output voltage Vf of the starting circuit 26 increases gradually. As the output voltage Vf increases, the frequencies (operation frequency of the inverter circuit 22) of the drive signals VDH and VDL output from the drive circuit 24*b* decrease gradually from their initial values, respectively. Herein, a starting initiation frequency is enough higher than an unloaded resonance frequency. Therefore, the output voltage Vx of the inverter circuit 22 having its operation frequency identical to the starting initiation frequency becomes low. The drive circuit 24*b* decreases gradually the operation frequency with an increase of the output voltage Vf of the starting circuit 26. When the operation frequency reaches a predetermined starting frequency, the output voltage Vx reaches a starting voltage. Thereby, the electrodeless discharge lamp La is turned on. In this situation, output characteristics of the inverter circuit 22 are changed from characteristics curve of a situation (unloaded situation) where the electrodeless discharge lamp La is kept turned off to characteristics curve of a situation (lighting situation) where the electrodeless discharge lamp La is kept turned on. Accordingly, the output voltage of the inverter circuit 22 decreases, and the starting circuit 26 decreases the operation frequency down to a starting completion frequency even after the electrodeless discharge lamp La is turned on. Thus, the lighting apparatus 1 keeps turning on successfully the electrodeless discharge lamp La.

Next, an explanation is made to the indication operation at the end stage of the end of life. The life judgment block 3 is configured to judge the end of life of the lighting apparatus 1 and the main body, and to perform the indication operation before the lighting apparatus 1 and the main body come into a non-safety mode.

The control source step-down circuit 30 decreases the output voltage of the chopper circuit 21 to a predetermined voltage, thereby supplying an operation voltage to the drive circuits 24*a* and 24*b*. When the drive circuits 24*a* and 24*b* are activated by receiving the operation voltage, the electrodeless discharge lamp La is turned on, and the lighting apparatus 1 and the main body start to deteriorate. The timer 31 is configured to measure a time in which the output voltage of the control source step-down circuit 30 is kept not less than a predetermined reference voltage. The timer 31 includes a nonvolatile memory (not shown) such as an EEPROM configured to store the accumulated operation time. When the output voltage of the control source step-down circuit 30 becomes not less than the predetermined reference voltage after the lighting apparatus 1 is turned on, the timer 31 reads out the previous accumulated operation time from the nonvolatile memory and resumes the measurement operation of measuring the accumulated operation time from the previous accumulated operation time. The timer 31 continues the measurement operation while the output voltage of the control source step-down circuit 30 is not less than the predetermined reference voltage. When the power switch is turned off to terminate the power supply, the timer 31 stores the measured accumulated operation time in the nonvolatile memory and terminates the measurement operation. In a starting period after the power switch is turned on, the drive circuits 24*a* and 24*b* are activated before the electrodeless discharge lamp La is turned on. Even in this starting period where the lighting apparatus 1 consumes less power, the timer 31 is activated to make the measurement operation for enabling the life judgment with improved safety.

The judgment unit 32 is configured to store a plurality of judgment times respectively corresponding to a plurality of levels predetermined to the components (e.g. electronic components or machine components constructing the lighting apparatus 1 and the main body) except for the light source. Each time the accumulated operation time measured by the timer 31 reaches the judgment time, the life judgment unit 32 generates the life judgment signal indicative of the level of the end of life corresponding to the judged judgment time and outputs the same to the indication unit 4. In the present embodiment, like the first embodiment, the life judgment unit 32 is configured to judge the life of the lighting circuit unit 2.

Upon receiving the life judgment signal, the indication unit 4 turns on and off the switch SW of the starting circuit 26 to vary the output voltage of the inverter circuit 22, thereby blinking the electrodeless discharge lamp La or dimming the electrodeless discharge lamp La intermittently. Thus, the indication unit 4 performs the indication operation corresponding to the level in the end of life indicated by the received life judgment signal. Herein, when a period of turning on and off of the switch SW increases, the electrodeless discharge lamp La is blinked. When the period of turning on and off of the switch SW decreases, the electrodeless discharge lamp La comes into an intermittent dimming state where the light flux of the electrodeless discharge lamp La are reduced. It is noted that the electrodeless discharge lamp La has an inherent function of blinking.

Thus, each time receiving the life judgment signal corresponding to the judgment time from the life judgment unit 32, the indication unit 4 performs the indication operation indicative of the level in the end of life corresponding to the received life judgment signal. It is assumed that the indication unit 4 performs the two-step indication operations (e.g., the indication unit 4 performs the indication operation indicative of the beginning stage of the end of life and the indication operation indicative of the end stage of the end of life). In this situation, the indication unit 4 reduces the light flux of the discharge lamp La at the indication operation corresponding to the beginning stage of the end of life. Subsequently, the indication unit 4 turns off the discharge lamp La or more reduces the light flux of the discharge lamp La at the indication operation corresponding to the end stage of the end of life.

Besides, with respect to the indication unit 4, the indication operation indicative of the beginning stage of the end of life and the indication operation indicative of the end stage of the end of life are not limited to the aforementioned instance. The indication unit 4 may flicker at long intervals the electrodeless discharge lamp La at the beginning stage of the end of life and may flicker at short intervals or turn off the electrodeless discharge lamp La at the end stage of the end of life. Moreover, the indication unit 4 may flicker weakly the electrodeless discharge lamp La at the beginning stage of the end of life and may flicker strongly or turn off the electrodeless discharge lamp La at the end stage of the end of life. Further, the indication unit 4 may keep varying slightly the light output of the electrodeless discharge lamp La at the beginning stage of the end of life and may keep varying widely the light output of the electrodeless discharge lamp La or turn off the electrodeless discharge lamp La at the end stage of the end of life. In addition, the indication unit 4 may perform a combination of these operations.

Like the first embodiment, the judgment time adjustment unit 33 of the present embodiment also varies a plurality (two, in the present embodiment) of the judgment times stored in the life judgment unit 32, respectively, thereby distributing the respective judgment times T1 and T2 differently from different ones of the lighting apparatuses 1. FIG. 4 shows distributions of the judgment times. In FIG. 4, the horizontal axis represents the accumulated operation time, and the vertical axis represents the number of the lighting apparatuses 1 which start to perform the indication operation. With reference to FIG. 4, G11 represents the number of the lighting apparatuses 1 which start to perform the indication operation at the beginning stage of the end of life, and G12 represents the number of the lighting apparatuses 1 which start to perform the indication operation at the end stage of the end of life. In FIG. 4, a period A represents a normal lighting period in which no lighting apparatuses 1 perform the indication operation. A period B represents a period in which the lighting apparatuses 1 start in sequence to perform the indication operation at the beginning stage of the end of life. A period C represents a period in which all the lighting apparatuses 1 keep performing the indication operation at the beginning stage of the end of life. A period D represents a period in which the lighting apparatuses 1 start in sequence to perform the indication operation at the end stage of the end of life. A period E represents a period in which all the lighting apparatuses 1 keep performing the indication operation at the end stage of the end of life.

As illustrated, each of distributions of the judgment times of the indication operations is a continuous curve including an anterior half part and a posterior half part. The number of the lighting apparatuses 1 increases gradually during the anterior half part and decreases gradually during the posterior half part. In view of the plurality of the lighting apparatuses 1, the judgment times are distributed by individually varying the judgment times. Therefore, the plurality of the lighting apparatuses 1 does not perform the indication operation at the same timing. Consequently, it is possible to prevent the lighting apparatuses 1 from ceasing the lighting function without providing prior notice. Accordingly, a person around the lighting apparatuses 1 or a user can prepare a replacement for the lighting apparatus 1 before noticing inconvenience or danger.

Figure 4:
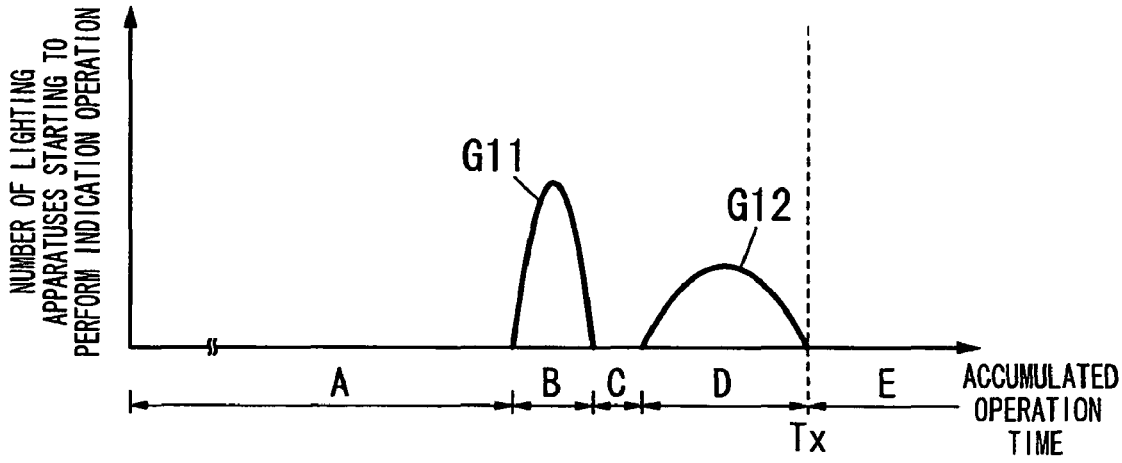
FIG. 4 is a graph showing distributions of respective judgment times for judging the corresponding level of end of life of the above lighting apparatus.

In the instance shown in FIG. 4, the second variation width is greater than the first variation width. That is, the distribution width of the longer judgment time is greater than the distribution width of the shorter judgment time. In this situation, as the indication operation becomes at a later stage (i.e., at a stage closer to the end of the life) where the light flux is reduced to a greater extent, more variation is given to the timing of starting the indication operation on the side of the lighting apparatus 1. Therefore, the lighting level in the entire space can be reduced gradually. Accordingly, the plurality of the lighting apparatuses 1 can sequentially perform the indication operation without jeopardizing the person in the illuminated space.

By the way, in the present embodiment, the electrodeless discharge lamp La having no electrodes is adopted as the light source. A solid light source (e.g., a light emitting diode and an organic electroluminescence device) may be adopted as the light source.

In other words, the lighting circuit unit 2 is configured to activate (turn on) the light source selected from an electrodeless discharge lamp, a light emitting diode, and an organic electroluminescence device.

The electrodeless discharge lamp La and a solid light source (e.g. a light emitting diode and an organic electroluminescence device) have a longer life than a fluorescent lamp having filaments, and do not break down even if being used for a long time. Therefore, the electrodeless discharge lamp La and the solid light source can be used even if the accumulated operation time exceeds its life. That is, since the light source such as the solid light source (e.g. the light emitting diode and the organic electroluminescence device) and the electrodeless discharge lamp has no electrodes, the light source does not break down even if being used for a long time. The light source can be used even if the accumulated operation time exceeds the life of the lighting apparatus. A user is likely not to make maintenance of the apparatus for a long time due to the use of the light source having the long life. Therefore, the user may find later a deterioration of circuit components or mechanic components of the lighting apparatus. It is assumed that the lighting apparatus 1 is checked at the maintenance of the light source. When the number of the lighting apparatuses 1 of which performance is deteriorated after a long time use is relatively small, the lighting apparatuses 1 may be replaced at the next maintenance. However, intervals of the maintenance can be extended when the light source of log life time is used. When all the lighting apparatuses 1 perform the indication operation at the same time before the next maintenance, a user has to change one's schedule immediately and to replace the lighting apparatuses 1, which may be inconvenient for the user. However, the present invention is more effective and causes no such inconvenience especially when the light source is selected from the one having the long life time such as the electrodeless discharge lamp, the light emitting diode, and the organic electroluminescent device. When the light emitting diode or the organic electroluminescent device is adopted as the light source, a conventional circuit necessary for activating the light emitting diode or the organic electroluminescent device can be adopted as the lighting circuit unit 2.

Third Embodiment

Figure 5:
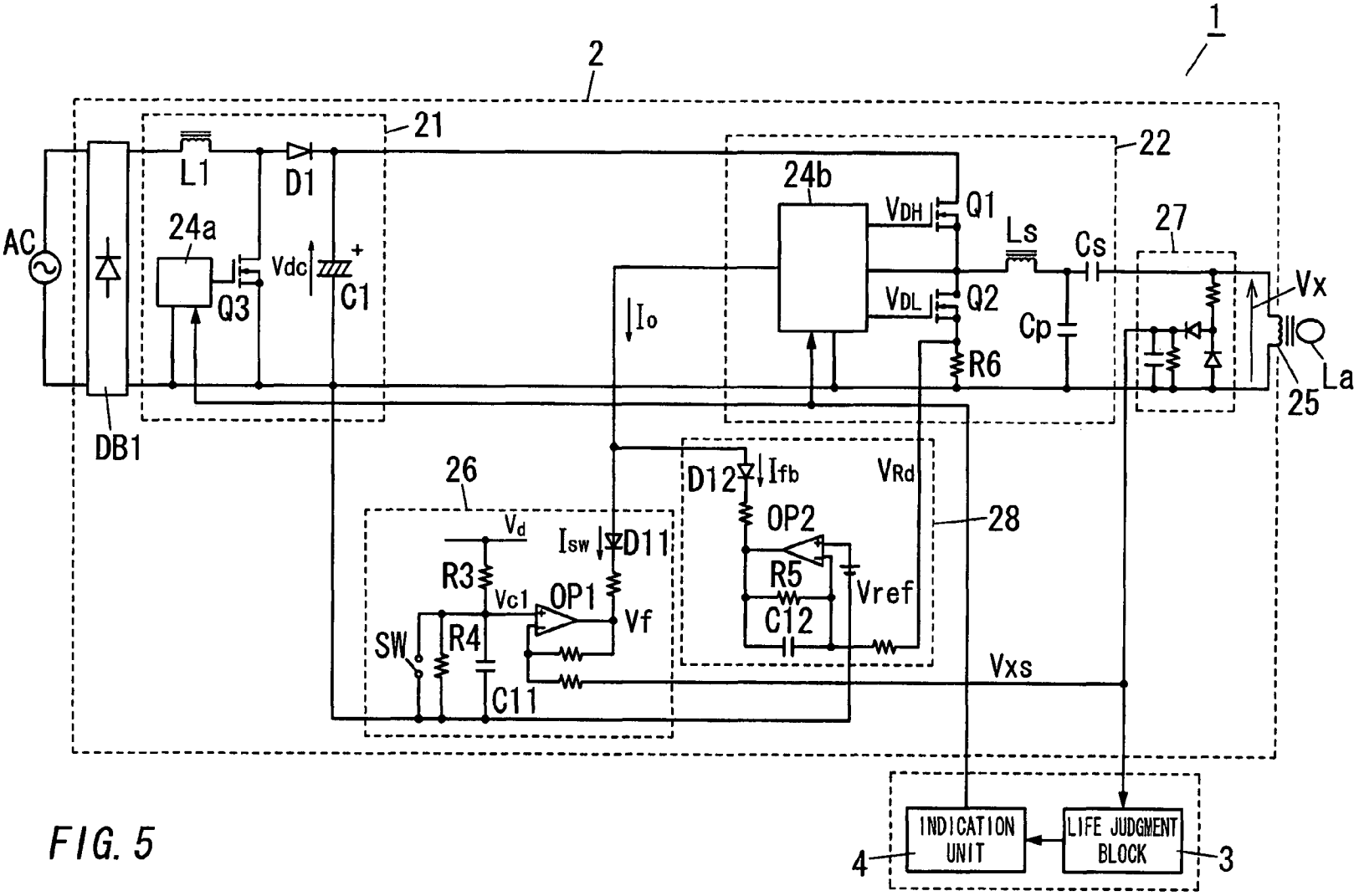
FIG. 5 is a circuit diagram illustrating the lighting apparatus of a third embodiment.

The third embodiment of the present invention is explained with reference to FIGS. 5 and 6. In the lighting apparatus 1 of the second embodiment, the accumulated operation time is measured by the timer 31 which measures the time in which the output voltage of the control source step-down circuit 30 decreasing the output voltage of the chopper circuit 21 is kept not less than the predetermined reference voltage. Meanwhile, in the present embodiment, as shown in FIG. 5, the timer 31 is configured to measure a time in which the detection voltage Vxs, which the voltage detection circuit 27 generates according to the output voltage of the inverter circuit 22, is kept not less than a prescribed reference voltage. With the exception of the measurement operation of the accumulated operation time by the timer 31, the lighting apparatus 1 of the present embodiment is the same as the lighting apparatus 1 of the second embodiment. Therefore, components common to the present embodiment and the second embodiment are designated by the same reference numerals and explanations thereof are deemed unnecessary.

The timer 31 of the life judgment block 3 is configured to measure the time in which the detection voltage Vxs is kept not less than the prescribed reference voltage. The timer 31 includes a nonvolatile memory (not shown) such as an EEPROM configured to store the accumulated operation time. When the detection voltage Vxs becomes not less than the prescribed reference voltage after the lighting apparatus 1 is turned on, the timer 31 reads out the previous accumulated operation time from the nonvolatile memory and resumes the measurement operation from the previous accumulated operation time. The timer 31 continues the measurement operation while the detection voltage Vxs is not less than the prescribed reference voltage. When the power switch is turned off to terminate the power supply, the timer 31 stores the measured accumulated operation time in the nonvolatile memory and terminates the measurement operation.

The life judgment unit 32 is configured to store a plurality of judgment times respectively corresponding to a plurality of levels predetermined to the components (e.g. electronic components or machine components constructing the lighting apparatus 1 and the main body) except for the light source. Each time the accumulated operation time measured by the timer 31 reaches the judgment time, the life judgment unit 32 generates a life judgment signal indicative of the level of the end of life corresponding to the judged judgment time and outputs the same to the indication unit 4.

Upon receiving the life judgment signal, the indication unit 4 performs the indication operation of a level in the end of life corresponding to the received life judgment signal. For example, the indication unit 4 performs the indication operation of deactivating the drive circuits 24*a* and 24*b* to turn off the electrodeless discharge lamp La and the lighting apparatus 1, and performs the indication operation of controlling the drive circuit 24*a* to deactivate the chopper circuit 21 not to output the output voltage Vdc, and performs the indication operation of controlling the drive circuit 24*b* to vary a lighting frequency in order to vary the lamp output. The indication unit 4 performs the aforementioned indication operation to announce a level in the end of life of the lighting apparatus 1 and the main body.

The indication unit 4 performs the indication operation indicative of the beginning stage of the end of life and the indication operation indicative of the end stage of the end of life. For example, the indication unit 4 may reduce the light flux of the electrodeless discharge lamp La at the beginning stage of the end of life and may turn off the electrodeless discharge lamp La or more reduce the light flux of the electrodeless discharge lamp La at the end stage of the end of life. Alternatively, the indication unit 4 may flicker at long intervals the electrodeless discharge lamp La at the beginning stage of the end of life and may flicker at short intervals or turn off the electrodeless discharge lamp La at the end stage of the end of life. Moreover, the indication unit 4 may flicker weakly the electrodeless discharge lamp La at the beginning stage of the end of life and may flicker strongly or turn off the electrodeless discharge lamp La at the end stage of the end of life. Further, the indication unit 4 may keep varying slightly the light output of the electrodeless discharge lamp La at the beginning stage of the end of life and may keep varying widely the light output of the electrodeless discharge lamp La or turn off the electrodeless discharge lamp La at the end stage of the end of life. In addition, the indication unit 4 may perform a combination of these operations.

Like the first embodiment, the judgment time adjustment unit 33 of the present embodiment also varies a plurality (two, in the present embodiment) of the judgment times stored in the life judgment unit 32, respectively, thereby distributing the respective judgment times T1 and T2 differently from different ones of the lighting apparatuses 1. FIG. 6 shows distributions of the judgment times. In FIG. 6, the horizontal axis represents the accumulated operation time, and the vertical axis represents the number of the lighting apparatuses 1 which start to perform the indication operation. With reference to FIG. 6, G21 represents the number of the lighting apparatuses 1 which start to perform the indication operation at the beginning stage of the end of life, and G22 represents the number of the lighting apparatuses 1 which start to perform the indication operation at the end stage of the end of life. In FIG. 6, a period A represents a normal lighting period in which no lighting apparatuses 1 perform the indication operation. A period B represents a period in which the lighting apparatuses 1 start in sequence to perform the indication operation at the beginning stage of the end of life. A period C represents a period in which all the lighting apparatuses 1 keep performing the indication operation at the beginning stage of the end of life. A period D represents a period in which the lighting apparatuses 1 start in sequence to perform the indication operation at the end stage of the end of life. A period E represents a period in which all the lighting apparatuses 1 keep performing the indication operation at the end stage of the end of life.

As illustrated, each of distributions of the judgment times of the indication operations is a continuous curve including an anterior half part and a posterior half part. The number of the lighting apparatuses 1 increases gradually during the anterior half part and decreases gradually during the posterior half part. In view of the plurality of the lighting apparatuses 1, the judgment times are distributed by individually varying the judgment times. Therefore, the plurality of the lighting apparatuses 1 does not perform the indication operation at the same timing. Consequently, it is possible to prevent the lighting apparatuses 1 from ceasing the lighting function without providing prior notice. Accordingly, a person around the lighting apparatuses 1 or a user can prepare a replacement for the lighting apparatus 1 before noticing inconvenience or danger.

Figure 6:
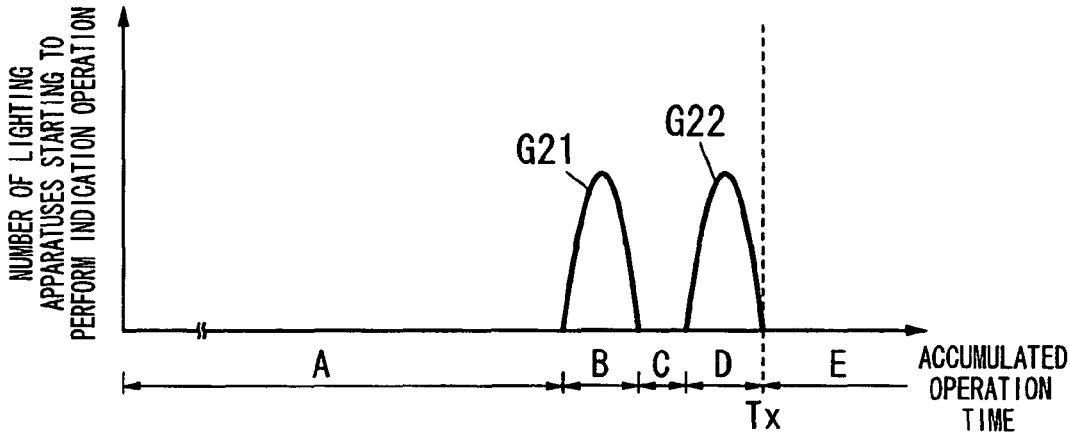
FIG. 6 is a graph showing distributions of respective judgment times for judging the corresponding level of end of life of the above lighting apparatus.

In the instance shown in FIG. 6, the second variation width is equivalent to the first variation width. Namely, the distribution width (period B) of the beginning stage of the end of life is adjusted to be equal to the distribution width (period D) of the end stage of the end of life. A person around the lighting apparatus 1 or a user can predict or realize the distribution of the lighting apparatuses 1 which start to perform the indication operation at the end stage of the end of life in view of a tendency of the distribution of the lighting apparatuses 1 which start to perform the indication operation at the beginning stage of the end of life.

In the present embodiment, the timer 31 measures the time in which the output voltage of the voltage detection circuit 27 is kept not less than the prescribed reference voltage. In other words, the timer 31 measures only a period in which the electrodeless discharge lamp La of the light source is kept turned on (that is, a period in which the power consumption of the lighting apparatus 1 is high and a deterioration advances easily). Therefore, it is possible to judge the life on the basis of the measured accumulated operation time which reflects a period in which the electrodeless discharge lamp La is kept turned on. Thus, the timer 31 can be free from measuring a time in which the lighting apparatus 1 makes the protection operation of turning off the electrodeless discharge lamp La or the power consumption of the lighting apparatus 1 is low. Consequently, it is possible to prevent the indication unit 4 from performing the indication operation at earlier timing than proper timing. It is noted that the timer 31 may measure a time in which an input voltage from the commercial AC source AC, the output voltage Vdc of the chopper circuit 21, or the output voltage of the inverter circuit 22 is kept not less than a predetermined voltage.

Fourth Embodiment

Figure 7:
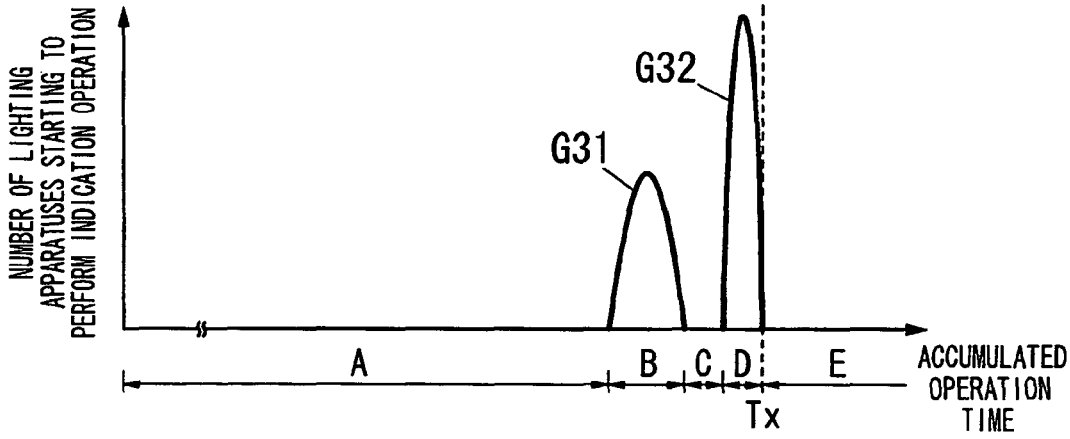
FIG. 7 is a graph showing distributions of respective judgment times for judging the corresponding level of end of life of the lighting apparatus of a fourth embodiment.

An explanation is made to the fourth embodiment of the present invention with reference to FIG. 7. The circuit configuration of the lighting apparatus 1 is the same as that of the first or second embodiment, and no explanation and illustration are deemed necessary.

The lighting apparatus 1 of the present embodiment is different from the lighting apparatuses 1 explained in the first and second embodiments, in the distribution width (period B in FIG. 7) of the judgment time for judging the beginning stage in the end of life and the distribution width (period D in FIG. 7) of the judgment time for judging the end stage in the end of life. FIG. 7 shows distributions of the judgment times of the respective stages. In FIG. 7, the horizontal axis represents the accumulated operation time, and the vertical axis represents the number of the lighting apparatuses 1 which start to perform the indication operation. With reference to FIG. 7, G31 represents the number of the lighting apparatuses 1 which start to perform the indication operation at the beginning stage of the end of life, and G32 represents the number of the lighting apparatuses 1 which start to perform the indication operation at the end stage of the end of life. In FIG. 7, a period A represents a normal lighting period in which no lighting apparatuses 1 perform the indication operation. A period B represents a period in which the lighting apparatuses 1 start in sequence to perform the indication operation at the beginning stage of the end of life. A period C represents a period in which all the lighting apparatuses 1 keep performing the indication operation at the beginning stage of the end of life. A period D represents a period in which the lighting apparatuses 1 start in sequence to perform the indication operation at the end stage of the end of life. A period E represents a period in which all the lighting apparatuses 1 keep performing the indication operation at the end stage of the end of life.

The judgment time adjustment units 33 of the respective lighting apparatuses 1 vary the respective judgment times in the same manner as the first embodiment, i.e., by distributing the judgment times T1 and T2. The judgment time T2 for judging the end stage of the end of life is smaller in the variation width than the judgment time T1 for judging the beginning stage of the end of life. There may be a situation where all the lighting apparatuses 1 are required to start the indication operation (operation of turning off the light source) as to the end stage of the end of life before the accumulated operation time reaches a predetermined life time Tx. In this situation, in order to extend the normal lighting period A as long as possible, it may be sufficient that the periods B, C, and D are shortened. If all the periods B, C, and D are shortened, there is seen a shortening of the time period starting from the very beginning of the indication operation for the beginning stage and ending on the time when the accumulated operation time reaches the life time Tx. In other words, when the user is noticed of that the lighting apparatus 1 is coming closer to the end of its life and is required to replace the lighting apparatus, the user is given only a short time for preparing the replacement parts for the lighting apparatus. However, the lighting apparatus 1 of the present embodiment can make the indication operation at the beginning stage of the end of life prior to performing the indication operation at the end stage of the end of life. In addition, the period B, in which the lighting apparatuses 1 start in sequence to perform the indication operation of the beginning stage of the end of life, is set to be longer than the period D in which the lighting apparatuses 1 start in sequence to perform the indication operation of the end stage of the end of life. Therefore, the user can make the preparation (e.g. preparation of the replacement for the lighting apparatus 1) within the period B from the beginning of the indication operation of the beginning stage of the end of life to the expiration of the life. As seen from the above, if the period B is sufficient for the preparation of the replacement before the expiration of the end of the life, the period D can be shorted relative to the period B so as to prolong the normal lighting period A for keeping the light source turned on with 100% light output over an extended time period.

Fifth Embodiment

Figure 8:
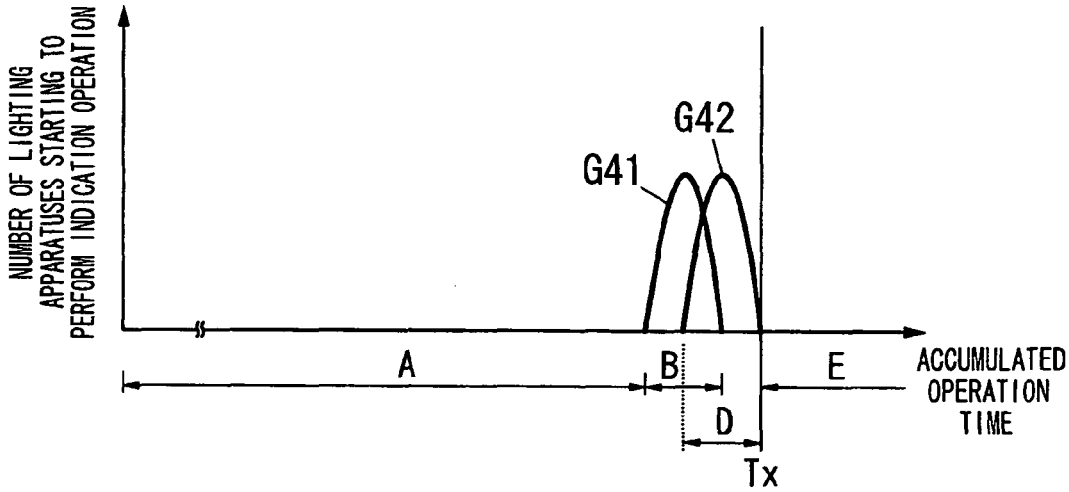
FIG. 8 is a graph showing distributions of respective judgment times for judging the corresponding level of end of life of the lighting apparatus of a fifth embodiment.

An explanation is made to the fifth embodiment of the present invention with reference to FIG. 8. The circuit configuration of the lighting apparatus 1 is the same as that of the first or second embodiment, and no explanation and illustration are deemed necessary.

In the above respective embodiments, in order to distribute the respective judgment times T1 and T2, the judgment time adjustment units 33 of the respective lighting apparatuses 1 vary respectively the judgment time T1 for judging the beginning stage of the end of life and the judgment time T2 for judging the end stage of the end of life. Further, in the aforementioned respective embodiments, the variation widths of the judgment times T1 and T2 are determined in order that the distribution of the judgment time T1 does not overlap with the distribution of the judgment time T2. In the present embodiment, the variation widths of the judgment times T1 and T2 are delimited in order that the distribution of the judgment time T1 overlaps with the distribution of the judgment time T2. FIG. 8 shows distributions of the judgment times of the respective levels. In FIG. 8, the horizontal axis represents the accumulated operation time, and the vertical axis represents the number of the lighting apparatuses 1 which start to perform the indication operation. With reference to FIG. 8, G41 represents the number of the lighting apparatuses 1 which start to perform the indication operation at the beginning stage of the end of life, and G42 represents the number of the lighting apparatuses 1 which start to perform the indication operation at the end stage of the end of life. In FIG. 8, a period A represents a normal lighting period in which not lighting apparatuses 1 perform the indication operation. A period B represents a period in which the lighting apparatuses 1 start in sequence to perform the indication operation at the beginning stage in the end of life. A period D represents a period in which the lighting apparatuses 1 start in sequence to perform the indication operation at the end stage in the end of life. A period E represents a period in which all the lighting apparatuses 1 keep performing the indication operation at the end stage in the end of life.

The judgment time adjustment units 33 of the respective lighting apparatuses 1 vary the judgment time T1 by use of random numbers in the same manner as the first embodiment, but vary the judgment time T2 by means of the other method. If the judgment time T2 is varied by use of random numbers, a sequence of performing the indication operation at the beginning stage of the end of life is likely to be different from a sequence of performing the indication operation at the end stage of the end of life. Therefore, the judgment time adjustment unit 33 varies the judgment time T1 in conformity with judgment time T2 such that the indication operation at the end stage is performed after a lapse of a constant time dT from the time of performing the indication operation at the beginning stage. Further, in the judgment time adjustment unit 33, the constant time dT is shorter than the variation width of the period B. Therefore, at least one part of the distribution of the judgment time T1 (G41 in FIG. 8) overlaps with the distribution of the judgment time T2 (G42 in FIG. 8). The indication operation at the end stage is performed in the same sequence as the indication operation at the beginning stage. Consequently, the sequence in which the indication operation at the end stage is performed can be predicted. In contrast to a situation where the judgment times T1 and T2 are varied such that the distribution (G41 in FIG. 8) of the judgment time T1 does not overlap with the distribution (G42 in FIG. 8) of the judgment time T2, the normal lighting period A in which the lighting function is fully executed can be more extended because at least one part of the distribution of the judgment time T1 (G41 in FIG. 8) overlaps with the distribution of the judgment time T2 (G42 in FIG. 8).

Sixth Embodiment

Figure 9:
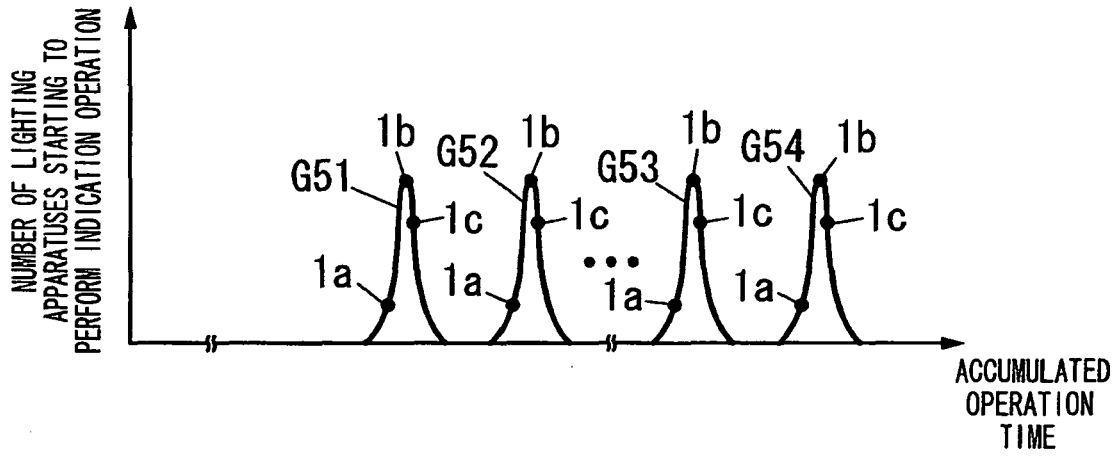
FIG. 9 is a graph showing distributions of respective judgment times for judging the corresponding level of end of life of the lighting apparatus of a sixth embodiment.

An explanation is made to the sixth embodiment of the present invention with reference to FIG. 9. The circuit configuration of the lighting apparatus 1 is the same as that of the first or second embodiment, and no explanation and illustration are deemed necessary.

The respective embodiments select the two stages, that is the beginning stage and the end stage in the end of life, and perform the two indication operations, that is, the indication operations respectively indicative of the beginning stage and the end stage in the end of life. By contrast, the present embodiment has the n judgment times T1, T2, . . . , Tn−1, and Tn respectively corresponding to the n phases of the end of life (n is integer not less than 3). Each time when the accumulated operation time reaches the judgment time, the life judgment signal is sent to the indication unit 4. The indication unit 4 performs the indication operation indicative of the phase of the end of life corresponding to the received life judgment signal.

FIG. 9 shows distributions of the judgment times. In FIG. 9, the horizontal axis represents the accumulated operation time, and the vertical axis represents the number of the lighting apparatuses 1 which start to perform the indication operation. With reference to FIG. 9, G51, G52, G53, and G54 represent the number of the lighting apparatuses 1 which start to perform the indication operation of the first, second, (n−1) th, and nth stages (levels) in the end of life, respectively.

As shown in FIG. 9, the distribution widths of the respective judgment times T1, . . . , and Tn are selected not to overlap with each other. The judgment time adjustment unit 33 may vary the respective judgment times such that at least one part of the distributions of one of the judgment times overlaps with the distribution of the other judgment time. In view of the plural lighting apparatuses 1 installed at the approximately same time, if the distribution of the judgment time T1 for judging the beginning stage in the end of life does not overlap with the distribution of the judgment time T2 for judging the end stage in the end of life, timing in which the accumulated operation time reaches the first judgment time T1 does not overlap with timing in which the accumulated operation time reaches the last judgment time Tn. Therefore, all the lighting apparatuses 1 perform the indication operation indicative of the beginning stage of the end of life before any lighting apparatus 1 performs the indication operation indicative of the end stage of the end of life. A user can preliminarily know the number of the lighting apparatuses 1 coming closer to the end of life and necessitated to be replaced. Consequently, the user can prepare the replacement for the lighting apparatus 1 in view of the end of life.

Upon receiving the life judgment signal from the life judgment unit 32, the indication unit 4 performs the indication operation of the level in the end of life indicated by the received life judgment signal. In the indication operation at the later level of the end of life, the discharge lamp La may have its light output decreased by a greater extent or its flicker frequency increased by a greater extent. In this situation, the lighting apparatus 1 performing the indication operation indicative of the later level of the end of life can be clearly distinguished from the lighting apparatus 1 not performing the indication operation. Accordingly, a user can easily notice the lighting apparatus 1 coming closer to the end of life.

The indication unit 4 decreases the light output gradually as the indication operation advances from the first level to the (n−1)th level. Further, the indication unit 4 turns off the discharge lamp La or greatly decreases the light output in the indication operation indicative of the nth level (end stage) of the end of life. The indication operations of the respective levels are not limited to the aforementioned operation. For example, the indication unit 4 may increase the frequency of the flicker of the discharge lamp La as the indication operation advances from the first level to the (n−1)th level, and may turn off or flicker frequently the discharge lamp La in the indication operation at the nth level (end stage) of the end of life. The indication unit 4 may increase a degree of the flicker of the light output as the indication operation advances from the first level to the (n−1)th level, and may turn off the discharge lamp La or more increase the degree of the flicker of the light output in the indication operation at the nth level (end stage) of the end of life. The indication unit 4 may keep varying slightly the light output of the discharge lamp La as the indication operation advances from the first level to the (n−1)th level, and may keep varying widely the light output of the discharge lamp La or turn off the discharge lamp La in the indication operation at the nth level (end stage) of the end of life. The indication unit 4 may perform a combination of these operations. The indication unit 4 may perform the different types of the indication operation (e.g., a decrease of the light output, and a flicker of the discharge lamp) in the different indication operations. The indication unit 4 may perform a combination of the indication operations. For example, the indication unit 4 may decrease the light output and flicker the discharge lamp in combination. With this arrangement, it is possible to successfully notify a user and a person around the lighting apparatus of that the lighting apparatus is coming closer to the end of its life.

If the indication unit 4 turns off the discharge lamp La or deactivates the lighting circuit 2 at the indication operation corresponding to the last level in the end of life, the lighting circuit 2 does not operate anymore thereafter. Therefore, it is possible to suppress the deterioration of the lighting apparatus 1 and the main body, and to improve the safety thereof. In the indication operation corresponding to the last level of the end of life, the indication unit 4 may cause the lighting apparatus 1 to operate the discharge lamp La nearly in a turned-off state or cause the lighting circuit 2 to operate nearly in a resting state. With this modification, since the deterioration of the lighting circuit 2 and the like is considerably restrained, it is possible to prevent the lighting apparatus 1 from being kept operating under the condition where the safety is not assured (unsafe condition).

Seventh Embodiment

Figure 10:
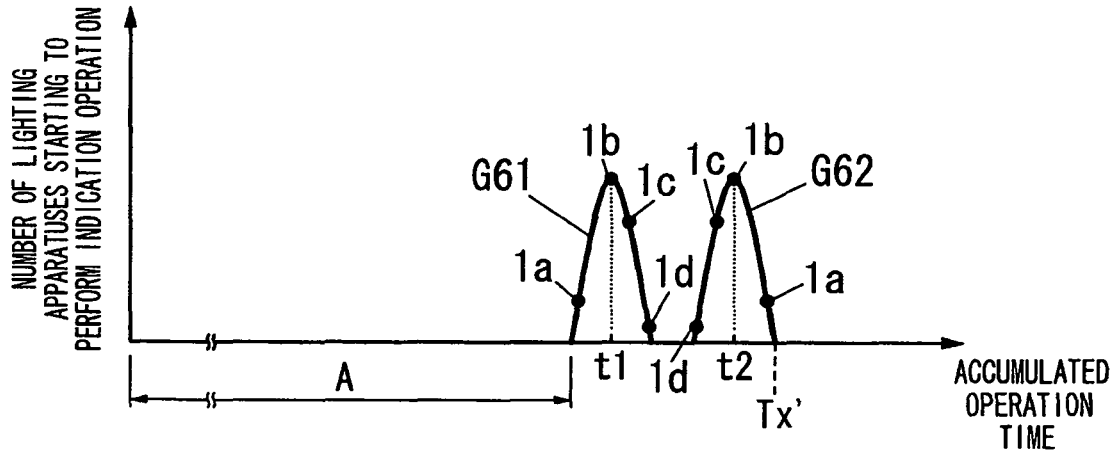
FIG. 10 is a graph showing distributions of respective judgment times for judging the corresponding level of end of life of the lighting apparatus of a seventh embodiment.

An explanation is made to the seventh embodiment of the present invention with reference to FIG. 10. The circuit configuration of the lighting apparatus 1 is the same as that of the first or second embodiment, and no explanation and illustration are deemed necessary.

FIG. 10 shows distributions of the judgment times of the respective levels. In FIG. 10, the horizontal axis represents the accumulated operation time, and the vertical axis represents the number of the lighting apparatuses 1 which start to perform the indication operation. In FIG. 10, G61 represents the number of the lighting apparatuses 1 which start to perform the indication operation at the beginning stage of the end of life, and G62 represents the number of the lighting apparatuses 1 which start to perform the indication operation at the end stage of the end of life. In FIG. 10, a period A represents a normal lighting period in which not lighting apparatuses 1 perform the indication operation. A period B represents a period in which the lighting apparatuses 1 start in sequence to perform the indication operation at the beginning stage of the end of life.

The lighting apparatus 1 of the present embodiment is different from that of the first and second embodiments, in that the judgment time adjustment unit 33 varies the respective judgment times such that the lighting apparatuses make the operations at the end stage of the end of life in the reverse order than the order in which the lighting apparatuses make the operation at the beginning stage. With the exception of this difference, the lighting apparatus 1 of the present embodiment is the same as that of the first or second embodiment. Therefore, no explanation for components and operations common to the present embodiment and the first or second embodiment is deemed necessary.

The judgment time adjustment unit 33 varies the judgment time T1 for the beginning stage by use of a random number. For example, the judgment time adjustment unit 33 generates a random number x within a predetermined variation width (±Δt), and obtains the judgment time T1 (=t1+Δt) by adding the random number x to a reference value t1 of the judgment time for the beginning stage. Meanwhile, with respect to the judgment time T2, the random number x used for varying the judgment time T1 for the beginning stage is used again. The judgment time adjustment unit 33 obtains the judgment time T2 (=t2−Δt) by subtracting the random number x from a reference value t2 of the judgment time for the end stage.

The judgment time adjustment unit 33 varies the times T1 and T2 in the aforementioned manner. Therefore, the lighting apparatuses can make the operations at the end stage of the end of life in the reverse order than the order in which the lighting apparatuses make the operations at the beginning stage of the end of life. The earlier the lighting apparatus 1 makes the indication operation of the beginning stage, the longer the lighting apparatus 1 has a period for reducing its output. Thus, the lighting apparatus is expected to have a longer operation life by the elongated period. As seen from the above, when the lighting apparatuses make the operations at the end stage of the end of life in the reverse order than the order in which the lighting apparatuses make the operations at the beginning stage of the end of life, the overall distributions of the judgment times T1 and T2 can be shifted to the longer side of the accumulated operation time. Therefore, the normal lighting period A in which the lighting function is not reduced can be extended by the shifted amount of the distribution of the judgment times T1 and T2.

Besides, in the aforementioned respective embodiments, the indication unit 4 makes the indication operations at the individual levels of the end of life in a manner different from that in the normal operation. Additional part necessary for realizing the indication may be attached to the main body in order to notify the user or an around person of that the apparatus is coming to its end of life. Such part includes an LED or the like pilot lamp which is attached to the exterior of the main body and is turned on by the indication unit 4, and a buzzer or speaker which is activated by the indication unit 4 to issue a sound or voice. Further, the part may be a transmitter which transmits an indication signal to an eternal monitoring system for making the indication on the side of the system. When using such additional part, it is possible to provide the indication of the end of life is coming without impairing the lighting function, prompting the user to replace the lighting apparatus. With this indication and prompt, it is possible to avoid the lighting apparatus from malfunction or any disorder due to deterioration of the components forming the apparatus and/or the main body, assuring to keep operating the lighting apparatus in a safe manner.

Eighth Embodiment

Figure 11:
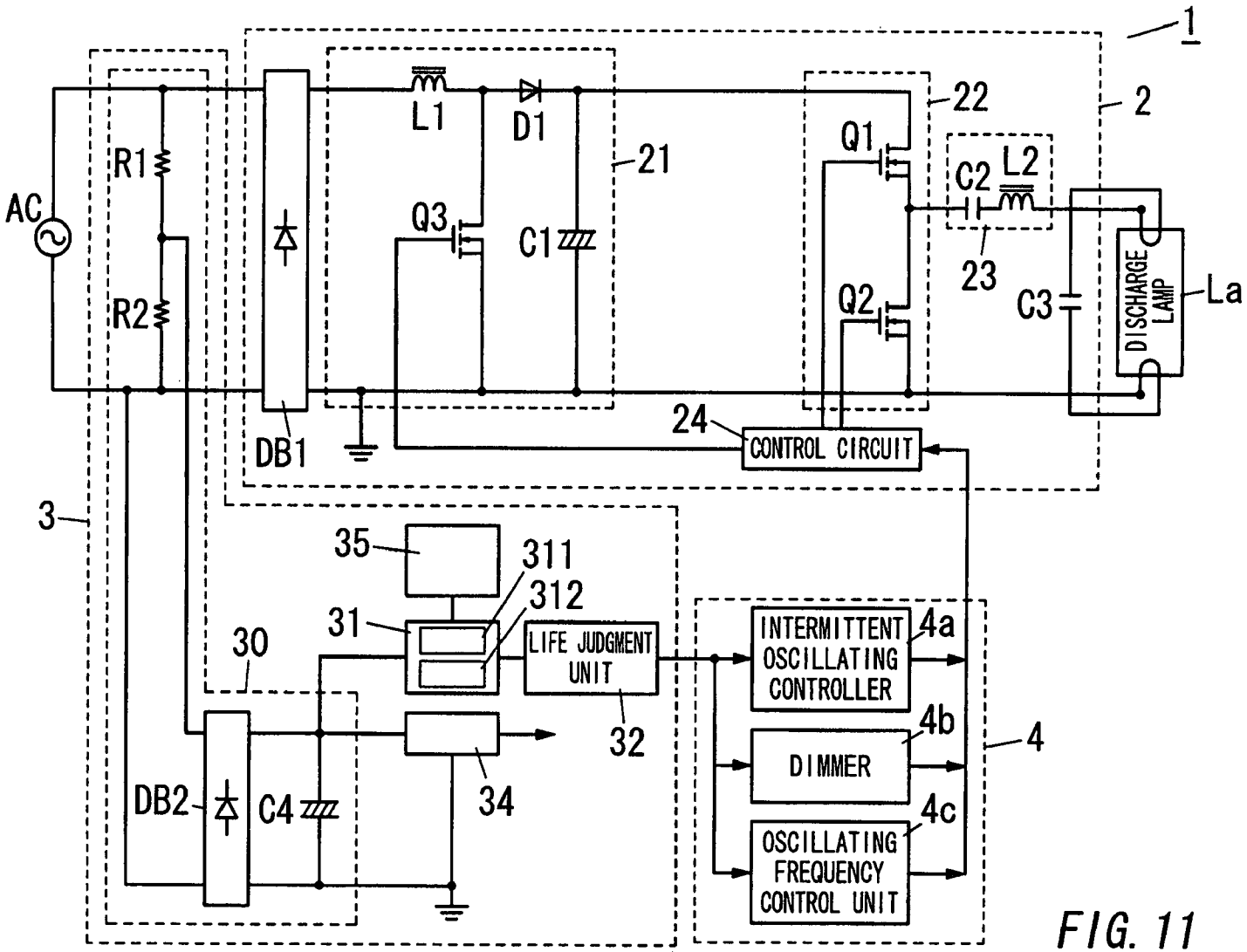
FIG. 11 is a circuit diagram illustrating the lighting apparatus of an eighth embodiment.

As shown in FIG. 11, the lighting apparatus 1 of the present embodiment is different from the lighting apparatus 1 of the first embodiment in that the lighting apparatus 1 of the present embodiment includes an accumulated operation time adjustment unit 35 instead of the judgment time adjustment unit 33. Therefore, components common to the present embodiment and the second embodiment are designated by the same reference numerals and explanations thereof are deemed unnecessary.

The accumulated operation time adjustment unit 35 is configured to vary the accumulated operation time measured by the timer 31.

The life judgment unit 32 of the present embodiment is configured to compare the accumulated operation time varied by the accumulated operation time adjustment unit 35 with the first judgment time T1 and output the first judgment signal when the accumulated operation time varied by the accumulated operation time adjustment unit 32 becomes equal to the first judgment time T1. The life judgment unit 32 of the present embodiment is configured to compare the accumulated operation time varied by the accumulated operation time adjustment unit 32 with the second judgment time and output the second judgment signal when the accumulated operation time varied by the accumulated operation time adjustment unit 32 becomes equal to the second judgment time T2.

That is, the accumulated operation time adjustment unit 35 varies the accumulated operation time measured by the timer 31 in order to adjust the timing at which the life judgment unit 32 provides the life judgment signal (first judgment signal and second judgment signal). Therefore, the accumulated operation time adjustment unit 35 is configured to function as the timing adjustment unit.

In the present embodiment, the timer 31 includes an oscillator 311 and a counting circuit 312. The oscillator 311 is configured to output a clock signal at a constant period. The counting circuit 312 is configured to count the number of the clock signals output from the oscillator 311.

The accumulated operation time adjustment unit 35 is configured to randomly vary a threshold for the counting circuit 312 within a predetermined variation width. The accumulated operation time adjustment unit 35 generates a random number before a lapse of a predetermined time from a time at which the lighting apparatus 1 (e.g., the accumulated operation time adjustment unit 35, the timer 31, or a microcomputer acting as the accumulated operation time adjustment unit 35 and the timer 31) is turned on for the first time (beginning of use), and varies the aforementioned threshold by use of the generated random number.

The counting circuit 312 is configured to increase the accumulated operation time by a constant amount each time the number of the clock signals output from the oscillator 311 becomes equivalent to the threshold varied by the accumulated operation time adjustment unit 35, thereby measuring the accumulated operation time.

Therefore, according to the lighting apparatus 1 of the present embodiment, the accumulated operation time adjustment unit 35 varies the accumulated operation time. Thus, even if the plurality of the lighting apparatuses 1 is installed, the plurality of the lighting apparatuses 1 does not perform the indication operation at the same timing. Consequently, the lighting apparatus 1 will not cause anxiety to people thereabout and will not reduce its safety. Further, it is possible to prevent the people from making false recognition that the light flux is lowered due to the power failure.

Ninth Embodiment

Figure 12:
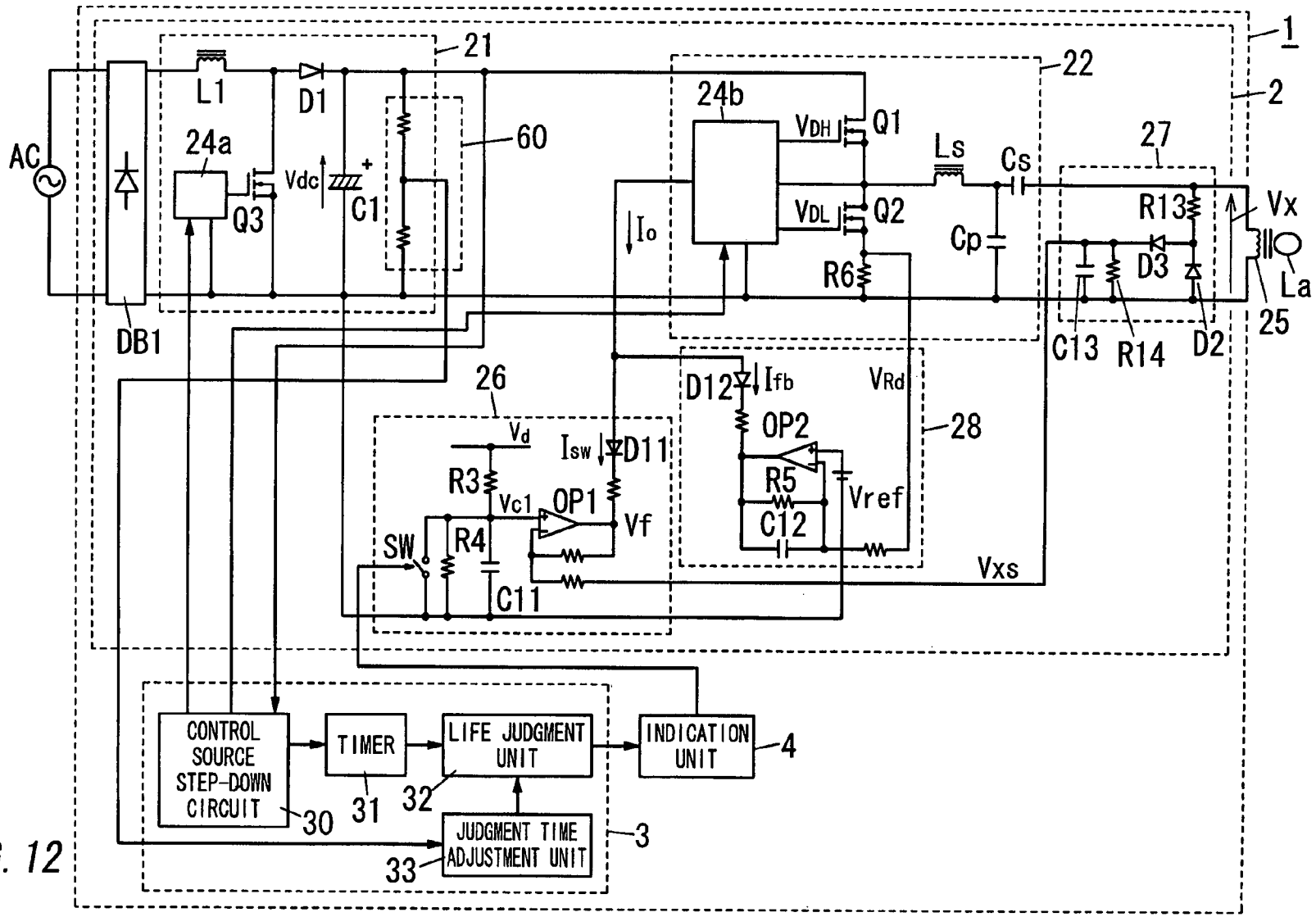
FIG. 12 is a circuit diagram illustrating the lighting apparatus of a ninth embodiment.

As shown in FIG. 12, the lighting apparatus 1 of the present embodiment includes the lighting circuit 2, the life judgment block 3, the indication unit 4, and a detection unit 60. In the present embodiment, an electrodeless discharge lamp is adopted as the discharge lamp La.

The lighting apparatus 2 of the present embodiment includes the induction coil 25, a lighting unit, and a control unit. The induction coil 25 is disposed adjacent to the discharge lamp La. The lighting unit is configured to output a high frequency power to the induction coil 25 so as to turn on the discharge lamp La. The control unit is configured to control the lighting unit.

The lighting unit includes a DC source circuit (chopper circuit) 21 and the inverter circuit 22. The DC source circuit 21 is configured to convert an AC power supplied from the AC source AC into a DC power. The inverter circuit 22 is configured to convert the DC power output from the DC source circuit into a high frequency AC power and output the same to induction coil 25.

The DC source circuit 21 is a conventional step-up converter (boost converter) which includes the diode bridge DB1, a series circuit of the inductor L1, the diode D1, and an output capacitor (smoothing capacitor) C1, the switching element Q3, and a drive circuit (control circuit) 24*a*. The diode bridge DB1 is configured to make a full-wave rectification of an AC current supplied from the AC source AC. The series circuit is connected across the output terminals of the diode bridge (rectifier) DB1. The switching element Q3 is connected between the lower side output terminal of the diode bridge DB1 and a connection point of the inductor L1 and the diode D1. The drive circuit 24*a* is configured to turn on and off periodically the switching element Q3. The control unit is energized by a step-down circuit configured to decrease an output voltage of the DC source circuit 21.

The inverter circuit 22 includes a series circuit of the switching elements Q1 and Q2 and a detection resistor (resistor) R6, the inductor Ls, the capacitor (series capacitor) Cs, the capacitor (parallel capacitor) Cp, and a drive circuit (control circuit) 24*b*. The series circuit is connected across the output terminals of the DC source circuit, that is, the terminals of the output capacitor C1. The inductor Ls has its first end connected to a connection point of the switching elements Q1 and Q2. The capacitor Cs has its first end connected to a second end of the inductor Ls and has its second end connected to a first end of the induction coil 25. The capacitor Cp has its first end connected to a connection point of inductor Ls and the series capacitor Cs and has its second end connected to a connection point of the detection resistor R6 and the induction coil 25. The drive circuit 24*b* is configured to turn on and off alternately the switching elements Q1 and Q2.

The control unit includes a sweep circuit (starting circuit) 26 configured to gradually reduce an operating frequency so as to gradually increase an output power from the inverter circuit 22 to the induction coil 25 during a start-up period of the discharge lamp. The control unit further includes a voltage detection unit (voltage detection circuit) 27 configured to provide the detection voltage Vxs of a DC voltage which increases with an increase of a voltage magnitude |Vx|. The sweep circuit 26 is configured to control the inverter circuit 22 in accordance with the detection voltage Vxs output from the voltage detection unit 27. The voltage detection unit 27 is configured to divide the coil voltage Vx by the resistors and rectify the resultant coil voltage Vx by a diode and smooth the resultant coil voltage Vx by a capacitor to generate the detection voltage Vxs.

The sweep circuit 26 includes the operational amplifier OP1 having its inverting input terminal connected to its output terminal through a resistor and connected to the output terminal of the voltage detection unit through a resistor. The operational amplifier OP1 has its output terminal connected to a control terminal of the drive circuit 24*b* through a series circuit of a capacitor and a diode for backflow prevention. The sweep circuit 26 further includes the resistor R3 and a parallel circuit of the switch SW, the resistor R4, and the capacitor C11. The resistor R3 has its first end receiving a constant voltage (operational voltage) Vd. The parallel circuit has its first end connected to a second end of the resistor R3 and has its second end connected to the ground of circuits. The operational amplifier OP1 has its non-inverting input terminal connected to a connection point of the aforementioned parallel circuit and the resistor R3.

The control unit includes a feedback circuit (control circuit) 28 configured to control the operating frequency corresponding to a voltage at a connection point of the detection resistor R6 and the lower side switching element Q2 of the inverter circuit 22, that is, a current flowing through the inverter circuit 22. The feedback circuit 28 includes the operational amplifier OP2 having its non-inverting input terminal receiving a predetermined voltage Vref and having its output terminal connected to a control terminal of the drive circuit 24*b* through a resistor and a diode D12 for backflow prevention. The operational amplifier OP2 has its inverting input terminal connected to its output terminal through the parallel circuit of the resistor R5 and the capacitor C12 and connected to a connection point of the switching element Q2 and the resistor R6 of the inverter circuit 22 through a resistor.

The detection unit 60 is configured to detect a temperature of the lighting circuit 2 and output the detected temperature as its detection value. Especially, in the present embodiment, the detection unit 60 is configured to detect a temperature of a specific part of the lighting circuit 2, for example, the output capacitor C1 which forms a portion of the DC source circuit 21, and is rather likely to be deteriorated with age.

The detection unit 60 is a series circuit of a resistor whose resistance varies little with temperature and a thermally sensitive resistor (thermistor) whose resistance varies significantly with temperature. The detection unit 60 is connected across the output terminals of the DC source circuit 21. The aforementioned thermally sensitive resistor is placed adjacent to the output capacitor C1 being a component (hereinafter referred to as "detection target component") whose temperature is detected by the detection unit 60. An output voltage (detection value) of the detection unit 60 varies depending on the temperature of the output capacitor C1. A platinum resistor is well known as the aforementioned thermally sensitive resistor. The thermally sensitive resistor can be of a pin insertion type or a surface mounting type. When the detection target component is a printed wiring board, the thermally sensitive resistor is preferred to be of the surface mounting type rather than the pin insertion type. Alternately, for example, a radiation thermometer utilizing a thermopile or the like can be adopted as the detection unit 60.

The judgment time adjustment unit 33 of the present embodiment is configured to vary respectively the first judgment time T1 and the second judgment time T2 corresponding to the detection value (detected temperature) received from the detection unit 60. In the present embodiment, the second level of the end of life is defined as the last level of the end of life, and the second judgment time T2 is shorter than an end of life of any component of the lighting circuit unit 2.

The judgment time adjustment unit 33 is configured to compare the detection value obtained from the detection unit 60 with a predetermined reference value (reference temperature). The deterioration of the lighting circuit unit 2 is promoted as the temperature increases. Therefore, the judgment time adjustment unit 33 increases the judgment times T1 and T2 as the detection value decreases relative to the reference value (the temperature decreases). The judgment time adjustment unit 33 decreases the judgment times T1 and T2 as the detection value increases relative to the reference value (the temperature increases).

Figure 13:
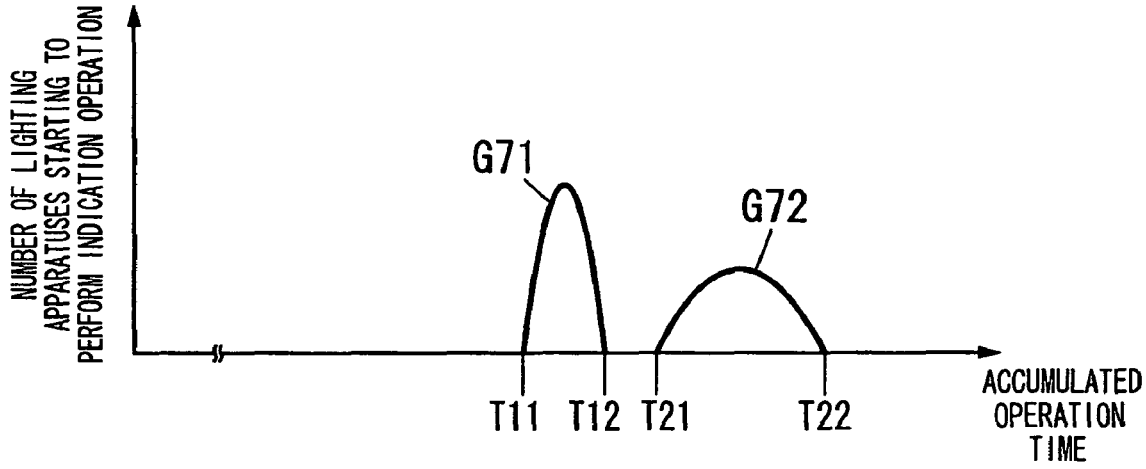
FIG. 13 is a graph showing distributions of respective judgment times for judging the corresponding level of end of life of the lighting apparatus of the ninth embodiment.

FIG. 13 shows distributions of the judgment times. In FIG. 13, the horizontal axis represents the accumulated operation time, and the vertical axis represents the number of the lighting apparatuses 1 which start to perform the indication operation. With reference to FIG. 13, G71 represents the number of the lighting apparatuses 1 which start to perform the indication operation at the beginning stage of the end of life, and G72 represents the number of the lighting apparatuses 1 which start to perform the indication operation at the end stage of the end of life.

As shown in FIG. 13, the judgment time adjustment unit 33 varies the first judgment time T1 within a range of T11 to T12 (first variation width). In addition, the judgment time adjustment unit 33 varies the second judgment time T2 within a range of T21 to T22 (second variation width). In other words, the distributions of the judgment times T1 and T2 have the upper limit and the lower limit.

The judgment time adjustment unit 33 is configured to select T11 and T21 as the judgment times T1 and T2 respectively when the detected temperature is not greater than −20° C. The judgment time adjustment unit 33 is configured to select T12 and T22 as the judgment times T1 and T2 respectively when the detected temperature is not less than 100° C.

For example, when the reference temperature is 60□, initial values of the judgment times T1 and T2 are decided on the basis of a life of the lighting circuit unit 2 having its temperature of 60□.

The judgment time adjustment unit 33 does not vary the judgment times T1 and T2 when the detected temperature is equivalent to the reference value. The judgment time adjustment unit 33 increases the judgment times T1 and T2 by one unit time (e.g. 1 minute, 5 minutes, and 1 hour) when the detected temperature is lowered by 1° C. than the reference value. The judgment time adjustment unit 33 increases the judgment times T1 and T2 by two unit times when the detected temperature is lowered by 2° C. than the reference value. By contrast, the judgment time adjustment unit 33 decreases the judgment times T1 and T2 by one unit time when the detected temperature is increased by 1° C. than the reference value. The judgment time adjustment unit 33 decreases the judgment times T1 and T2 by two unit times when the detected temperature is increased by 2° C. than the reference value. The unit times of the judgment times T1 and T2 may be different from each other. The unit time (variation of the judgment time) may be selected such that total variations of the judgment times T1 and T2 fall within a predetermined range.

According to the lighting apparatus 1 of the present embodiment, it takes a longer time to judge the end of life as the environmental temperature becomes lower to retard the deterioration of the circuit components forming the lighting circuit 2, such deterioration being influenced by the individual difference of the components and promoted in the high environmental temperature. For example, even when a plurality of the lighting apparatuses 1 are used in the same environment, the individual lighting circuits 2 see different operation temperatures due to the individual difference of the components. Accordingly, the lighting circuit 2, which operates at the lower temperature and sees less deterioration of the circuit components, is given a longer time for judgment of the end of life than the other lighting circuit, and therefore improving accuracy of judging the end of life, and further enabling to randomly vary the time at which the indication unit 4 of the lighting apparatuses 1 starts to perform the indication operation.

Besides, the judgment time adjustment unit 33 may adjust the judgment times T1 and T2 one or more times. For example, when an operating condition of the lighting circuit unit 2 is changed (e.g. the light source is replaced), or when a usage environment is changed (e.g. an ambient temperature is varied due to devices placed adjacent to the lighting apparatus 1), the judgment time adjustment unit 33 may vary the judgment times T1 and T2.

Further, in the lighting apparatus 1 of the present embodiment, the second level of the end of life is defined as the last level of the end of life. The second judgment time T2 is shorter than an end of life of any component of the lighting circuit unit 2. That is, the last judgment time (second judgment time T2) is varied to fall below a lifetime of any component of the lighting circuit unit 2. Therefore, it is possible to prevent the respective judgment times T1 and T2 from exceeding the lifetime of the lighting circuit unit 2. Thus, it is possible to improve the safety of the lighting apparatus 1 and to prevent an unnecessary protection operation and an unnecessary promotion of replacement.

Besides, the detection unit 60 may be configured to detect a voltage applied to the lighting circuit unit 2 (voltage applied to a specific component of the lighting circuit 2) and/or a current flowing through the lighting circuit unit 2 (current supplied to a specific component of the lighting circuit unit 2).

That is, the detection unit 60 may be configured to detect at least one of a temperature of the lighting apparatus 1, a voltage applied to the lighting apparatus 1, and a current flowing through the lighting apparatus 1, and output detection value indicative thereof. In this situation, the judgment time adjustment unit 33 is configured to respectively vary the judgment times T1 and T2 according to the detection value received from the detection unit 60.

In a situation where the detection value indicates a voltage applied to the lighting circuit unit 2, the deterioration of the lighting circuit unit 2 is promoted as the voltage increases. The judgment time adjustment unit 33 increases the judgment times T1 and T2 as the detection value decreases relative to a reference value (reference voltage) (the voltage decreases). The judgment time adjustment unit 33 decreases the judgment times T1 and T2 as the detection value increases relative to the reference value (the voltage increases).

Further, in a situation where the detection value indicates a current flowing through the lighting circuit unit 2, the deterioration of the lighting circuit unit 2 is promoted as the current increases. The judgment time adjustment unit 33 increases the judgment times T1 and T2 as the detection value decreases relative to a reference value (reference current) (the current decreases). The judgment time adjustment unit 33 decreases the judgment times T1 and T2 as the detection value increases relative to the reference value (the current increases).

Tenth Embodiment

The lighting apparatus 1 of the present embodiment is different in the operation of the judgment time adjustment unit 33 from the lighting apparatus 1 of the ninth embodiment. Besides, the components common to the present embodiment and the ninth embodiment are designated by the same reference numeral and no explanation thereof is deemed necessary.

The judgment time adjustment unit 33 is configured to calculate a subtraction amount by use of the detection value obtained from the detection unit 60. The judgment time adjustment unit 33 is configured to subtract the calculated subtraction amount from the judgment times T1 and T2 in order to vary the judgment times T1 and T2 respectively.

Next, an explanation is made to a method which the judgment time adjustment unit 33 employs for determining the subtraction amount. The judgment time adjustment unit 33 preliminarily stores a life function in a ROM or the like. The life function is defined as a function of temperature, and has a negative correlation with temperature at least in a portion of a temperature range (hereinafter referred to as "application temperature range") at which the lighting circuit unit 2 is expected to operate. In the present embodiment, the application temperature range is from −20° C. to 100° C.

The judgment time adjustment unit 33 inputs the temperature (detected temperature) detected by the detection unit 60 into the life function, thereby determining the lifetime of the lighting circuit 2 corresponding to the detected temperature. The judgment time adjustment unit 33 subtracts the lifetime of the lighting circuit unit 2 corresponding to the detected temperature from a reference lifetime of the lighting circuit unit 2 (e.g. a lifetime of the lighting circuit unit 2 at temperature of −20° C.), thereby determining the subtraction amount. Besides, the subtraction amount can be a negative value. For example, the judgment time adjustment unit 33 can obtain the subtraction amount by use of a data table or a formula indicative of correspondence relation between the output (detected temperature) of the detection unit 60 and the subtraction amount.

Figure 14A:
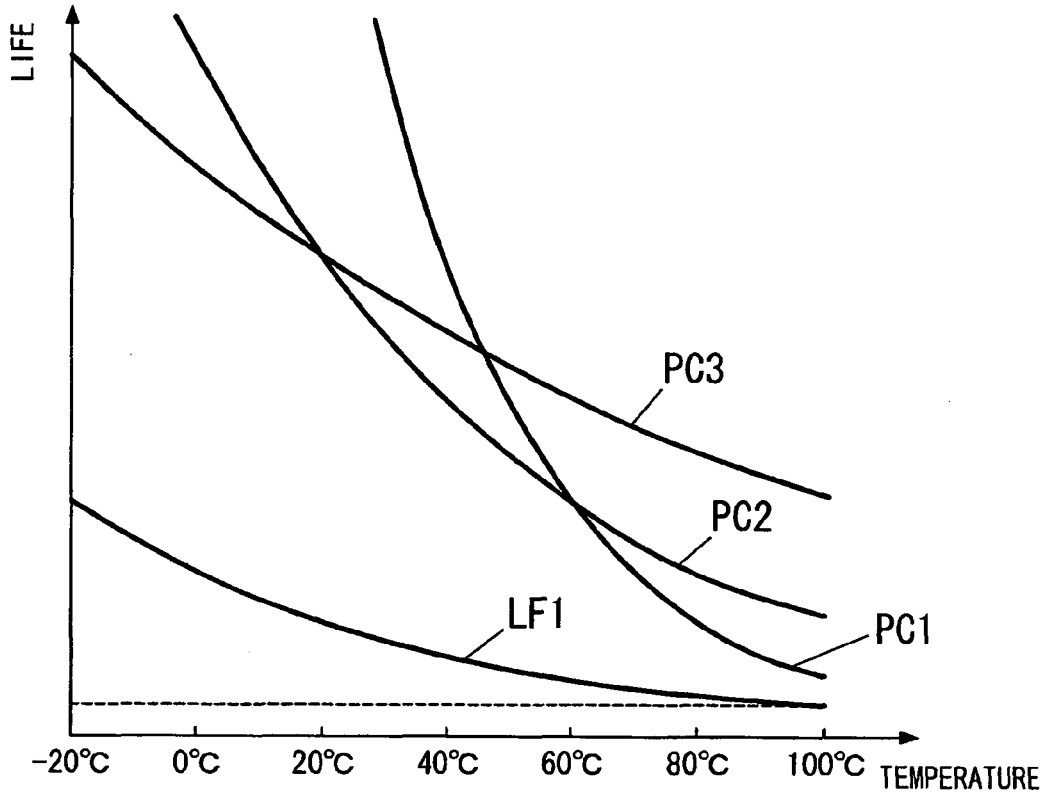
FIG. 14A is an explanatory view illustrating a graph of a life function and life curves of the lighting apparatus of a tenth embodiment.
Figure 14B:
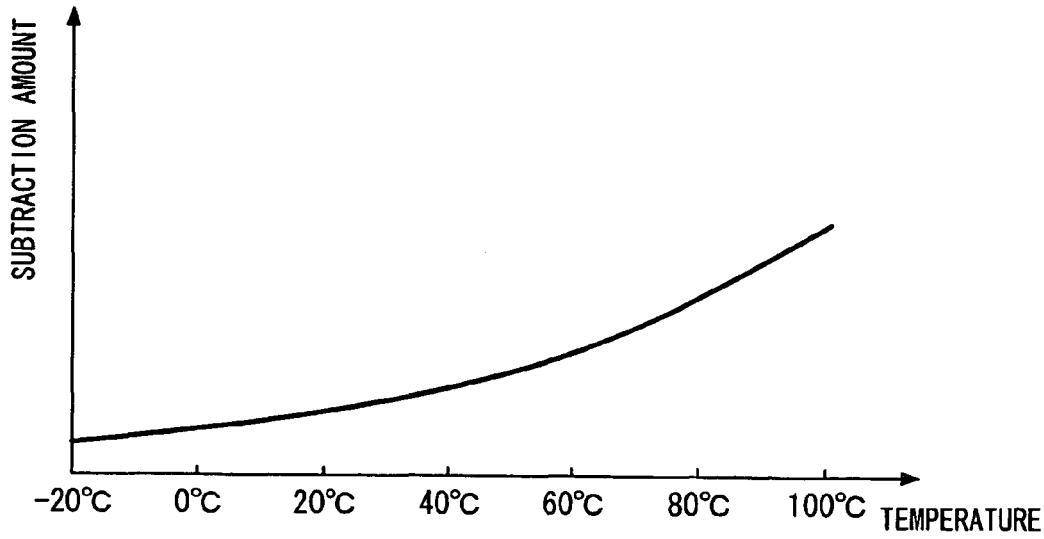
FIG. 14B is an explanatory view illustrating a relation between a subtraction amount and temperature of the lighting apparatus of the tenth embodiment.

A graph indicated by the aforementioned life function is located in a low side (short life side) relative to life curves of any component of the lighting circuit unit 2 over the entire application temperature range. When the application temperature range is a range of −20° C. to 100° C. and when the life curves of three parts having a short life relative to other parts of the lighting circuit unit 2 are respectively given by curves PC1 to PC3, shown in FIG. 14A, the life function is selected to give a curve LF1 shown in FIG. 14A. The life function of FIG. 14A is defined as an exponential function represented by a relation of $A\exp(-\ln 2*T/B)$ by use of a temperature T and coefficients A and B (B>10). That is, in any case when two points of which temperature T difference is 10° C. are selected arbitrarily, a proportion of less than 2 is satisfied for the value corresponding to a low side point of the selected two points relative to the value corresponding to a high side point of the selected two points. As shown in FIG. 14B, the subtraction amount determined by the above life function monotonically increases as the temperature increases.

As seen from the above, the life function is defined to give a value which is short relative to any life times of three components respectively corresponding to the life curves PC1 to PC2 of the components of the lighting circuit unit 2 in the whole application temperature range. Therefore, in contrast to a situation where the value given by the life function exceeds any one of life times of the aforementioned three components of the lighting circuit unit 2 at a temperature of the application temperature range, the lighting apparatus can judge the end of life prior to occurrence of a malfunction caused by a aged deterioration of the components.

Figure 15:
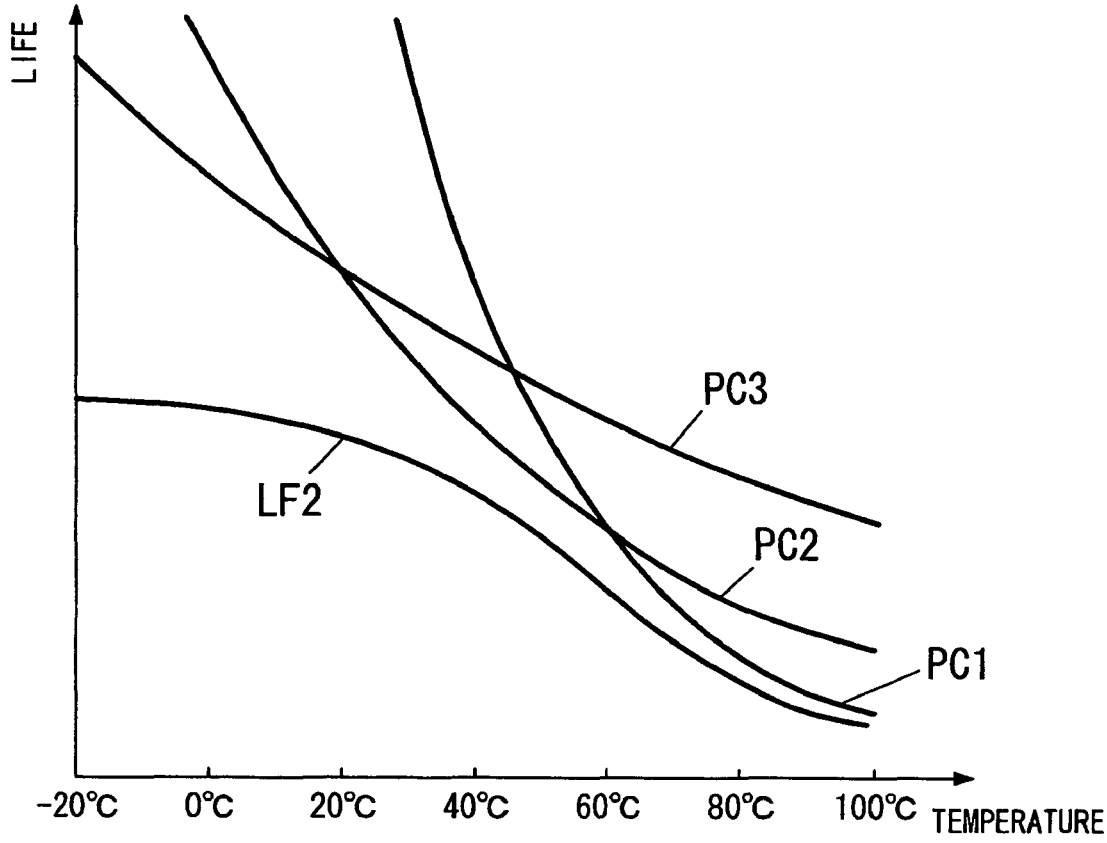
FIG. 15 is an explanatory view illustrating the graph of the life function and the life curves of a first modification of the lighting apparatus of the tenth embodiment.

Besides, the life function is not limited to the exponential function shown in FIG. 14A. The life function may be a function indicative of a curve having its part convex upward, as shown in a curve LF2 of FIG. 15.

Figure 16A:
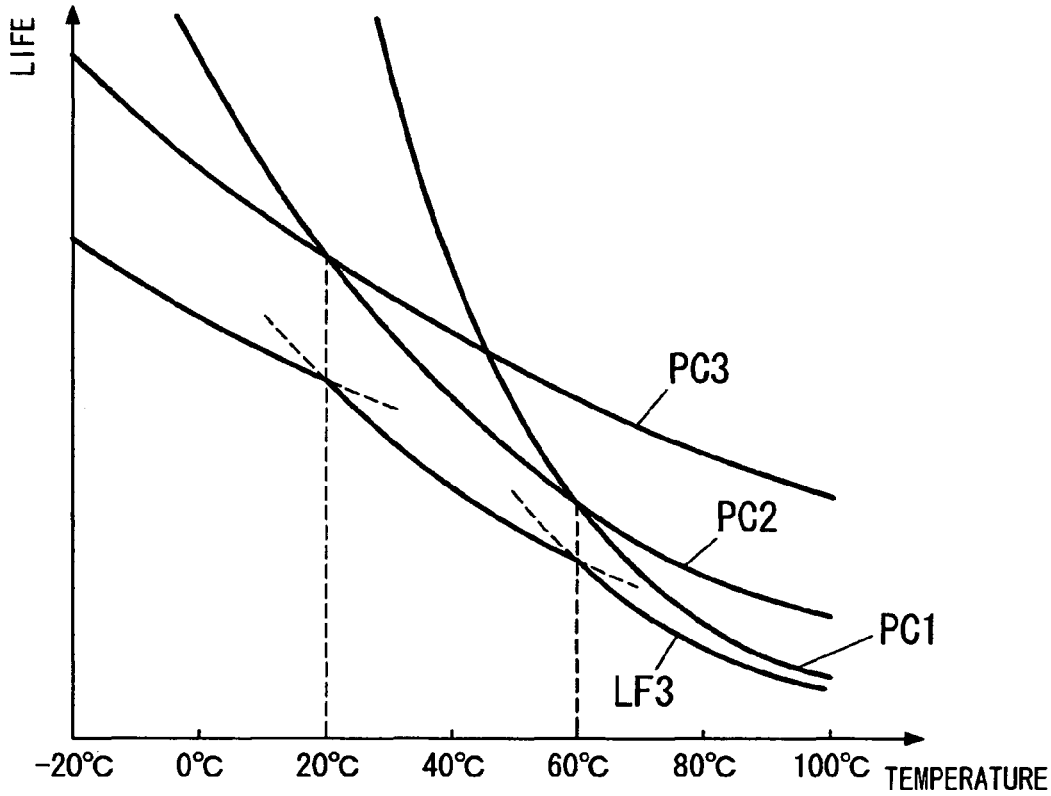
FIG. 16A is an explanatory view illustrating the graph of the life function and life curves of a second modification of the lighting apparatus of the tenth embodiment.
Figure 16B:
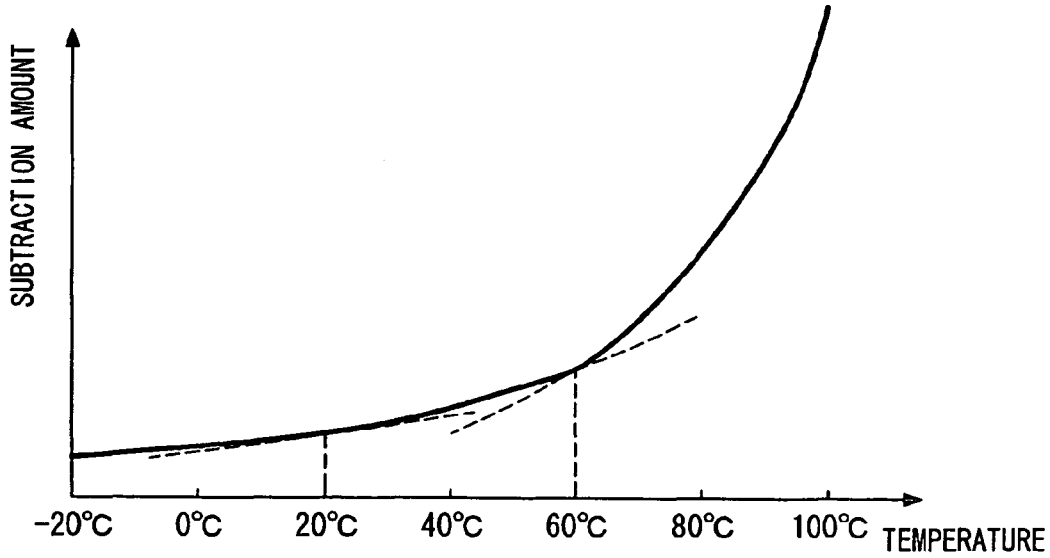
FIG. 16B is an explanatory view illustrating the relation between the subtraction amount and temperature of the second modification of the lighting apparatus of the tenth embodiment.

Alternatively, as indicated by a curve LF3 in FIG. 16A, the life function may include a plurality of exponential functions having temperature range and coefficients different from each other. In details, life curves PC1 to PC3 of the three components shown in FIG. 16A are each defined as an exponential function represented by a formula of L=Aexp(−ln 2*T/B) wherein L is the life, T is the temperature, and A, B are coefficients. The respective components have the different coefficients A and B. In a range where the temperature T falls below 20° C. of the application temperature range, the life curve PC3 having the greatest coefficient B of 80(° C.) (i.e., in conformity with an 80° C. half rule) is in the lower side (short life side) relative to the other curves. Further, in a range where the temperature T falls between 20° C. and 60° C. in the application temperature range, the life curve PC2 having the second greatest coefficient B of 40(° C.) (i.e., in conformity with a 40° C. half rule) is in the lower side (short life side) relative to the other curves. Moreover, in a range where the temperature T is not less than 60° C. in the application temperature range, the life curve PC1 having the smallest coefficient B of 20(° C.) (i.e., in conformity with a 20° C. half rule) is in the lower side (short life side) relative to the other curves. The life function (designated by the curve LF3 in FIG. 16A) includes different functions (exponential functions having the different coefficients A and the coefficients B) respectively corresponding to the three temperature ranges of −20° C. to 20° C., 20° C. to 60° C., and 60° C. to 100° C. In the respective temperature ranges, the coefficient B of the life function is identical to the coefficient B of the life curve in the lower side relative to the other curves, and the coefficient A of the life function is less than the coefficient A of the life curve in the lower side relative to the other curves. Concerning the life function, the coefficients A of each of the temperature-ranges are determined such that the partial life functions adjacent to each other in the temperature range are continuously connected to each other. As shown in FIG. 16B, the subtraction amount corresponding to the above life function are also represented by a combination of three exponential function. Alternatively, the life function may include partial life functions having the coefficients A and B respectively identical to the coefficients A and B of the lowest one of the life curves PC1 to PC3 and translated toward lower side (short life side), in the respective temperature ranges. When the life function is defined as a combination of plural exponential functions, in contrast to a situation where the life function is defined as a single exponential function, it is possible to approximate the curve determined by the life function to the life curve of the component having the shortest life in the respective temperature ranges.

Figure 17A:
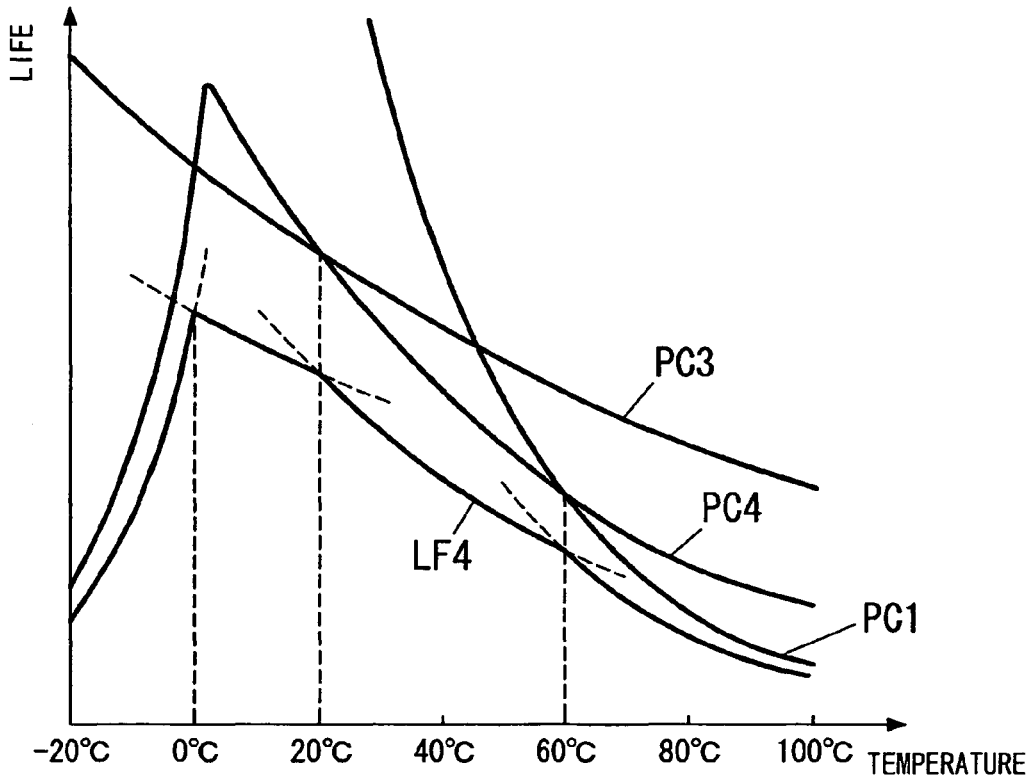
FIG. 17A is an explanatory view illustrating the graph of the life function and life curves of a third modification of the lighting apparatus of the tenth embodiment.
Figure 17B:
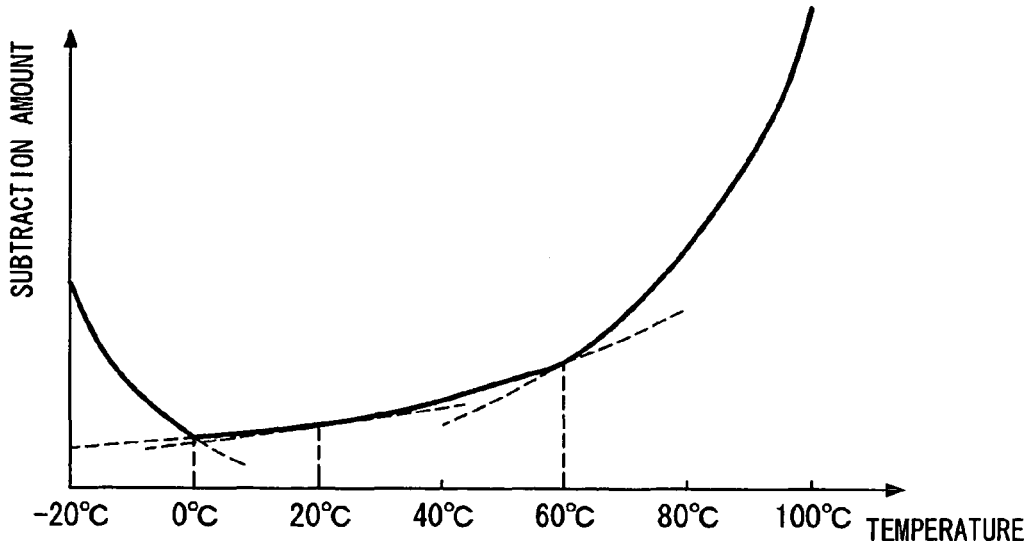
FIG. 17B is an explanatory view illustrating the relation between the subtraction amount and temperature of the third modification of the lighting apparatus of the tenth embodiment.

Moreover, as shown in the above instance, the life function is not limited to a monotonically decreasing function having a negative correlation with temperature of the whole application temperature range. For example, as indicated by a life curve PC4 in FIG. 17A, in a situation where the lighting circuit unit 2 includes a component in which an aged deterioration is promoted as temperature decreases in a low temperature range (−20° C. to 0° C.), the life function may have a positive correlation with temperature in the low temperature range as indicated by a curve LF4 in FIG. 17A in conformity with the above. In this situation, the subtraction amount has a negative correlation with temperature in the low temperature range as shown in FIG. 17B.

Figure 18:
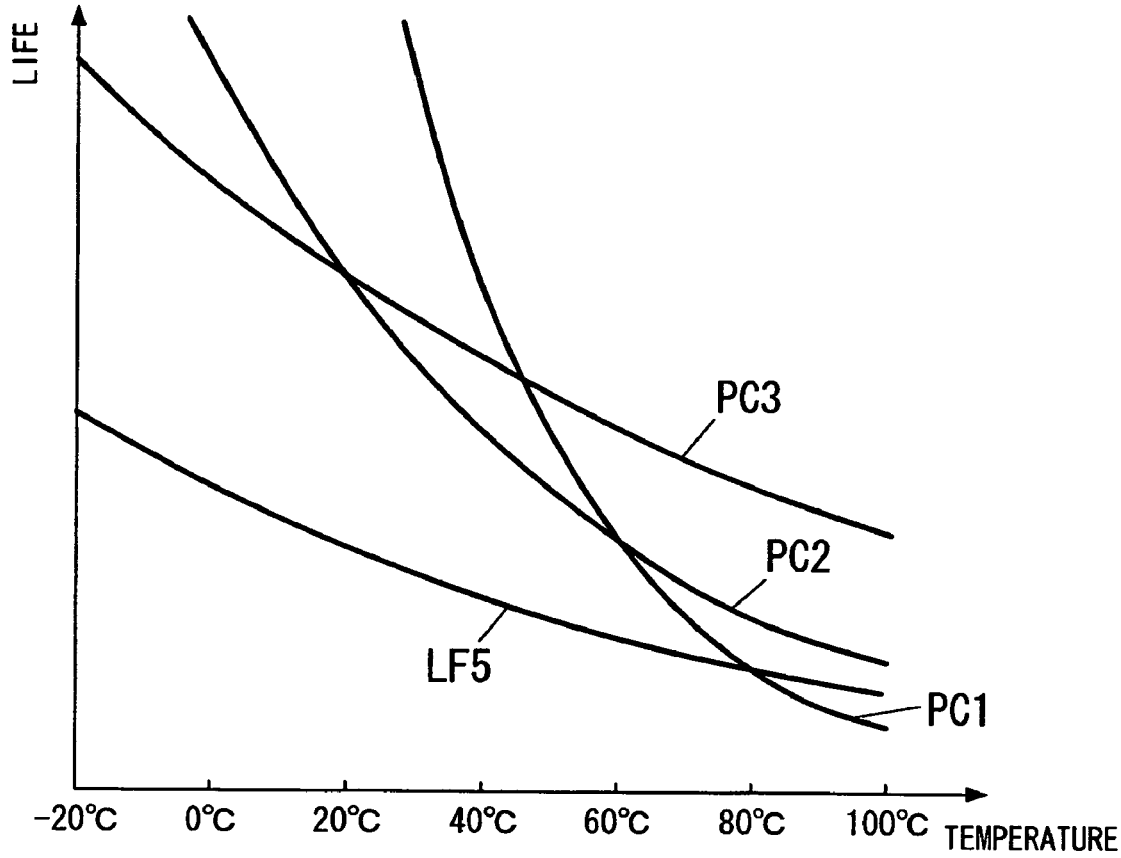
FIG. 18 is an explanatory view illustrating the graph of the life function and the life curves of a fourth modification of the lighting apparatus of the tenth embodiment.

The curve defined by the life function need not be under the life curves of all the components of the lighting circuit unit 2. For example, when the additional life judging means configured to judge the end of life of the component corresponding to the life curve PC1 is provided, the life function may be determined, without considering the life curve PC1, such that a graph defined thereby has a part being in an upper side (long life side) relative to the life curve PC1 as indicated by a curve LF5 in FIG. 18. For example, a conventional circuit configured to judge the end of life of the output capacitor C1 on the basis of magnitude of a ripple of an output of the DC source circuit 21 can be adopted as the additional life judging means.

Figure 19:
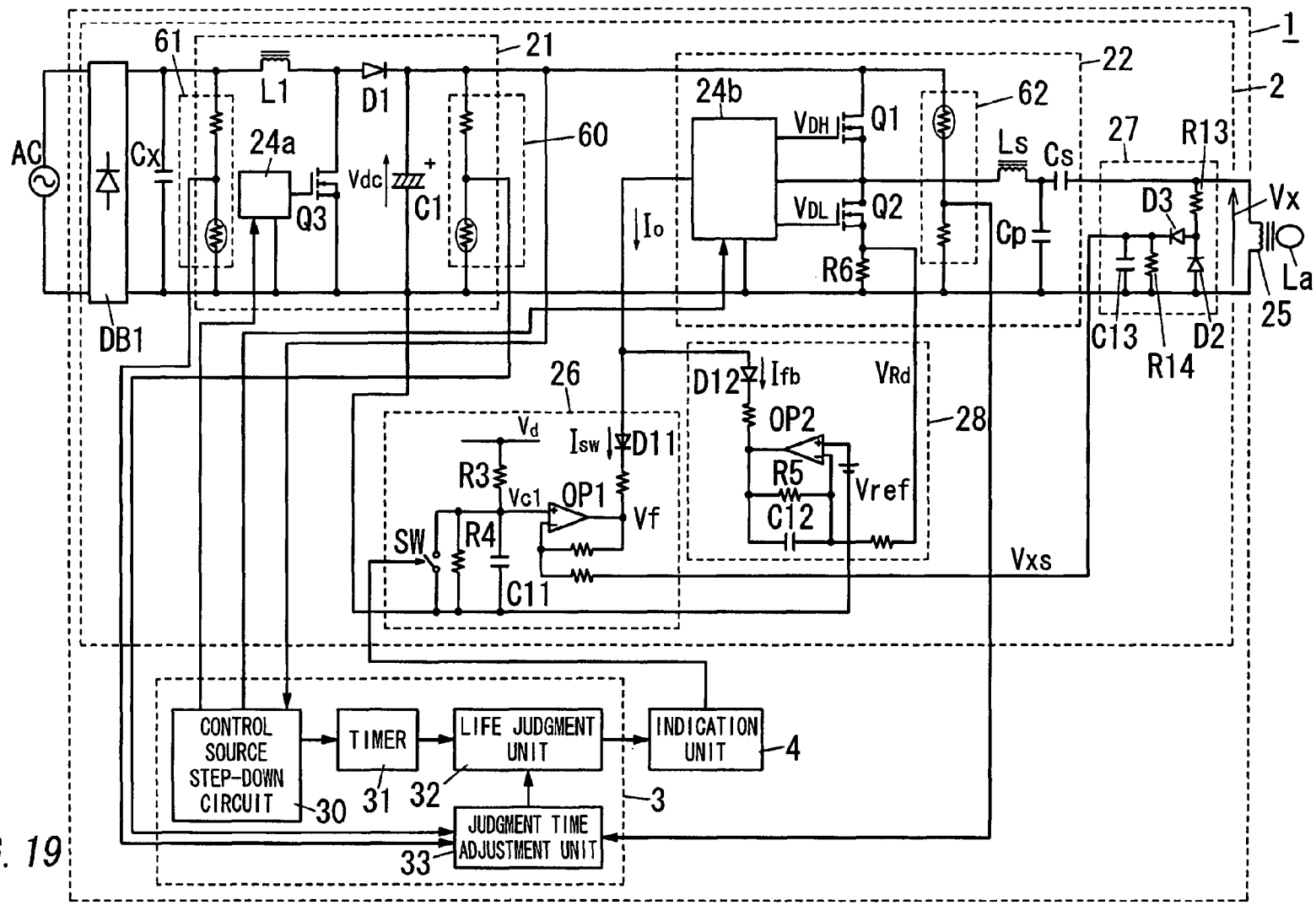
FIG. 19 is a circuit diagram of a tenth modification of the lighting apparatus of the tenth embodiment.

In addition, as shown in FIG. 19, the lighting apparatuses 1 of the present embodiment and the ninth embodiment may include a plurality (three, in the illustrated instance) of the detection units 60, 61, and 62. The detection units 60, 61, and 62 are configured to measure temperatures of vicinities of the different components, respectively.

In the instance of FIG. 19, an across-the-line capacitor Cx is connected across the output terminals of the diode bridge DB1 of the DC source circuit 21. The detection unit 61 is configured to measure the temperature of the vicinity of the across-the-line capacitor Cx, and the detection unit 62 is configured to measure the temperature of the vicinity of the inductor Ls of the inverter circuit 22.

With this arrangement, the lighting apparatus 1 may be configured such that the life judgment unit 32 judges the end of life of the components of the lighting circuit unit 2 corresponding to the detection units 60, 61, and 62, respectively. In addition, the judgment time adjustment unit 33 may vary the judgment times T1 and T2 by use of an average value of the detected temperatures of the detection units 60, 61, and 62. Besides, the lighting apparatus 1 may include any one of the detection units 60, 61, and 62.

Alternately, the detection unit 60 may be configured to measure a temperature of environment where the lighting apparatus 1 is installed. In this situation, the detection unit 60 is placed sufficiently away from the respective components of the lighting circuit unit 2. With this arrangement, in contrast to a situation where the detection unit 60 is placed adjacent to a specific component, the temperature detected by the detection unit 60 has positive correlations with temperatures of the other components as much as possible.

Eleventh Embodiment

The lighting apparatus 1 of the present embodiment is different in the operation of the judgment time adjustment unit 33 from the lighting apparatus 1 of the tenth embodiment. Besides, the components common to the present embodiment and the ninth embodiment are designated by the same reference numeral and no explanation thereof is deemed necessary.

The judgment time adjustment unit 33 of the present embodiment is configured to vary the judgment times T1 and T2 according to the detection value of the detection unit 60 in a similar manner as the judgment time adjustment unit 33 of the tenth embodiment. In addition, the judgment time adjustment unit 33 of the present embodiment is configured to vary within a third variation width the judgment time T1 which was varied depending on the detection value, and to vary within a fourth variation width the judgment time T2 which was varied depending on the detection value. Herein, the third variation width is narrower than the first variation width, and the fourth variation width is narrower than the second variation width. However, the third variation width need not be narrower than the first variation width, and the fourth variation width need not be narrower than the second variation width. In other words, the third variation width and the fourth variation width may be selected not to give a bad influence to the judgment of the end of life of the lighting circuit unit 2.

According to the lighting apparatus 1 of the present embodiment, it is possible to improve accuracy of judging the end of life, and further to enable to randomly vary the judgment times T1 and T2 for each lighting apparatus.

The judgment time adjustment unit 33 may be configured to vary the judgment times T1 and T2 depending on the detection value of the detection unit 60 in a similar manner as the judgment time adjustment unit 33 of the ninth embodiment, and subsequently vary randomly the judgment times T1 and T2.

Twelfth Embodiment

Figure 20:
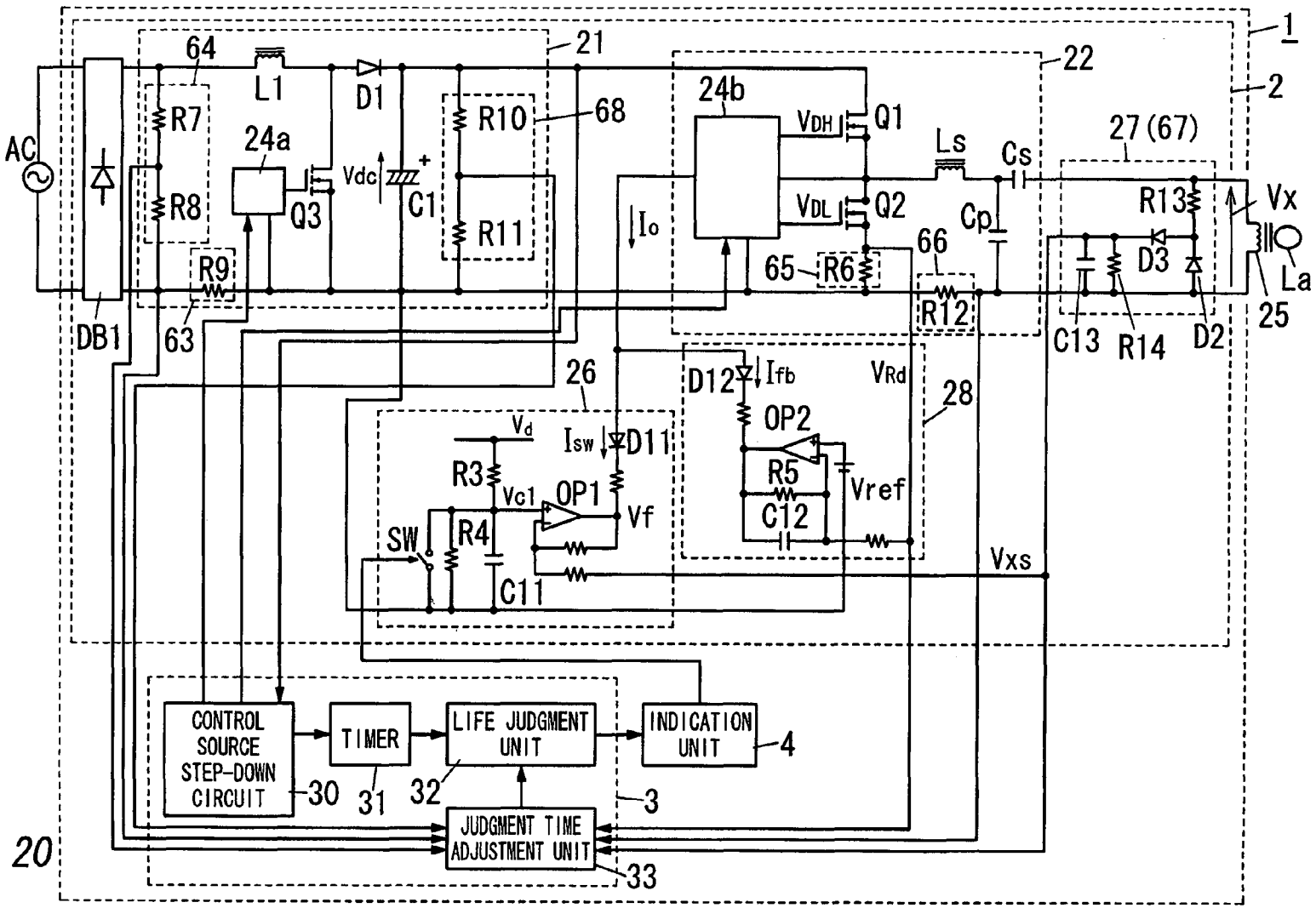
FIG. 20 is a circuit diagram of the lighting apparatus of a twelfth embodiment.

The lighting apparatus 1 of the present embodiment is different in the operation of the judgment time adjustment unit 33 from the lighting apparatus 1 of the tenth embodiment. In addition, as shown in FIG. 20, the lighting apparatus 1 of the present embodiment includes, instead of the detection unit configured to detect the temperature of the lighting circuit unit 2, the detection units 64, 67, and 68 configured to detect voltages applied to the lighting circuit unit 2, and the detection units 63, 65, and 66 configured to detect currents flowing through the lighting circuit unit 2. Besides, the components common to the present embodiment and the tenth embodiment are designated by the same reference numeral and no explanation thereof is deemed necessary.

The detection unit 63 is configured to detect an input current of the lighting circuit unit 2. The detection unit 63 is a resistor R9 interposed between the switching element Q3 and the low voltage side output terminal of the diode bridge 63.

The detection unit 64 is configured to detect an input voltage of the lighting circuit unit 2. The detection unit 63 is a series circuit of resistors R7 and R8 interposed between the output terminals of the diode bridge 63.

Each of the detection units 65 and 66 is configured to detect an output current of the lighting circuit unit 2. The detection unit 65 is the resistor R6 interposed between the switching element Q2 and the low voltage side output terminal of the diode bridge 63. The detection unit 66 is a resistor R12 interposed between the parallel capacitor CP and the low voltage side output terminal of the diode bridge 63.

The detection unit 69 is configured to detect a voltage across the output capacitor C0. The detection unit 68 is a series circuit of resistors R10 and R11 connected parallel to the output capacitor C0.

In the lighting apparatus 1 of the present embodiment, the voltage detection circuit 27 defines the detection unit 67 configured to measure the output voltage of the lighting circuit unit 2.

The judgment time adjustment unit 33 of the present embodiment is configured to vary respectively the first judgment time T1 and the second judgment time T2 corresponding to the detection values (detected currents) received from the detection units 63, 65, and 66, and the detection values (detected voltages) received from the detection units 64, 67, and 68.

The judgment time adjustment unit 33 is configured to compare the detection values obtained from the detection units 63, 65, and 66 with a predetermined reference value (reference current). The deterioration of the lighting circuit unit 2 is promoted as the current increases. Therefore, the judgment time adjustment unit 33 increases the judgment times T1 and T2 as the detection value decreases relative to the reference value (the current decreases). The judgment time adjustment unit 33 decreases the judgment times T1 and T2 as the detection value increases relative to the reference value (the current increases).

For example, the judgment time adjustment unit 33 does not vary the judgment times T1 and T2 when the detected current is equivalent to the reference value (reference current). The judgment time adjustment unit 33 increases the judgment times T1 and T2 by one unit time (e.g. 1 minute, 5 minutes, and 1 hour) when the detected current is lowered by 1[A] than the reference current. The judgment time adjustment unit 33 increases the judgment times T1 and T2 by two unit times when the detected current is lowered by 2[A] than the reference current. By contrast, the judgment time adjustment unit 33 decreases the judgment times T1 and T2 by one unit time when the detected current is increased by 1[A] than the reference current. The judgment time adjustment unit 33 decreases the judgment times T1 and T2 by two unit times when the detected current is increased by 2[A] than the reference current. Besides, the unit times of the judgment times T1 and T2 may be different from each other.

Besides, the judgment time adjustment unit 33 is configured to compare the detection values obtained from the detection units 64, 67, and 68 with a predetermined reference value (reference voltage). The deterioration of the lighting circuit unit 2 is accelerated as the voltage increases. Therefore, the judgment time adjustment unit 33 increases the judgment times T1 and T2 as the detection value decreases relative to the reference value (the voltage decreases). The judgment time adjustment unit 33 decreases the judgment times T1 and T2 as the detection value increases relative to the reference value (the voltage increases).

For example, the judgment time adjustment unit 33 does not vary the judgment times T1 and T2 when the detected voltage is equivalent to the reference value (reference voltage). The judgment time adjustment unit 33 increases the judgment times T1 and T2 by one unit time (e.g. 1 minute, 5 minutes, and 1 hour) when the detected voltage is lowered by 1[V] than the reference voltage. The judgment time adjustment unit 33 increases the judgment times T1 and T2 by two unit times when the detected voltage is lowered by 2[V] than the reference voltage. By contrast, the judgment time adjustment unit 33 decreases the judgment times T1 and T2 by one unit time when the detected voltage is increased by 1 [V] than the reference voltage. The judgment time adjustment unit 33 decreases the judgment times T1 and T2 by two unit times when the detected voltage is increased by 2[V] than the reference voltage.

According to the lighting apparatus 1 of the present embodiment, it takes a shorter time to judge the end of life as the deterioration of the circuit components forming the lighting circuit 2 is promoted depending on the individual difference of the components and the environment (magnitudes of voltage and current). Therefore, the lighting circuit 2 enables to randomly vary the time at which the indication unit 4 of the lighting apparatuses 1 starts to perform the indication operation.

The judgment time adjustment unit 33 may adjust the judgment times T1 and T2 one or more times. For example, when an operating condition of the lighting circuit unit 2 is changed (e.g. the voltage or current is changed due to replacement of the light source), or when a usage environment is changed (e.g. an ambient temperature is varied due to devices placed adjacent to the lighting apparatus 1, and thereby the voltage or current is changed due to temperature characteristics of components of the lighting circuit unit 2), the judgment time adjustment unit 33 may vary the judgment times T1 and T2.

The judgment time adjustment unit 33 varies the first judgment time T1 within a range of T11 to T12 (first variation width). In addition, the judgment time adjustment unit 33 varies the second judgment time T2 within a range of T21 to T22 (second variation width). In other words, the distributions of the judgment times T1 and T2 have the upper limit and the lower limit.

Alternately, the judgment time adjustment unit 33 is configured to keep the judgment times T1 and T2 when the detection value is not greater than the reference value. In addition, the judgment time adjustment unit 33 may be configured to decrease the judgment times T1 and T2 as the detection value increases relative to the reference value (the current increases). With this arrangement, the judgment times T1 and T2 can be prevented from exceeding the lifetime of the lighting circuit unit 2. Therefore, it is possible to maintain safety of the lighting apparatus.

Although the lighting apparatus 1 of the present embodiment includes the six detection units 63 to 68, the lighting apparatus 1 may include at least one detection unit.

Thirteenth Embodiment

Figure 21:
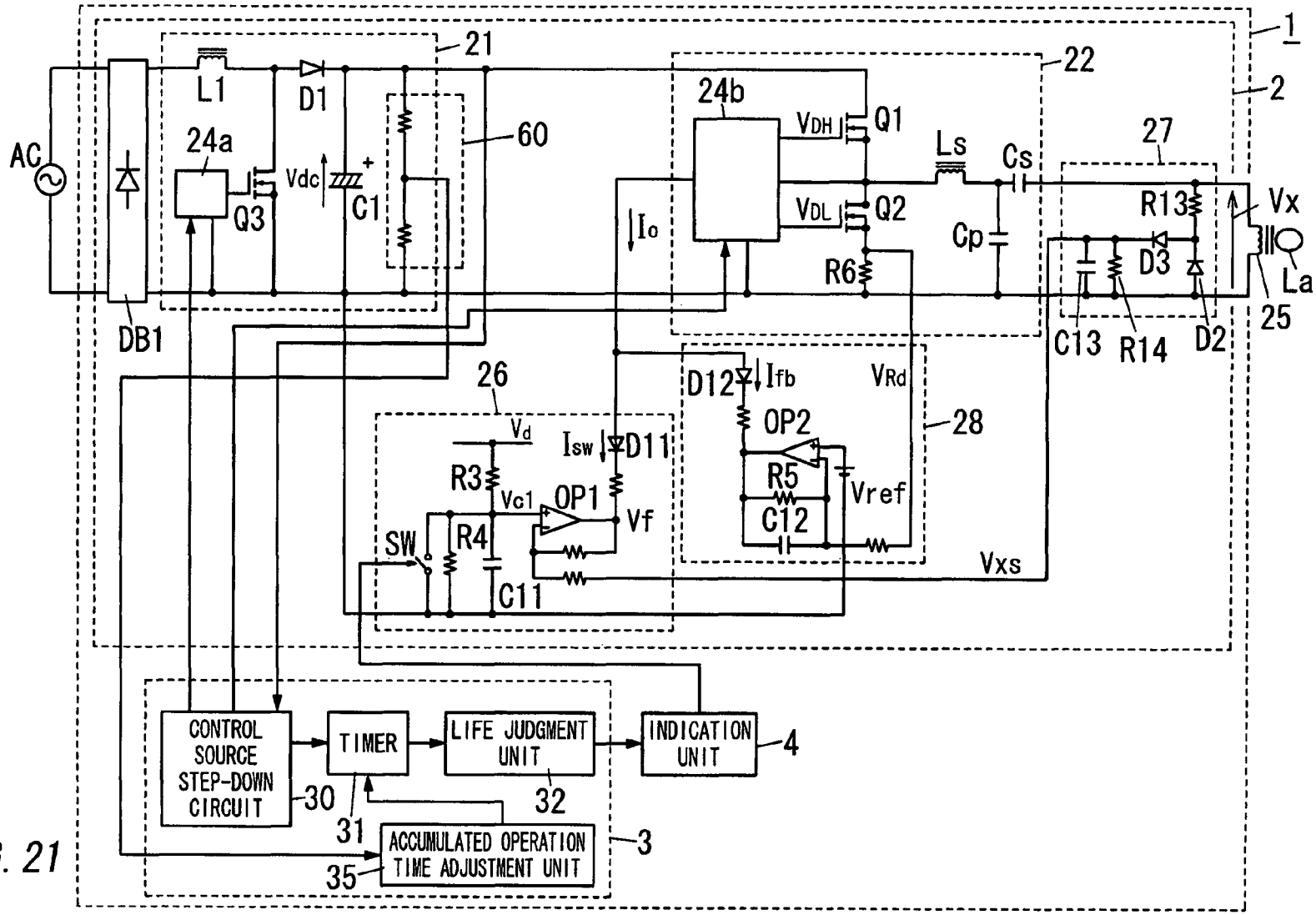
FIG. 21 is a circuit diagram of the lighting apparatus of a thirteenth embodiment.

As shown in FIG. 21, the lighting apparatus 1 of the present embodiment is different from the lighting apparatus 1 of the ninth embodiment in that the lighting apparatus 1 of the present embodiment includes an accumulated operation time adjustment unit 35 instead of the judgment time adjustment unit 33. Besides, the components common to the present embodiment and the ninth embodiment are designated by the same reference numeral and no explanation thereof is deemed necessary.

The timer 31 of the present embodiment is configured to perform a count operation of adding a numerical value (hereinafter referred to as "adding age amount") to an accumulated age amount (accumulated operation time) at intervals of a predetermined addition time (that is, periodically), thereby measuring the accumulated operation time. Herein, the adding age amount is calculated by the accumulated operation time adjustment unit 35.

Next, an explanation is made to a method of determining the adding age amount by the accumulated operation time adjustment unit 35. The accumulated operation time adjustment unit 35 preliminarily stores a life function in a ROM or the like. The life function is defined as a function of temperature, and has a negative correlation with temperature at least in a portion of a temperature range (hereinafter referred to as "application temperature range") at which the lighting circuit unit 2 is expected to operate. In the count operation, there is given a numerical value which is calculated by dividing a product of the addition time (that is, a period of the count operation) and a limit age amount (a reference lifetime of the lighting circuit unit 2) by a numerical value which is obtained by substituting the temperature detected by the detection unit 60 into the life function, and the given numerical value is added to the accumulated operation time as the adding age amount. For example, the accumulated operation time adjustment unit 35 can calculate the adding age amount by use of a data table or a formula indicative of correspondence relation between the output (detected temperature) of the detection unit 60 and the adding age amount.

Figure 22A:
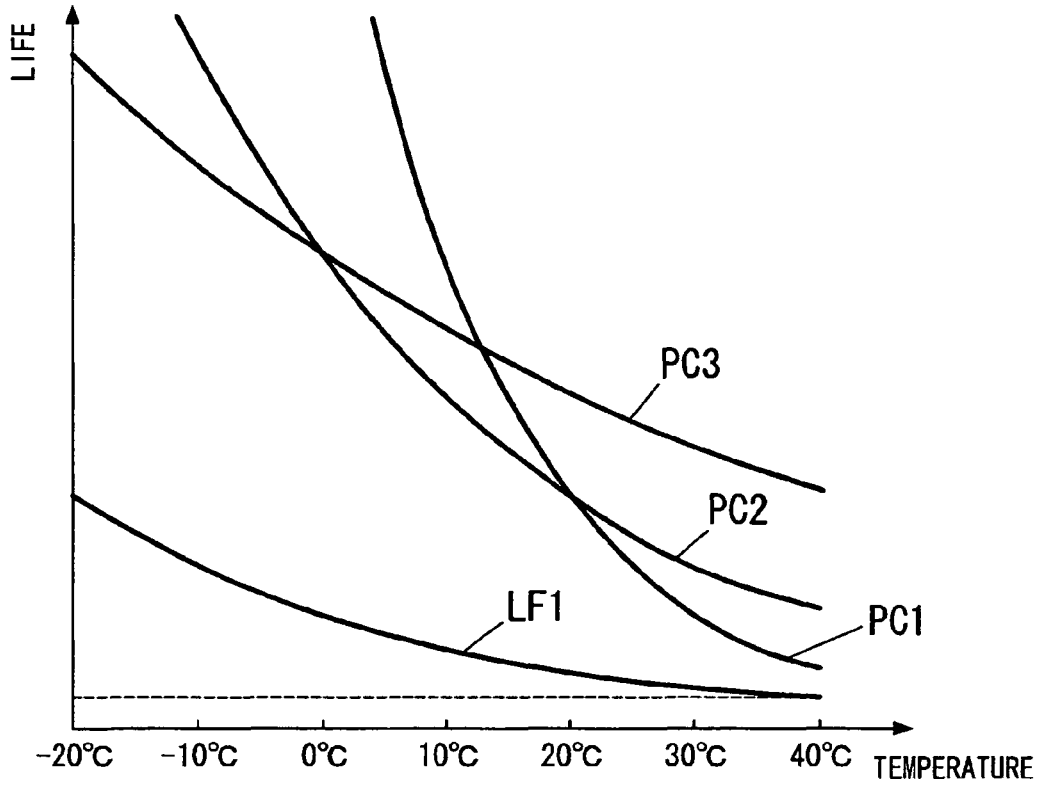
FIG. 22A is an explanatory view illustrating a graph of a life function and life curves of the lighting apparatus of the thirteenth embodiment.
Figure 22B:
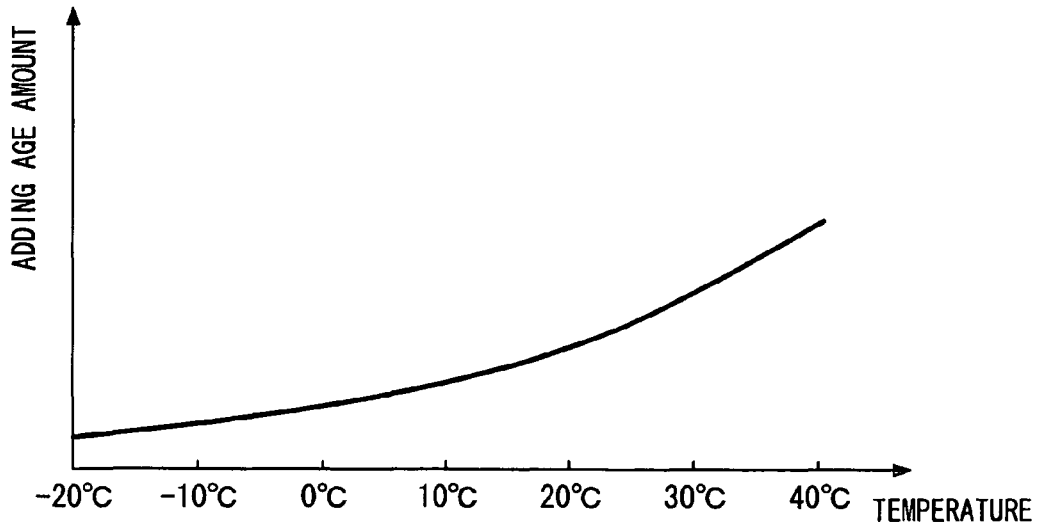
FIG. 22B is an explanatory view illustrating a relation between an adding age amount and temperature of the lighting apparatus of the thirteenth embodiment.

A graph indicated by the aforementioned life function is located in a low side (short life side) relative to life curves of any component of the lighting circuit unit 2 over the entire application temperature range. When the application temperature range is a range of −20° C. to 40° C. and when the life curves of three parts having a short life relative to other parts of the lighting circuit unit 2 are respectively given by curves PC1 to PC3, shown in FIG. 22A, the life function is selected to give a curve LF1 shown in FIG. 22A. The life function of FIG. 22A is defined as an exponential function represented by a relation of $A\exp(-\ln 2*T/B)$ by use of a temperature T and coefficients A and B (B>10). That is, in any case when two points of which temperature T difference is 10° C. are selected arbitrarily, a proportion of less than 2 is satisfied for the value corresponding to a low side point of the selected two points relative to the value corresponding to a high side point of the selected two points. As shown in FIG. 22B, the adding age amount determined by the above life function monotonically increases as the temperature increases.

The life judgment unit 32 of the present embodiment is configured to compare the accumulated operation time varied by the accumulated operation time adjustment unit 35 with the first judgment time T1 and output the first judgment signal when the accumulated operation time varied by the accumulated operation time adjustment unit 35 becomes equal to the first judgment time T1. The life judgment unit 32 is configured to compare the accumulated operation time varied by the accumulated operation time adjustment unit 35 with the second judgment time T2 and output the second judgment signal when the accumulated operation time varied by the accumulated operation time adjustment unit 35 becomes equal to the second judgment time T2.

As mentioned in the above, the lighting apparatus 1 of the present embodiment includes the detection unit 60 configured to detect a temperature of the lighting circuit unit 2 and output detection value indicative thereof. The accumulated operation time adjustment unit 35 is configured to calculate the adding age amount depending on the detection value of the detection unit 60 and provide the same to the timer 31. The timer 31 is configured to add the provided adding age amount to the accumulated operation time (previous accumulated operation time), thereby measuring the accumulated operation time (current accumulated operation time).

Thus, in the present embodiment, the accumulated operation time adjustment unit (timing adjustment unit) 35 is configured to vary the accumulated operation time according to the detection value received from the detection unit 60.

Therefore, according to the lighting apparatus 1 of the present embodiment, the indication unit 4 performs the indication operations at the plurality of levels of the end of life of the lighting circuit unit 2 before the lighting circuit unit 2 comes to the end of its life. Therefore, even if the light source is turned off at the end stage of the end of life for safety, the light source is not turned off without providing prior notice. Consequently, it is possible to avoid sudden termination of the lighting effect, causing no anxiety to people and reducing the safety which would otherwise occur. Further, a user can replace the lighting apparatus 1 before the lighting circuit unit 2 comes to the end of its life because the user can know a current level of the end of life. In addition, the accumulated operation time adjustment unit 35 varies the accumulated operation time. Therefore, even if the plurality of the lighting apparatuses 1 is installed, the plurality of the lighting apparatuses 1 does not perform the indication operation simultaneously. For example, even if the plurality of the lighting apparatuses 1 performs the indication operation with reducing the light flux, the plurality of the lighting apparatuses 1 does not reduce the light flux simultaneously. Therefore, the lighting apparatus 1 will not cause anxiety to people thereabout and will not reduce its safety. Further, it is possible to prevent the people from making false recognition that the light flux is lowered due to the power failure.

Figure 23:
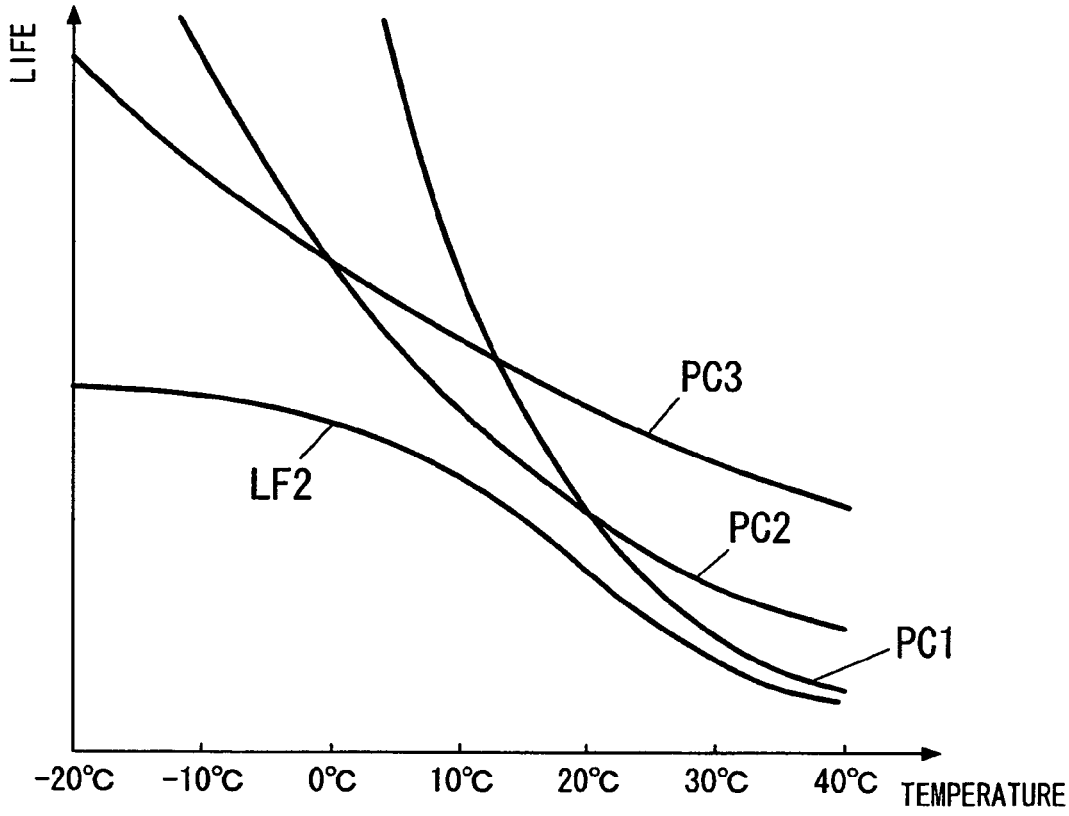
FIG. 23 is an explanatory view illustrating the graph of the life function and the life curves of a first modification of the lighting apparatus of the thirteenth embodiment.

Besides, the life function is not limited to the exponential function shown in FIG. 22A. The life function may be a function indicative of a curve having its part convex upward, as shown in a curve LF2 of FIG. 23.

Figure 24A:
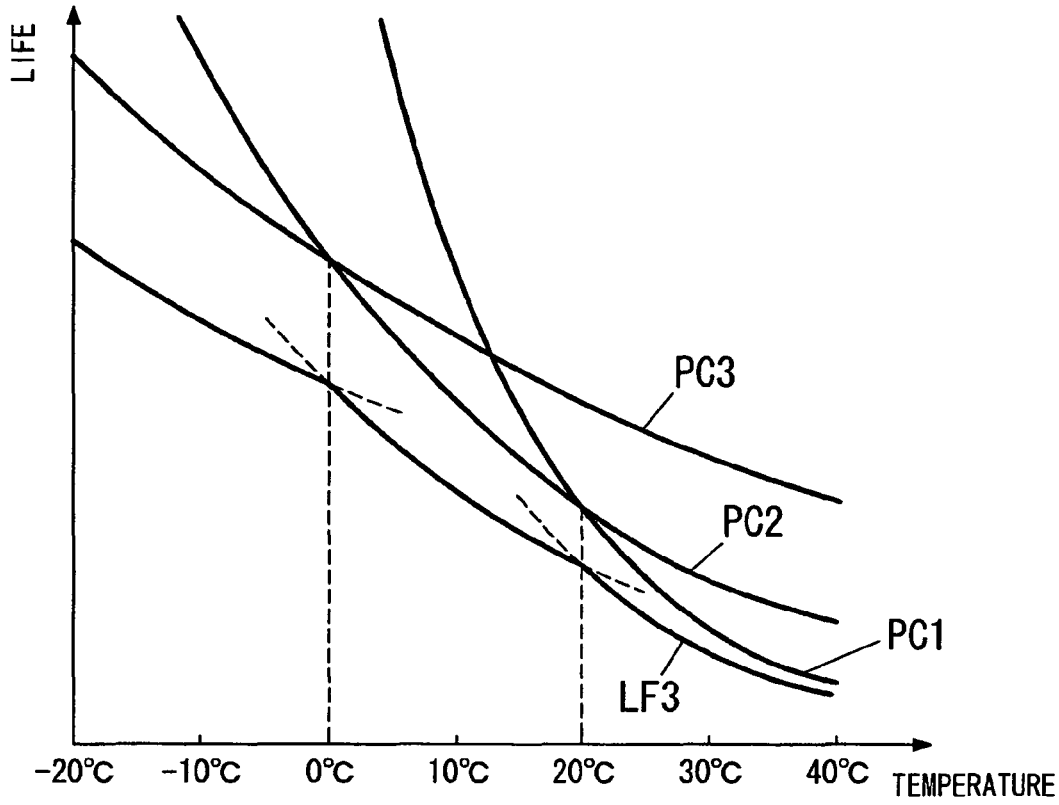
FIG. 24A is an explanatory view illustrating the graph of the life function and life curves of a second modification of the lighting apparatus of the thirteenth embodiment.
Figure 24B:
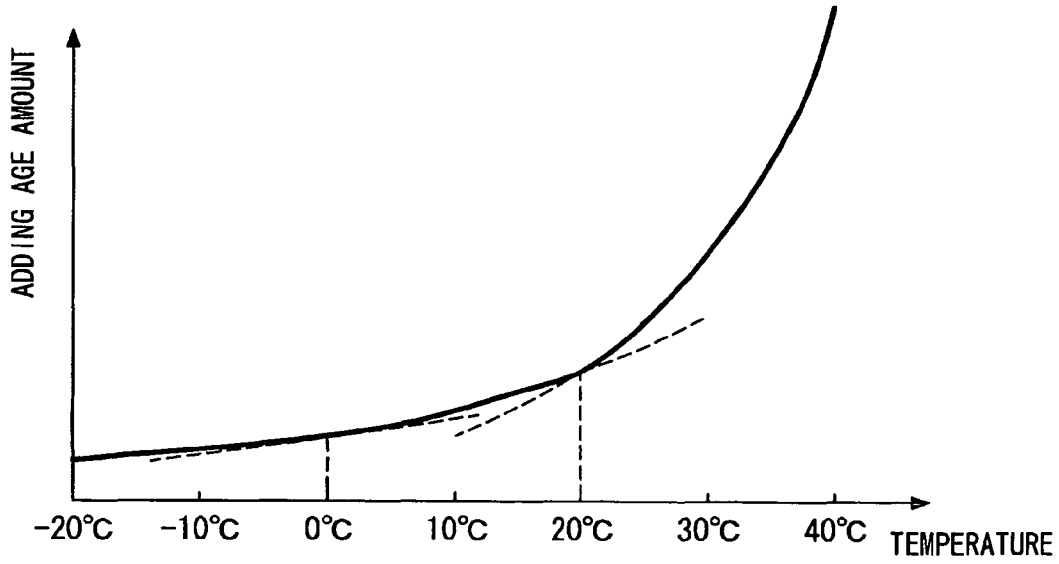
FIG. 24B is an explanatory view illustrating the relation between the adding age amount and temperature of the second modification of the lighting apparatus of the thirteenth embodiment.

Alternatively, as indicated by a curve LF3 in FIG. 24A, the life function may include a plurality of exponential functions having temperature range and coefficients different from each other. In details, life curves PC1 to PC3 of the three components shown in FIG. 24A are each defined as an exponential function represented by a formula of L=Aexp(−ln 2*T/B) wherein L is the life, T is the temperature, and A, B are coefficients. The respective components have the different coefficients A and B. In a range where the temperature T falls below 0° C. of the application temperature range, the life curve PC3 having the greatest coefficient B of 40(° C.) (i.e., in conformity with an 40° C. half rule) is in the lower side (short life side) relative to the other curves. Further, in a range where the temperature T falls between 0° C. and 20° C. in the application temperature range, the life curve PC2 having the second greatest coefficient B of 20(° C.) (i.e., in conformity with a 20° C. half rule) is in the lower side (short life side) relative to the other curves. Moreover, in a range where the temperature T is not less than 20° C. in the application temperature range, the life curve PC1 having the smallest coefficient B of 10(° C.) (i.e., in conformity with a 10° C. half rule) is in the lower side (short life side) relative to the other curves. The life function (designated by the curve LF3 in FIG. 24A) includes different functions (exponential functions having the different coefficients A and the coefficients B) respectively corresponding to the three temperature ranges of −20° C. to 0° C., 0° C. to 20° C., and 20° C. to 40° C. In the respective temperature ranges, the coefficient B of the life function is identical to the coefficient B of the life curve in the lower side relative to the other curves, and the coefficient A of the life function is less than the coefficient A of the life curve in the lower side relative to the other curves. Concerning the life function, the coefficients A of each of the temperature-ranges are determined such that the partial life functions adjacent to each other in the temperature range are continuously connected to each other. As shown in FIG. 24B, the adding age amount corresponding to the above life function are also represented by a combination of three exponential function. Alternatively, the life function may include partial life functions having the coefficients A and B respectively identical to the coefficients A and B of the lowest one of the life curves PC1 to PC3 and translated toward lower side (short life side), in the respective temperature ranges. When the life function is defined as a combination of plural exponential functions, in contrast to a situation where the life function is defined as a single exponential function, it is possible to approximate the curve determined by the life function to the life curve of the component having the shortest life in the respective temperature ranges.

Figure 25A:
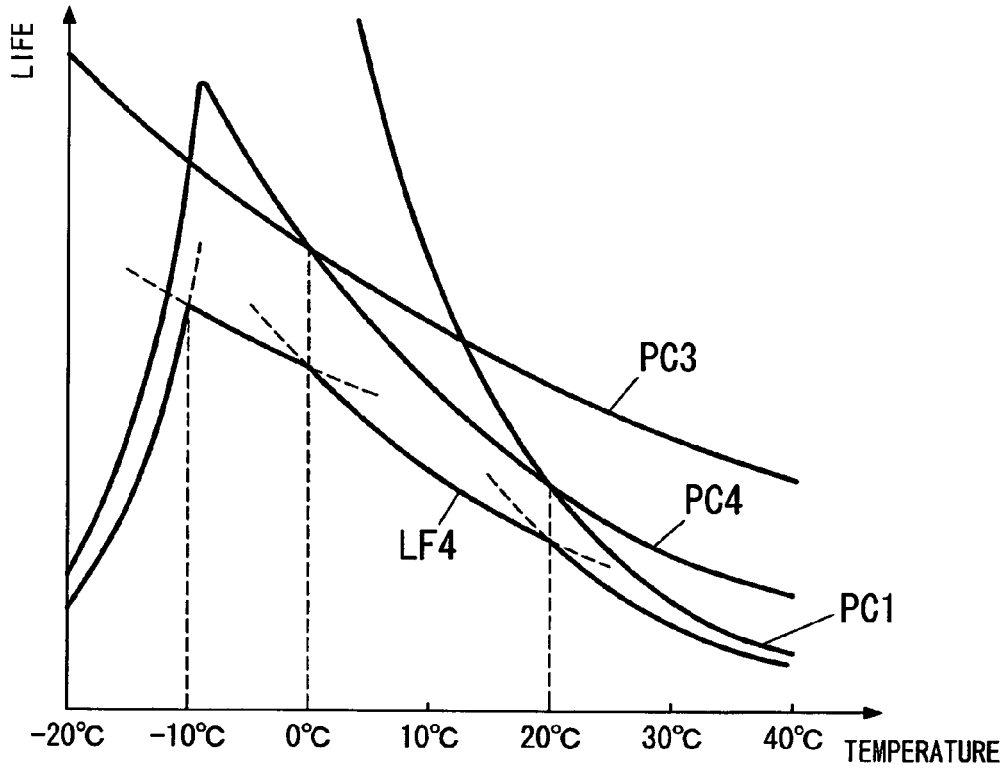
FIG. 25A is an explanatory view illustrating the graph of the life function and life curves of a third modification of the lighting apparatus of the thirteenth embodiment.
Figure 25B:
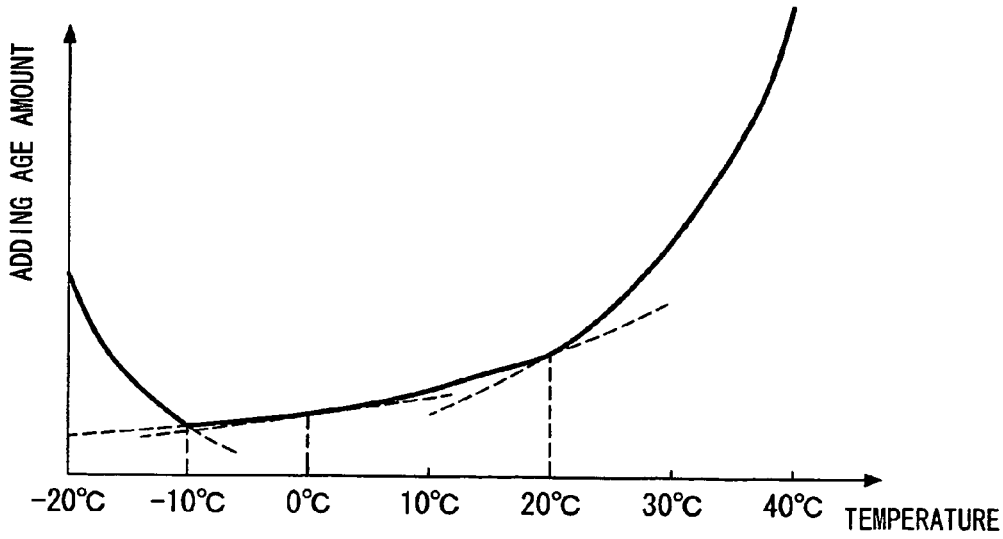
FIG. 25B is an explanatory view illustrating the relation between the adding age amount and temperature of the third modification of the lighting apparatus of the thirteenth embodiment.

Moreover, the life function is not limited to a monotonically decreasing function having a negative correlation with temperature of the whole application temperature range, as shown in the above instance. For example, in a situation where the lighting circuit unit 2 includes a component in which an aged deterioration is accelerated as temperature decreases in a low temperature range (−20° C. to −10° C.) as indicated by a life curve PC4 in FIG. 25A, in view of the above, the life function may have a positive correlation with temperature in the low temperature range as indicated by a curve LF4 in FIG. 25A. In this situation, the adding age amount has a negative correlation with temperature in the low temperature range as shown in FIG. 25B.

Figure 26:
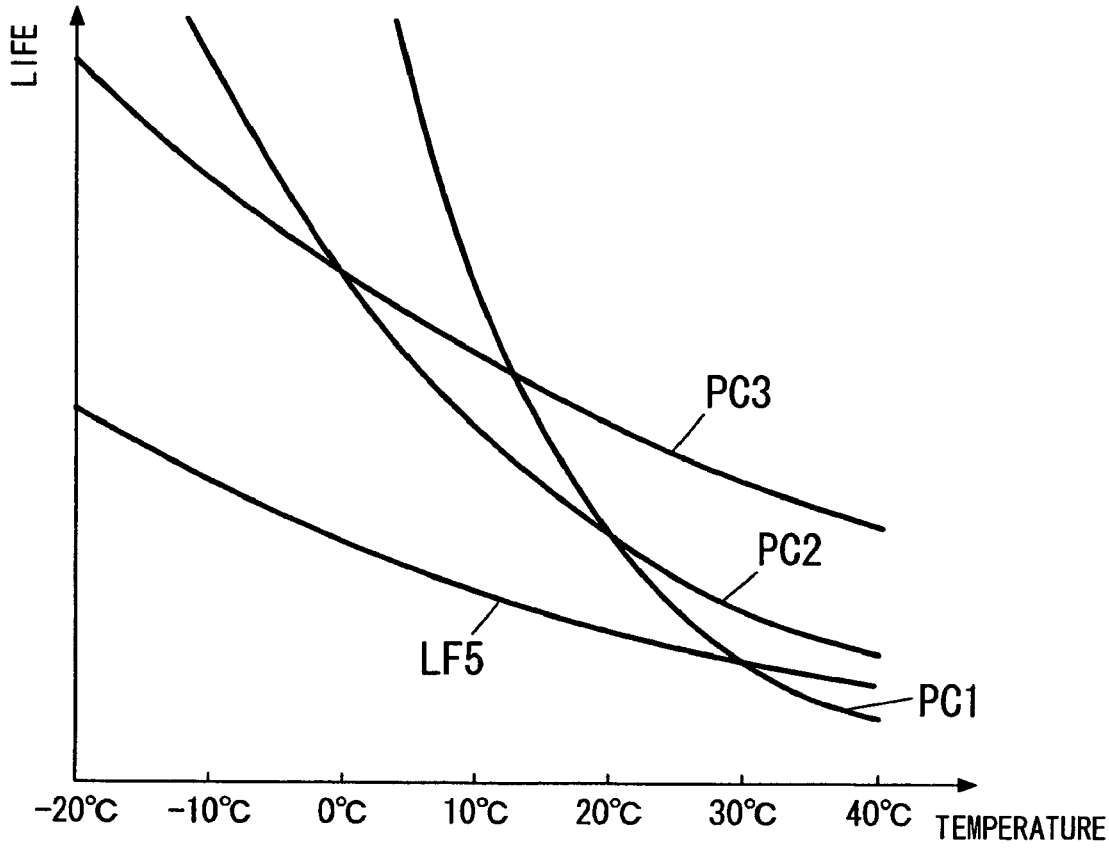
FIG. 26 is an explanatory view illustrating the graph of the life function and the life curves of a fourth modification of the lighting apparatus of the thirteenth embodiment.

The curve defined by the life function need not be under the life curves of all the components of the lighting circuit unit 2. For example, when the additional life judging means configured to judge the end of life of the component corresponding to the life curve PC1 is provided, the life function may be determined, without considering the life curve PC1, such that a graph defined thereby has a part being in an upper side (long life side) relative to the life curve PC1 as indicated by a curve LF5 in FIG. 26. For example, a conventional circuit configured to judge the end of life of the output capacitor C1 on the basis of magnitude of a ripple of an output of the DC source circuit 21 can be adopted as the additional life judging means.

In a similar manner as the tenth embodiment, the lighting apparatus 1 of the present embodiment also may include the three detection units 60 to 62 (see FIG. 19). With this arrangement, the accumulated operation time adjustment unit 35 is configured to vary the accumulated operation time on the basis of the respective detection values of the three detection units 60 to 62.

Fourteenth Embodiment

In the present embodiment, with reference to drawings, an explanation is made to a lighting fixture including the lighting apparatus 1 explained in any one of the second to thirteenth embodiments.

The lighting fixture of the present embodiment includes the discharge lamp La being an electrodeless discharge lamp, and the lighting apparatus 1 including a coupler 42. The coupler 42 is configured to hold the induction coil 25. The discharge lamp La is attached to the coupler 42.

Figure 27:
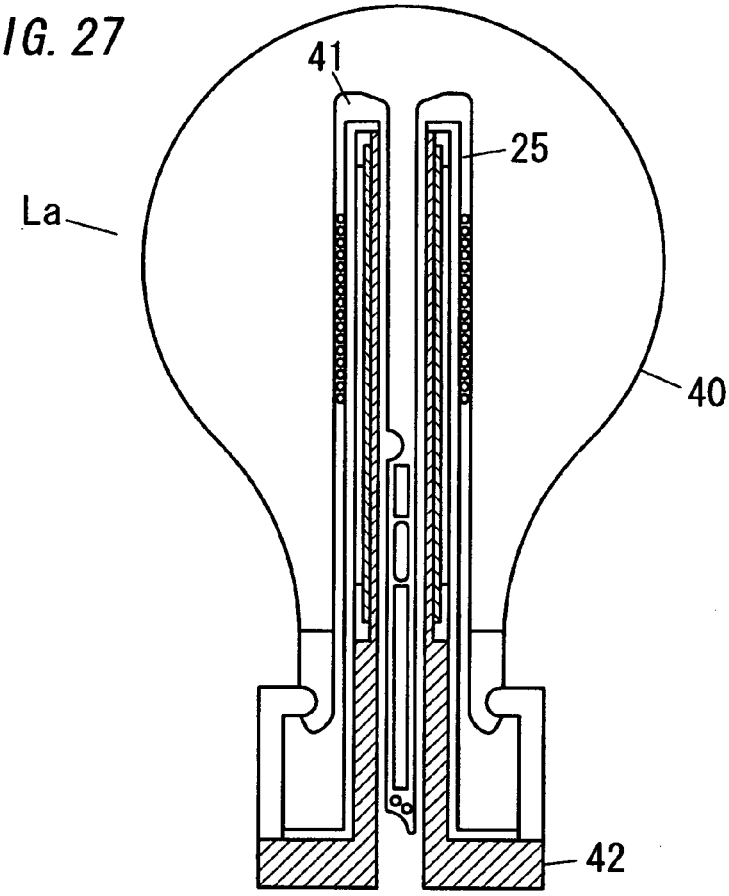
FIG. 27 is a cross sectional view illustrating a lighting fixture of a fourteenth embodiment where an electrodeless discharge lamp is attached to a coupler.

FIG. 27 shows a cross sectional view of the discharge lamp La being the electrodeless discharge lamp. The discharge lamp La includes a bulb 40 shaped into a bulb shape. A discharge gas is filled in the bulb 40. The bulb 40 is provided in its bottom with a cavity 41. The induction coil 25 carried by the coupler 42 is inserted into the cavity 41.

Figure 28:
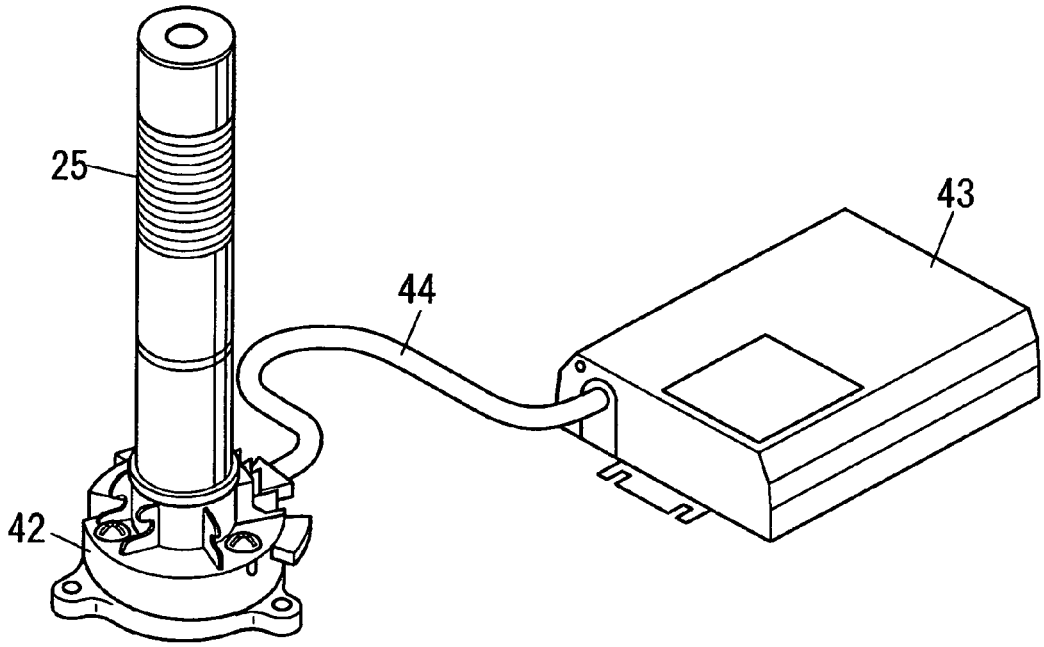
FIG. 28 is an exterior perspective view illustrating the coupler and a lighting apparatus of the fourteenth embodiment.

FIG. 28 shows the lighting apparatus 1 including the coupler 42. The lighting apparatus 1 includes a metal case 43 housing the aforementioned circuit component. In the lighting apparatus 1, the lighting circuit unit 2 is electrically connected to the induction coil 25 by use of a lamp cable 44 extending from the metal case 43. The coupler 42 is inserted into the cavity 41 of the bulb 40 of the discharge lamp La. The lighting circuit unit 2 supplies high-frequency power to the induction coil via the lamp cable 44, thereby generating a high-frequency electromagnetical field inside the bulb 40. As a result, the discharge gas starts to discharge.

Figure 29:
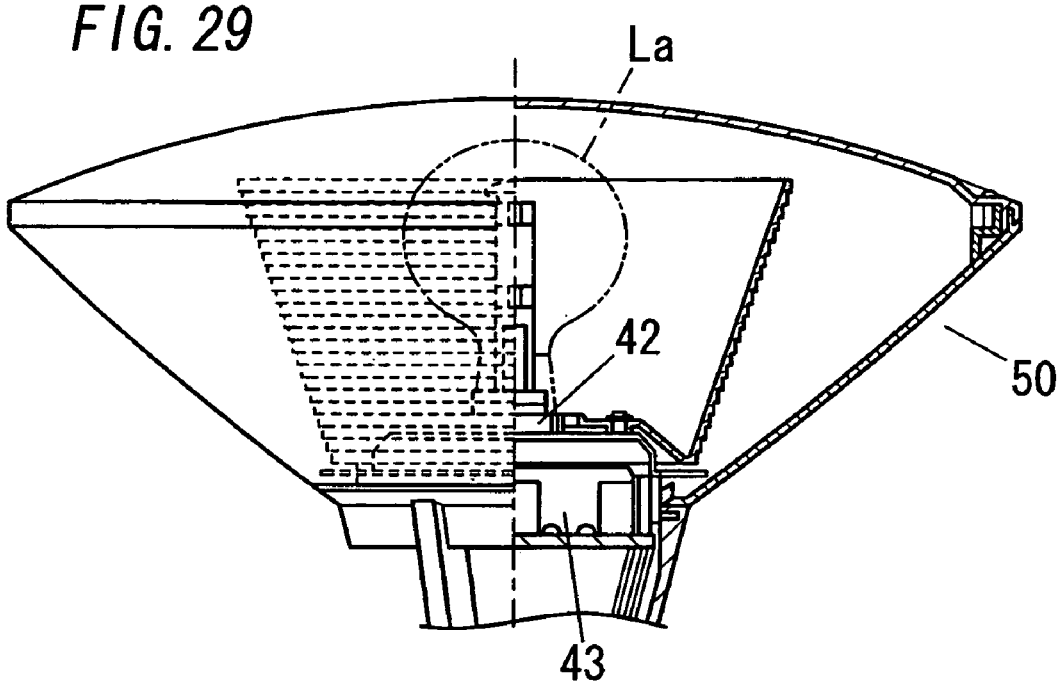
FIG. 29 is a partially cross sectional view illustrating an example of the lighting fixture of the fourteenth embodiment.
Figure 30:
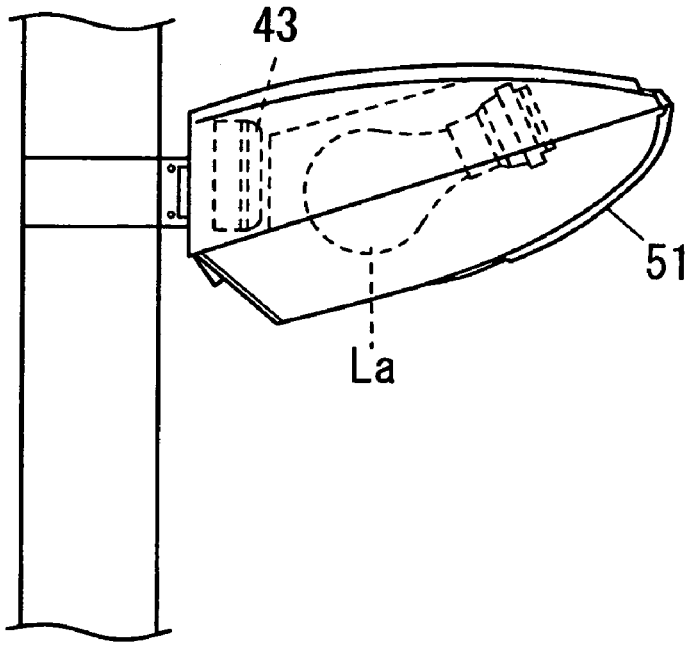
FIG. 30 is an external view illustrating an another example of the lighting fixture of the fourteenth embodiment.
Figure 31A:
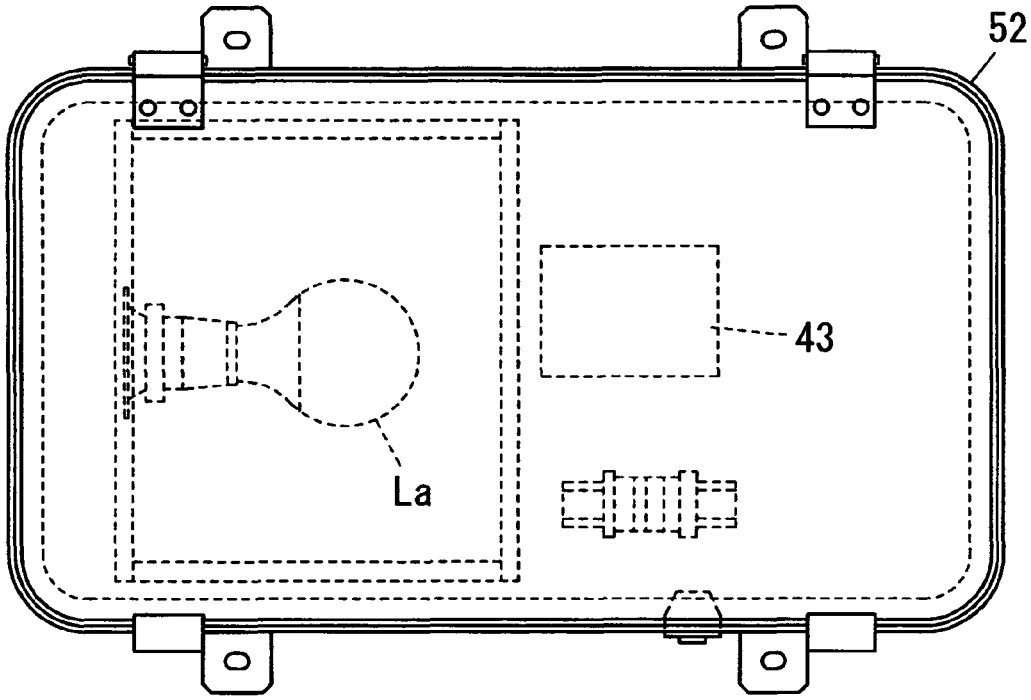
FIG. 31A is a front view illustrating an another example of the lighting fixture of the fourteenth embodiment.
Figure 31B:
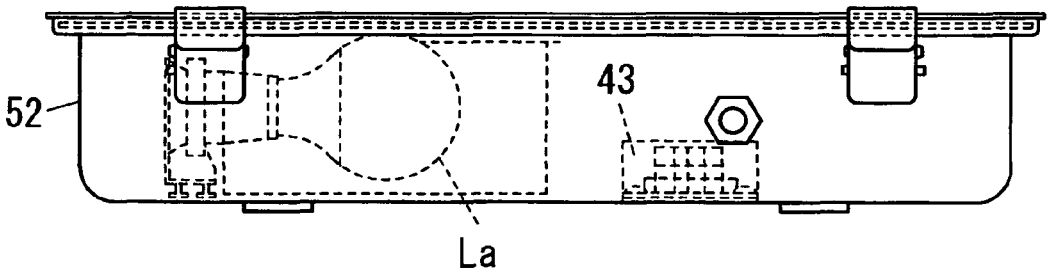
FIG. 31B is a bottom view illustrating the lighting fixture of FIG. 31A.

Herein, FIGS. 29 to 31 show examples of the lighting fixture. The lighting fixture can be applied to a street light 50 shown in FIG. 29, a security light 51 shown in FIG. 30, and a tunnel lighting fixture 52 shown in FIGS. 31A and 31B.

As mentioned in the above, since the lighting apparatus 1 of any one of the above mentioned second to thirteenth embodiment is used, it is possible to provide a safer lighting fixture.

Obviously, the lighting fixture including the lighting apparatus 1 explained in the first embodiment and a light source may be applied to the street light 50, the security light 51, and the tunnel lighting fixture 52. The lighting fixture including a light source such as a light emitting diode, and an organic electroluminescence device, and the lighting apparatus 1 configured to control the light source can be applied for intended use.

The invention claimed is:

1. A lighting apparatus comprising:

a lighting circuit unit configured to activate a light source;

a timer unit configured to measure accumulated operation time of said lighting circuit unit;

a life judgment unit configured to store a first judgment time and a second judgment time longer than said first judgment time, said life judgment unit being configured to compare said accumulated operation time with said first judgment time and output a first judgment signal when said accumulated operation time becomes equal to said first judgment time, and said life judgment unit being configured to compare said accumulated operation time with said second judgment time and output a second judgment signal when said accumulated operation time becomes equal to said second judgment time;

a timing adjustment unit configured to vary timing at which said life judgment unit outputs said first judgment signal and timing at which said life judgment unit outputs said second judgment signal;

an indication unit configured to indicate, upon receiving said first judgment signal from said life judgment unit, a first level of the end of life with said light source kept turned on, said indication unit being configured to indicate, upon receiving said second judgment signal from said life judgment unit, a second level of the end of life, and said second level of the end of life is later than the first level of the end of life, wherein said timing adjustment unit is configured to vary said first judgment time and said second judgment time respectively, said life judgment unit being configured to compare said accumulated operation time measured by said timer unit with said first judgment time varied by said timing adjustment unit and output said first judgment signal when said accumulated operation time measured by said timer unit becomes equal to said first judgment time varied by said timing adjustment unit, and said life judgment unit being configured to compare said accumulated operation time measured by said timer unit with said second judgment time varied by said timing adjustment unit and output said second judgment signal when said accumulated operation time measured by said timer unit becomes equal to said second judgment time varied by said timing adjustment unit, wherein said timing adjustment unit is configured to randomly vary said first judgment time within a first variation width and to randomly vary said second judgment time within a second variation width.

2. A lighting apparatus as set forth in claim 1, wherein said lighting circuit unit is configured to activate said light source selected from an electrodeless discharge lamp, a light emitting diode, and an organic electroluminescence device.

3. A lighting fixture comprising:

a light source;

a lighting apparatus defined by claim 1.

4. A lighting apparatus as set forth in claim 1, wherein said first level of the end of life is defined as the initial level of the end of life, said second level of the end of life being defined as the last level of the end of life, and said first variation width and said second variation width being selected such that the maximum of the first judgment time within said first variation width is shorter than the minimum of said second judgment time within said second variation width.

5. A lighting apparatus as set forth in claim 1, wherein said second variation width is greater than said first variation width.

6. A lighting apparatus comprising:

a lighting circuit unit configured to activate a light source;

a timer unit configured to measure accumulated operation time of said lighting circuit unit;

a life judgment unit configured to store a first judgment time and a second judgment time longer than said first judgment time, said life judgment unit being configured to compare said accumulated operation time with said first judgment time and output a first judgment signal when said accumulated operation time becomes equal to said first judgment time, and said life judgment unit being configured to compare said accumulated operation time with said second judgment time and output a second judgment signal when said accumulated operation time becomes equal to said second judgment time;

a timing adjustment unit configured to vary timing at which said life judgment unit outputs said first judgment signal and timing at which said life judgment unit outputs said second judgment signal;

an indication unit configured to indicate, upon receiving said first judgment signal from said life judgment unit, a first level of the end of life with said light source kept turned on, said indication unit being configured to indicate, upon receiving said second judgment signal from said life judgment unit, a second level of the end of life, and said second level of the end of life is later than the first level of the end of life, wherein said timing adjustment unit is configured to vary said first judgment time and said second judgment time respectively, said life judgment unit being configured to compare said accumulated operation time measured by said timer unit with said first judgment time varied by said timing adjustment unit and output said first judgment signal when said accumulated operation time measured by said timer unit becomes equal to said first judgment time varied by said timing adjustment unit, and said life judgment unit being configured to compare said accumulated operation time measured by said timer unit with said second judgment time varied by said timing adjustment unit and output said second judgment signal when said accumulated operation time measured by said timer unit becomes equal to said second judgment time varied by said timing adjustment unit, wherein said lighting apparatus includes a detection unit configured to detect at least one of a temperature of said lighting apparatus, a voltage applied to said lighting apparatus, and a current flowing through said lighting apparatus, and output detection value indicative thereof, said timing adjustment unit being configured to respectively vary said first judgment time and said second judgment time according to said detection value received from said detection unit, said second level of the end of life being defined as the last level of the end of life, and said second judgment time being shorter than an end of life of any component of said lighting circuit unit.

7. A lighting apparatus as set forth in claim 6, wherein said lighting circuit unit is configured to activate said light source selected from an electrodeless discharge lamp, a light emitting diode, and an organic electroluminescence device.

8. A lighting fixture comprising:

a light source;

a lighting apparatus defined by claim 6.

9. A lighting apparatus comprising:

a lighting circuit unit configured to activate a light source;

a timer unit configured to measure accumulated operation time of said lighting circuit unit;

a life judgment unit configured to store a first judgment time and a second judgment time longer than said first judgment time, said life judgment unit being configured to compare said accumulated operation time with said first judgment time and output a first judgment signal when said accumulated operation time becomes equal to said first judgment time, and said life judgment unit being configured to compare said accumulated operation time with said second judgment time and output a second judgment signal when said accumulated operation time becomes equal to said second judgment time;

a timing adjustment unit configured to vary timing at which said life judgment unit outputs said first judgment signal and timing at which said life judgment unit outputs said second judgment signal;

an indication unit configured to indicate, upon receiving said first judgment signal from said life judgment unit, a first level of the end of life with said light source kept turned on, said indication unit being configured to indicate, upon receiving said second judgment signal from said life judgment unit, a second level of the end of life, and said second level of the end of life is later than the first level of the end of life, wherein said timing adjustment unit is configured to vary said accumulated operation time measured by said timer, said life judgment unit being configured to compare said accumulated operation time varied by said timing adjustment unit with said first judgment time and output said first judgment signal when said accumulated operation time varied by said timing adjustment unit becomes equal to said first judgment time, and said life judgment unit being configured to compare said accumulated operation time varied by said timing adjustment unit with said second judgment time and output said second judgment signal when said accumulated operation time varied by said timing adjustment unit becomes equal to said second judgment time, wherein said timer unit comprises an oscillator configured to output a clock signal at a constant period, and a counting circuit configured to count the number of said clock signals output from said oscillator, said timing adjustment unit being configured to randomly vary a threshold for said counting circuit within a predetermined variation width, and said counting circuit being configured to increase said accumulated operation time by a constant amount each time when the number of said clock signals output from said oscillator becomes identical to said threshold varied by said timing adjustment unit, thereby measuring said accumulated operation time.

10. A lighting apparatus comprising:

a lighting circuit unit configured to activate a light source;

a timer unit configured to measure accumulated operation time of said lighting circuit unit;

a life judgment unit configured to store a first judgment time and a second judgment time longer than said first judgment time, said life judgment unit being configured to compare said accumulated operation time with said first judgment time and output a first judgment signal when said accumulated operation time becomes equal to said first judgment time, and said life judgment unit being configured to compare said accumulated operation time with said second judgment time and output a second judgment signal when said accumulated operation time becomes equal to said second judgment time;

a timing adjustment unit configured to vary timing at which said life judgment unit outputs said first judgment signal and timing at which said life judgment unit outputs said second judgment signal;

an indication unit configured to indicate, upon receiving said first judgment signal from said life judgment unit, a first level of the end of life with said light source kept turned on, said indication unit being configured to indicate, upon receiving said second judgment signal from said life judgment unit, a second level of the end of life, and said second level of the end of life is later than the first level of the end of life, wherein said timing adjustment unit is configured to vary said accumulated operation time measured by said timer, said life judgment unit being configured to compare said accumulated operation time varied by said timing adjustment unit with said first judgment time and output said first judgment signal when said accumulated operation time varied by said timing adjustment unit becomes equal to said first judgment time, and said life judgment unit being configured to compare said accumulated operation time varied by said timing adjustment unit with said second judgment time and output said second judgment signal when said accumulated operation time varied by said timing adjustment unit becomes equal to said second judgment time, wherein said lighting apparatus includes a detection unit configured to detect at least one of a temperature of said lighting apparatus, a voltage applied to said lighting apparatus, and a current flowing through said lighting apparatus, and output detection value indicative thereof, said timing adjustment unit being configured to vary said accumulated operation time according to said detection value received from said detection unit, said second level of the end of life being defined as the last level of the end of life, and said second judgment time being shorter than an end of life of any component of said lighting circuit unit.

* * * * *